US005185236A

United States Patent [19]

Shiba et al.

[11] Patent Number: 5,185,236

[45] Date of Patent: Feb. 9, 1993

[54] FULL COLOR RECORDING MATERIALS AND A METHOD OF FORMING COLORED IMAGES

[75] Inventors: Keisuke Shiba; Kiyoshi Kawai; Masaki Okazaki; Yoshiharu Okino, all of Kanagawa, Japan

[73] Assignee: Fuji Photo Film Co., Ltd., Kanagawa, Japan

[21] Appl. No.: 729,910

[22] Filed: Jul. 15, 1991

Related U.S. Application Data

[63] Continuation of Ser. No. 448,176, Dec. 8, 1989, abandoned.

[30] Foreign Application Priority Data

Dec. 9, 1988 [JP] Japan ..... 63-310211

[51] Int. Cl.[5] ..... G03C 7/00

[52] U.S. Cl. ..... 430/505; 430/506; 430/508; 430/563; 430/567; 430/572; 430/573; 430/578; 430/584; 430/944; 430/363

[58] Field of Search ..... 430/506, 508, 584, 578, 430/944, 363, 563, 572, 573, 567, 505

[56] References Cited

U.S. PATENT DOCUMENTS

| | | | |
|---|---|---|---|
| 4,493,889 | 1/1985 | Mihara et al. | 430/572 |
| 4,536,473 | 8/1985 | Mihara | 430/575 |
| 4,564,591 | 1/1986 | Tanaka et al. | 430/567 |
| 4,603,104 | 9/1986 | Philip, Jr. | 430/572 |
| 4,619,892 | 10/1986 | Simpson et al. | 430/505 |
| 4,770,961 | 9/1988 | Tanaka et al. | 430/14 |
| 4,892,807 | 1/1990 | Hirabayashi | 430/567 |
| 5,057,405 | 10/1991 | Shiba et al. | 430/363 |

FOREIGN PATENT DOCUMENTS

| | | |
|---|---|---|
| 0244184 | 11/1987 | European Pat. Off. . |
| 0273430 | 7/1988 | European Pat. Off. . |

*Primary Examiner*—Richard L. Schilling
*Assistant Examiner*—Thomas R. Neville
*Attorney, Agent, or Firm*—Sughrue, Mion, Zinn, Macpeak & Seas

[57] ABSTRACT

A full color recording material which has, on a support, at least three silver halide photosensitive emulsion layers which have different color sensitivities and which contain a yellow coupler, magenta coupler and cyan coupler, respectively, and in which at least two of these layers are selectively spectrally sensitized to match semiconductor laser light beams of wavelengths greater than 670 nm, wherein said at least three silver halide photosensitive layers which have different color sensitivities each contains silver chlorobromide grains with a layer average silver chloride content of at least 96 mol %, and said silver chlorobromide grains have a silver bromide local phase of which the silver bromide content is higher than that of the surroundings and a method for forming color images wherein the recording material is imagewise exposed while being transported at a feed rate which matches the scanning rate with semiconductor light beams, and substantially continuously to the exposing, the material is subjected to a color development process wherein the time for color development using a color development solution is not more than 60 seconds, and the time for whole color development process including color development, breach-fixing, washing and/or stabilizing is not more than 180 seconds.

4 Claims, No Drawings

FULL COLOR RECORDING MATERIALS AND A METHOD OF FORMING COLORED IMAGES

This is a continuation of application Ser. No. 07/448,176 filed Dec. 8, 1989, now abandoned.

FIELD OF THE INVENTION

The present invention concerns full color recording materials on which soft image information is reproduced and recorded in full color images which have gradation by means of a scanning exposure system and, more precisely, it concerns inexpensive and high quality full color recording materials which have stable spectral sensitivities in the red-infrared region corresponding to the wavelengths of two or three types of semiconductor laser light beams, and which have a latent image stability, and a rapid color development processing potential which are appropriate for the scanning exposure rate.

BACKGROUND OF THE INVENTION

Techniques for the production of a hard copy from soft information are being used as a result of the recent progress which has been made with information processing and storage and with techniques for image processing, and as a result of the use of communication circuits. In addition, very high quality photographic prints can easily and inexpensively be provided as a result of the progress which has been made with silver halide photosensitive materials and compact, rapid and simple development systems (for example, the mini-lab system). Therefore, there is a great demand for that inexpensive hard copies with the high picture quality of photographic prints can be obtained easily from soft information.

Conventional techniques for the provision of a hard copy from soft information have included those, in which photosensitive recording materials are not used, such as the systems in which electrical signals and electromagnetic signals are used and ink jet systems. Other conventional techniques in which photosensitive materials are used include silver halide photosensitive materials and electrophotographic materials. In the latter case, there are systems in which recordings are made with an optical system which emits controlled light in accordance with the image information, and this enables not only optical system production, image resolution and binary recording but also multi-tone recording to be achieved. These systems are useful for obtaining high image quality. The use of silver halide photosensitive materials are more convenient than systems in which electrophotographic materials are used since image formation is achieved chemically. However, systems in which silver halide photosensitive materials are used must have photosensitive wavelengths which match the optical system, the stable sensitivity, latent image stability, resolution, color separation of the three primary colors, and rapid and simple color development processing with attention given to cost.

In the past, copying machines wherein electrophotographic techniques are used, laser printers, silver halide based heat developable dye diffusion systems, and Pictrography (a trade name: made by the Fuji Photographic Film Co.) which used LED's existed as a color copying technique.

Color photographic materials which use at least three silver halide emulsion layers with the usual color couplers are formed on a base. These layers are not exposed using visible light but at least two of the layers are sensitized to laser light in the infrared region. The fundamental conditions for these materials are disclosed in JP-A-61-137149. (The term "JP-A" as used herein signifies an "unexamined published Japanese patent application".)

In JP-A-63-197947, full color recording materials in which a unit of at least three photosensitive layers which contain color couplers is provided on a support are disclosed. At least one layer is formed in such a way that it is photosensitive to LED or semiconductor laser light, being spectrally sensitized in such a way that the spectrally sensitized peak wavelength is longer than about 670 nm, and with which color images can be obtained by means of a light scanning exposure and a subsequent color development process. More precisely, a method of spectral sensitization which is stable and provides high speed, and a method of using dyes are disclosed in JP-A-63-197947.

In the specification of JP-A-55-13505, a color image recording system using a color photographic material in which yellow, magenta and cyan color formation is controlled with three light beams which have different wavelengths, for example, green, red and infrared light beams, respectively, is disclosed.

The basic conditions for a continuous tone scanning type printer semiconductor laser output controlling mechanism are described by S. H. Baek on pages 245–247 of the published papers of the *Fourth International Symposium (SPSE) on Non-impact Printing* (Mar. 23, 1988).

Devices in which light-insensitive recording materials are used for obtaining a hard copy from soft information are effective for low image quality results, but it is virtually impossible to obtain photographic print type picture quality with A4 to B4 or smaller sizes which are normally used. Even though the cost per sheet is low, the cost is high when picture quality (for example, recording content:density×surface area) is taken into account. The image quality with electrophotographic systems is worse than that obtained with silver halide photosensitive material systems. Also the image forming process is more complex mechanically and it is difficult to obtain a hard copy in a stable manner.

On the other hand, high image quality is readily obtained with systems in which silver halide photosensitive materials are used, but the photosensitive materials themselves must be provided with photosensitive wavelengths which match the optical system, stable sensitivity, latent image stability, and separation of the three primary colors etc. The semiconductor lasers which are used in the present invention have a generating device which can be obtained inexpensively and which is more compact than that required with gas lasers. But, contrary to expectation, the emitted light intensity and the emission wavelength regions are unstable, and with a semiconductor laser light of comparatively short wavelengths, the modulation tolerance band of the current dependence of the emission intensity is narrow in practice and special steps must be taken in the silver halide photosensitive material to reproduce the excellent image quality of the silver halide photosensitive materials. First, the spectrally sensitized wavelength region of each photosensitive layer must be sufficiently wide (for example, 40 to 60 nm wide), and there must be little overlap of the sensitive wavelengths of the various photosensitive layers. For example, the difference in photographic speed from the other layers at the principal sensitive wavelength of a photosensitive layer should be at least 0.80 (logarithmic representation). Second, the latent image obtained with an exposure time of $10^{-6}$ to $10^{-8}$ second must be stable, and the gradation represented by a photographic characteristic curve must be sufficiently linear in the exposure region (represented by logalithm) above 1.0, and preferably in the exposure region above 1.5.

No mention is made of these important points in the afore-mentioned JP-A-55-13505 or in the aforementioned paper by Baek et al. The basic structure of the color photosensitive materials is disclosed in the aforementioned JP-A-61-137149 (corresponding to EP 183528), but there is no actual disclosure of the preferred means of achieving this structure. Practical performance cannot be obtained with the color photosensitive materials indicated in Examples 1 to 10. Moreover, there is no disclosure of a practical means of using these silver halide photosensitive materials.

Silver iodobromide emulsions, silver bromide emulsions and silver chlorobromide emulsions are known as silver halide emulsions used in silver halide photosensitive emulsions which can be exposed using laser light beams. The color development processing of full color recording materials should be rapid, taking not more than 60 seconds, to match the rapidity of the exposures which are made with an output device with semiconductor laser light beams used in the present invention. Silver halide emulsions which have a high silver chloride content are useful for this purpose. However, it is difficult to provide infrared sensitivity to wavelengths above 670 nm, and especially to wavelengths above 750 nm, with silver chlorobromide emulsions which have a high silver chloride content, especially when the silver chloride content is above 95 mol %. There are three reasons. First, the high speed is affected, and the production and storage stabilities are poor. It is especially difficult to obtain good linear gradation at high photographic speed and difficult to obtain a sharp spectral sensitivity distribution. Second, it is difficult to obtain high photographic speeds with short exposure times, for example, of from $10^{-6}$ to $10^{-8}$ seconds. Finally, the adsorpability of a sensitizing agent on the silver halide grains is low. If color couplers and high concentrations of surfactants or organic solvents are present, a decrease of photographic speed and fogging are liable to occur during dissolution of the emulsion and ageing. Hence, the discovery of a technique which provides high photographic speed even when silver halide emulsions which have a high silver chloride content are used, and which provides excellent latent image stability with rapid processing is desirable.

SUMMARY OF THE INVENTION

The first object of the present invention is to provide full color recording materials which have been selectively spectrally sensitized to wavelengths greater than 670 nm, and especially long wavelength regions which matches to laser light beams and which have excellent photographic speed stability and latent image stability.

The second object of the present invention is to provide full color recording materials which have excellent color separation between each photosensitive layer and which have excellent sharpness.

The third object of the present invention is to provide full color recording materials which can be color developed and processed rapidly, easily and continuously, matching to the scanning exposure rate.

The fourth object of the present invention is to provide a method of forming full color images by rapid color development of 60 seconds or less essentially following a scanning exposure, followed by bleach-fixing and rinsing or stabilization, in which the time after color development up to the completion of rinsing or stabilization is not more than 180 seconds.

Other objects of the present invention are clear from the disclosures in the specification.

It has been discovered that the aforementioned objects of the present invention can be realized by the use of full color recording materials which have, on a support, at least three silver halide photosensitive layers which have different color sensitivities and which contain a yellow coupler, a magenta coupler and a cyan coupler, respectively, and in which at least two of these layers are selectively spectrally sensitized to match semiconductor laser light beams of wavelengths greater than 670 nm, wherein the at least three silver halide photosensitive layers which have different color sensitivities each contain silver chlorobromide grains with a layer average silver chloride content of at least 96 mol %, and the silver chlorobromide grains have a silver bromide local phase of which the silver bromide content is higher than that of the surroundings thereof.

DETAILED DESCRIPTION OF THE INVENTION

The light beam outputting mechanism used in this invention is described below.

Actual examples of the semiconductor lasers which can be used in the present invention include those in which materials such as $In_{1-x}Ga_xP$ (up to 700 nm), $GaAs_{1-x}P_x$ (610 to 900 nm), $Ga_{1-x}Al_xAs$ (690 to 900 nm), InGaAsP (1100 to 1670 nm) and AlGaAsSb (1250 to 1400 nm), for example, are used as the luminescence materials. The light which is directed onto the full color photosensitive materials in the present invention may be the light which is emitted by the above mentioned semiconductor lasers or the light from a YAG laser in which an Nb:YAG crystal is excited by means of a $GaAs_xP_{(1-x)}$ (1064 nm) light emitting diode. The use of light selected from among the semiconductor laser light beams of wavelength about 670, 680, 750, 780, 810, 830 and 880 nm is preferred.

Furthermore, devices with which the wavelength of laser light is halved using a non-linear optical effect with a secondary higher harmonic wave generator element (SHG element), for example, those in which CD*A and KD*P are used as non-linear optical crystals, can be used in the present invention (See pages 122–139 of the Laser Society publication *Laser Handbook*, published Dec. 15, 1982). Furthermore, $LiNbO_3$ optical wave guide elements in which optical wave guides have been formed by replacing the $Li^+$ ions in an $LiNbO_3$ crystal with $H^+$ ions can be used (*Nikkei Electronics* Jul. 14, 1986 (No. 399), pages 89–90).

When a laser beam has a wavelength of, for example, 670 nm, it hunts a wavelength region of from about 660 to 680 nm (providing that it thermally fluctuates). Therefore, the sensitivity which is given to an emulsion should be in the region of from 660 to 680 nm in order to obtain stable sensitivity. In the present invention "a laser beam having a wavelength of X nm" should be construed that the laser beam has a wavelength of a region including the wavelength of X nm which may be exist in the hunting region.

The output device disclosed in the specification of Japanese Patent Application No. 63-226552 can be used in the present invention.

The silver halide emulsions in the present invention are spectrally sensitized in the infrared region. These emulsions have a high photographic speed and excellent stability, especially latent image stability, as a result of the structure of the silver halide grains, and especially as a result of the establishment of a local phase at the surface of the grains. Super-sensitizing techniques can be used jointly in the present invention, and a tolerable latent image stability can be realized even in silver halide emulsions having a high content of silver chloride. This is an unexpected feature.

The first distinguishing feature of the silver halide emulsions of the present invention is the halogen composition. The halogen composition of the silver halide grains must be essentially silver iodide free silver chlorobromide in which at least 96 mol % of all the silver halide from which the silver halide grains are constructed is silver chloride. Here, the term "essentially silver iodide free" signifies that the silver iodide content is not more than 1.0 mol %. The preferred halogen composition for the silver halide grains is that of an essentially silver iodide free silver chlorobromide in which from 96 mol % to 99.9 mol % of all the silver halide from which the silver halide grains are constructed is silver chloride. In the silver halide grains silver bromide is contained at least 0.1 mol %, and it may be contained up to 4 mol %.

The second distinguishing feature of the silver halide emulsions of the present invention is the grain structure. The silver halide grains of the present invention have a local phase which has a different silver bromide content in at least some of the interior and surface parts. The silver halide grains used in this invention preferably have a local phase in which the silver bromide content is at least 15 mol %. The arrangement of this local phase in which the silver bromide content is higher than that of the surroundings can be provided freely, in accordance with the intended purpose, and it may be in the interior of the silver halide grains, or at the surface or in the sub-surface region, or it may be divided between the interior and the surface or sub-surface regions. Furthermore, the local phase may form a layer-like structure which surrounds the silver halide or it may have a discontinuous isolated structure within the grain or at the grain surface. In a preferred arrangement of the local phase in which the silver bromide content is higher than that of the surroundings, a local phase in which the silver bromide content exceeds 15 mol % is grown epitaxially and locally on the surface of the silver halide grains.

The silver bromide content of the local phase preferably exceeds 15 mol % but, if it is too high, characteristics undesirable in a photographic photosensitive material, such as desensitization when pressure is applied to the photosensitive material and large variations in speed and gradation due to variations in the composition of the processing baths, for example, are liable to occur. In consideration of these facts, the silver bromide content of the local phase is preferably within the range from 20 to 60 mol % and most preferably within the range from 30 to 50 mol %, and the remainder is most desirably silver chloride. The silver bromide content of the local phase can be measured, for example, using the X-ray diffraction method (for example, that described in the Japanese Chemical Society Publication entitled *New Experimental Chemistry Course* 6, *Structure Analysis* published by Maruzen), or the XPS method (for example, that described in *Surface Analysis, The Application of IMA, Auger Electron-Photoelectron Spectroscopy,* published by Kodansha). The local phase preferably contains from 0.1 to 20%, and most preferably from 0.5 to 7% of all the silver which is contained in the silver halide grains in the present invention. The amount of silver halide having the local phase is preferably 50 mol % or more, more preferably 80 mol % or more, and most preferably 90 mol % or more.

The boundary between such a local phase which has high silver bromide content and the other phase may be a distinct boundary, or there may be a short transition zone in which the halogen composition changes gradually.

Various methods can be used to form such a local phase which has a high silver bromide content. For example, a local phase can be formed by reacting a soluble halide with a soluble silver salt using a single jet procedure or a double jet procedure. Moreover, the local phase can be formed using a so-called conversion method which includes a process in which a silver halide which has been formed is converted to a silver halide which has a lower solubility product. Alternatively, the local phase can be formed by recrystallization at the surface of the silver chloride grains due to the addition of fine silver bromide grains.

In the case of silver halide grains which have a discontinuous isolated local phase at the surface, the grain substrate and the local phase are both present on essentially the same surface of the grain, and so they both function at the same time during exposure and development processing. Thus, the invention is useful for increasing photographic speed, for latent image formation and for rapid processing, and it is especially useful in terms of the gradation balance and the efficient use of the silver halide. In the present invention, the increase in sensitivity, stabilization of photographic speed and the stability of the latent image which present problems with red-infrared sensitized high silver chloride content emulsions are markedly improved overall by the establishment of the local phase, and the distinguishing features of silver chloride emulsions in connection with rapid processing can be maintained.

Furthermore, anti-foggants and sensitizing dyes etc. can be adsorbed on the grain substrate and on the local phase with the functions separated, and it is possible to achieve chemical sensitization, to suppress the occurrence of fogging and to achieve rapid development easily.

The silver halide grains included in the silver halide emulsions of this invention are cubic or tetradecahedral grains which have a (100) plane. In many cases the local phase is at, or in the vicinity of, the corners of the cube, or on the surface of a (111) plane. A discontinuous isolated local phase on the surface of these silver halide grains can be formed by halogen conversion by supplying bromide ions to an emulsion which contains the substrate grains while controlling the pAg and pH values, the temperature and the time. It is desirable that the halide ions should be supplied at a low concentration, and organic halogen compounds or halides which have been covered with a semipermeable membrane as an encapsulating film can be used, for example, for this purpose. Furthermore, a "local phase" can be formed by growing silver halide locally by supplying silver ions and halide ions to an emulsion which contains the substrate grains while controlling the pAg value or by mixing a fine grain silver halide, for example, fine grains of silver iodobromide, silver bromide, silver chlorobromide or silver iodochlorobromide, with the substrate and carrying out a recrystallization. In this case, a small amount of a silver halide solvent can be used, as desired. Furthermore, the CR-compounds disclosed in European Patents 273,430 and 273,429, and in U.S. Pat. No. 4,820,624, EP 273430, Japanese Patent Application 62-152330, and JP-A-1-6941 can be used conjointly. The end point of local phase formation can be assessed easily by observing the form of the silver halide in the ripening process and comparing this with the form of the silver halide grains in the substrate. The composition of the silver halide in the local phase can be measured using the XPS (X-ray photoelectron spectroscopy) method, using an ESCA 750 type spectrometer made by the Shimadzu Dupont Co. for example. Practical details have been described by Someno and Yasumori in *Surface Analysis,* published by Kodansha, 1977. Of course, it can also be determined by calculation from the production details. The silver halide composition, for example, the silver bromide content, in the local phase at the surface of the silver halide grains in the present invention can be measured using the EDX (energy dispersing X-ray analysis) method with an EDX spectrometer fitted to a transmission type electron microscope, and an accuracy of some 5 mol % can be achieved in the measurements by using an aperture having a diameter from about 0.1 to 0.2 μm. Practical details have been disclosed by H. Soejima in *Electron Beam Microanalysis,* published by Nikkan Kogyo Shinbunsha, 1987).

The average size (the average value of the corresponding sphere diameters) of the grains in the silver halide emulsions used in the present invention is preferably not more than 2 μm, but at least 0.1 μm. An average grain size of not more than 1.4 μm, but at least 0.15 μm is especially desirable A narrow grain size distribution is preferred, and mono-disperse emulsions are most preferred. Mono-disperse emulsions which have a regular form are especially desirable in the present invention. Emulsions such that at least 85%, and preferably at least 90%, of all the grains in terms of the number of grains or in terms of weight are within ±20% of the average grain size are especially desirable.

The photographic emulsions used in the present invention can be prepared using the methods disclosed, for example, by P. Glafkides in *Chimie et Physique Photographique,* published by Paul Montel, 1966, by G. F. Duffin in *Photographic Emulsion Chemistry,* published by Focal Press, 1966, and by V. L. Zelikmann et al. in *Making and Coating Photographic Emulsions,* published by Focal Press, 1964. That is to say, they can be prepared using acidic methods, neutral methods and ammonia methods, for example, but the acid methods are preferred. Furthermore, a single jet procedure, a double jet procedure or a combination of such procedures can be used for reacting the soluble silver salt with the soluble halide. Double jet methods are preferred for obtaining the mono-disperse emulsions which are preferred in the present invention. Methods in which the grains are formed under conditions of excess silver ion (so called reverse mixing methods) can also be used. The method where the silver ion concentration in the liquid phase in which the silver halide is being formed is held constant, the so called controlled double jet method, can be used as one type of double jet method. It is possible to obtain mono-disperse emulsions which are ideal for this invention with a regular crystalline form and a narrow grain size distribution when this method is used. It is desirable that grains such as those described above which are preferably used in the present invention should be prepared on the basis of a double jet method.

It is possible and preferred to obtain mono-disperse silver halide emulsions which have a regular crystalline form and a narrow grain size distribution if physical ripening is carried out in the presence of a known silver halide solvent (for example, ammonia, potassium thiocyanate, and the thioether compounds and thione compounds disclosed, for example, in U.S. Pat. No. 3,271,157, JP-A-51-12360, JP-A-53-82408, JP-A-53-144319, JP-A-54-100717 and JP-A-54-155828).

Noodle washing, flocculation precipitation methods and ultra-filtration can be used, for example, to remove the soluble salts from the emulsion after physical ripening.

The silver halide emulsions used in the present invention can be chemically sensitized by sulfur sensitization or selenium sensitization, reduction sensitization or noble metal sensitization either independently or in combination. That is to say, sulfur sensitization methods in which active gelatin or compounds containing sulfur which can react with silver ions (for example, thiosulfate, thiourea compounds, mercapto compounds and rhodanine compounds) are used. In reduction sensitization methods, reducing substances (for example, stannous salts, amines, hydrazine derivatives, formamidinesulfinic acid and silane derivatives) are used. In noble metal sensitization methods, metal compounds (for example, gold complex salts, and complex salts of the metals of group VIII of the periodic table, such as Pt, Ir, Pd, Rh and Fe) are used. These sensitization methods can be used either independently or in combinations. Furthermore, complex salts of metals of group VIII of the periodic table, for example, Ir, Rh, Fe, can be used separately in the substrate and the local phase. The use of sulfur sensitization or selenium sensitization is especially desirable with the mono disperse silver halide emulsions which are used in the present invention, and the presence of hydroxyazaindene compounds during the sensitization is preferred.

The use of spectrally sensitizing dyes is important in the present invention. Cyanine dyes, merocyanine dyes, complex merocyanine dyes, for example, can be used as spectrally sensitizing dyes in the present invention. Complex cyanine dyes, holopolar cyanine dyes, hemicyanine dyes, styryl dyes and hemioxonol dyes can also be used. Simple cyanine dyes, carbocyanine dyes and dicarbocyanine dyes can be used as cyanine dyes. Dyes can be selected from among those represented by the general formulae (I), (II) and (III) indicated below and used for providing red sensitivity-infrared sensitivity. These sensitizing dyes are distinguished by being comparatively stable in chemical terms, by being quite strongly adsorbed on the surface of silver halide grains and by being excellent in respect to resistance to desorption by dispersions of couplers for example which are also present.

At least one, and preferably at least two, of the at least three photosensitive silver halide layers of the present invention preferably contains at least one type of sensitizing dye selected from among the compounds represented by the general formulae (I), (II) and (III), and these layers are preferably spectrally sensitized selectively to match the wavelengths of semiconductor laser light beams in any of the wavelength regions 660 to 690 nm, 740 to 790 nm, 800 to 850 nm and 850 to 900 nm.

In the present invention, the expression "spectrally sensitized selectively to match the wavelength of semiconductor laser light beams in any of the wavelength regions 660 to 690 nm, 740 to 790 nm, 800 to 850 nm and 850 to 900 nm" means spectral sensitization such that the principal wavelength of a single laser light beam lies within any one of the above-mentioned wavelength regions and, in comparison to the photographic speed (at the principal wavelength of the laser light beam) of the principal photosensitive layer which has been spectrally sensitized to match the principal wavelength of this laser light beam, the photographic speed of the other photosensitive layers at this principal wavelength is in practice at least 0.8 (log representation) lower. For this purpose, it is desirable that the principal sensitized wavelength of each photosensitive layer should be separated from each other by at least 40 nm, corresponding to the principal wavelength of the semiconductor laser light beams used. The sensitizing dyes which provide high photographic speed at the principal wavelength and provide a sharp spectral sensitivity distribution are used. Furthermore, the term "principal wavelength" is used here since although laser light is actually coherent light, a certain width has to be taken into account because of the deviations which occur in practice.

The sensitizing dyes represented by the general formulae (I), (II), (II)' and (III) are described below.

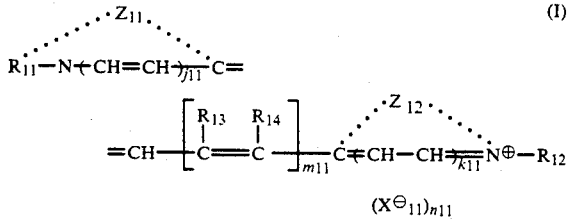

(I)

In this formula, $Z_{11}$ and $Z_{12}$ each represent a group of atoms which is required to form a heterocyclic ring.

The heterocyclic ring is preferably 5- or 6-membered rings which may further contain, at least one of a nitrogen atom, a sulfur atom, an oxygen atom, a selenium atom or a tellurium atom as hetero-atom (and the ring may be bound with a condensed ring and it may be substituted with at least one substituent).

Actual examples of the aforementioned heterocyclic nuclei include a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, a imidazole nucleus, a benzimidazole nucleus, a naphthimidazole nucleus, a 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus and a naphthotellurazole nucleus.

$R_{11}$ and $R_{12}$ each represent an alkyl group, an alkenyl group, an alkynyl group or an aralkyl group. These groups and the groups described hereinafter (in the definition for formulae (II), (II)' and (III)) include groups which have substituent groups. For example, "alkyl groups" include both unsubstituted and substituted alkyl groups, and these groups may be linear chain, branched or cyclic groups. The alkyl group and the alkenyl group each (unsubstituted or before substitution; the same hereinafater) preferably has from 1 to 8 carbon atoms.

Furthermore, actual examples of substituent groups for substituted alkyl, alkenyl, alkynyl and aralkyl groups include halogen atoms (for example, chlorine, bromine, fluorine), cyano groups, alkoxy groups, substituted and unsubstituted amino groups, carboxylic acid groups, sulfonic acid groups and hydroxyl groups. The alkyl groups may be substituted with one, or with a plurality, of these groups.

The vinylmethyl group is an example of an alkenyl group.

Benzyl and phenethyl are examples of aralkyl groups.

Moreover, $m_{11}$ represents an integer of 2 or 3.

$R_{13}$ represents a hydrogen atom, and $R_{14}$ represents a hydrogen atom, a lower alkyl group (having from 1 to 4 carbon atoms; the same hereinafter) or an aralkyl group, or it may be joined with $R_{12}$ to form a 5- or 6-membered ring. Furthermore, in those cases where $R_{14}$ represents a hydrogen atom, $R_{13}$ may be joined with another $R_{13}$ group to form a hydrocarbonyl or heterocyclic ring. These rings are preferably 5- or 6-membered rings containing at least one of N, O and S atoms (the same hereinafter). Moreover, $j_{11}$ and $k_{11}$ represent 0 or 1, $X\ominus_{11}$ represents an acid anion, such as $Cl^-$, $Br^-$, $I^-$, $SCN^-$ and p-toluenesulfonic acid anion, and $n_{11}$ represents 0 or 1.

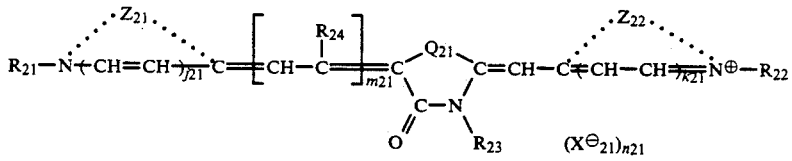

(II)

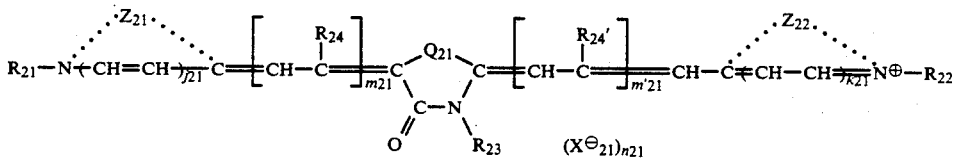

(II)'

In this formula, $Z_{21}$ and $Z_{22}$ have the same Significance as $Z_{11}$ and $Z_{12}$, respectively. $R_{21}$ and $R_{22}$ have the same significance as $R_{11}$ and $R_{12}$, respectively, and $R_{23}$ represents an alkyl group, an alkenyl group, an alkynyl group or an aryl group (for example, substituted or unsubstituted phenyl group). Moreover, $m_{21}$ represents an integer of 2 or 3. $R_{24}$ represents a hydrogen atom, a lower alkyl group or an aryl group, or $R_{24}$ may be joined with another $R_{24}$ group to form a hydrocarbyl or heterocyclic ring. These rings are preferably 5- or 6-membered rings. $R'_{24}$ and $m'_{21}$ have the same significance as $R_{24}$ and $m_{21}$, respectively. The alkyl and alkenyl groups each preferably has from 1 to 8 carbon atoms.

$Q_{21}$ represents a sulfur atom, an oxygen atom, a selenium atom or an

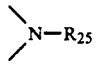

group, and $R_{25}$ has the same significance as $R_{23}$. Moreover, $j_{21}$, $k_{21}$, $X_{21}^{\ominus}$ and $n_{21}$ have the same significance as $j_{11}$, $k_{11}$, $X_{11}^{\ominus}$ and $n_{11}$, respectively.

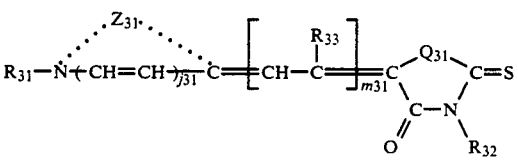

(III)

In this formula, $Z_{31}$ represents a group of atoms which is required to form a heterocyclic ring. Actual examples of this ring include, in addition to those described in connection with $Z_{11}$ and $Z_{12}$, a thiazolidine, a thiazoline, a benzothiazoline, a naphthothiazoline, a selenazolidine, a selenazoline, a benzoselenazoline, a naphthoselenazoline, a benzoxazoline, a naphthoxazoline, a dihydropyridine, a dihydroquinoline, a benzimidazoline and a naphthoimidazoline nuclei.

$Q_{31}$ has the same significance as $Q_{21}$. $R_{31}$ has the same significance as $R_{11}$ or $R_{12}$, and $R_{32}$ has the same significance as $R_{23}$. Moreover, $m_{31}$ represents 2 or 3. $R_{33}$ has the same significance as $R_{24}$, or it may be joined with another $R_{33}$ group to form a hydrocarbyl or heterocyclic ring. Moreover, $j_{31}$ has the same significance as $j_{11}$.

Sensitizing dyes in which the heterocyclic nucleus formed by $Z_{11}$ and/or $Z_{12}$ in general formula (I) is a naphthothiazole nucleus, a naphthoselenazole nucleus, a naphthoxazole nucleus, a naphthoimidazole nucleus, or a 4-quinoline nucleus are preferred. The same is true of $Z_{21}$ and/or $Z_{22}$ in general formula (II) and also $Z_{31}$ in general formula (III). Furthermore, the sensitizing dyes in which the methine chain forms a hydrocarbonyl ring or a heterocyclic ring are preferred.

Sensitization with the M-band of the sensitizing dye is used for infrared sensitization, and so in general, the spectral sensitivity distribution is broader than sensitization with the J-band. Consequently, the provision of a colored layer by incorporating a dye is in a colloid layer on the photosensitive surface side of the prescribed photosensitive layer and correction of the spectral sensitivity distribution is desirable. Such a colored layer effectively prevents color mixing by a filter effect.

Compounds which have a reduction potential of −1.00 (V vs. SCE) or below are preferred for the sensitizing dyes for red-infrared sensitization purposes, and of these compounds, those which have a reduction potential of −1.10 or below are preferred. Sensitizing dyes which have these characteristics are effective for providing high sensitivity and especially for stabilizing the photographic speed and the latent image.

The measurement of reduction potentials can be carried out using phase discrimination type second harmonic alternating current polarography. This can be carried out by using a dropping mercury electrode for the active electrode, a saturated calomel electrode for the reference electrode and platinum for the counter electrode.

Furthermore, the measurement of reduction potentials with phase discrimination type second harmonic alternating current voltammetry using platinum for the active electrode has been described in *Journal of Imaging Science,* Vol. 30, pages 27–45 (1986).

Actual examples of sensitizing dyes of general formulae (I), (II), (II)' and (III) are shown below.

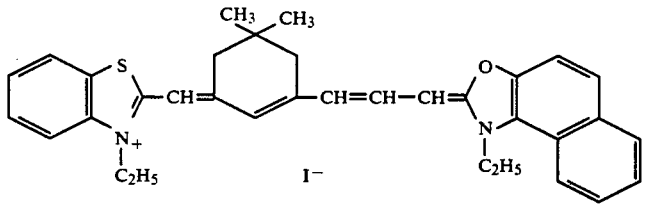

(I-1)

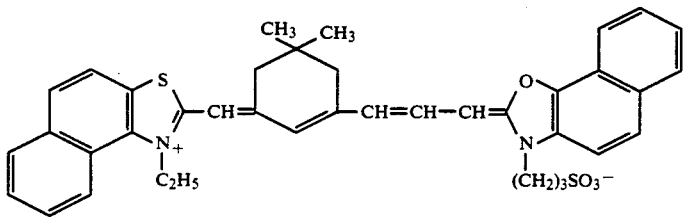

(I-2)

-continued
(I-3)
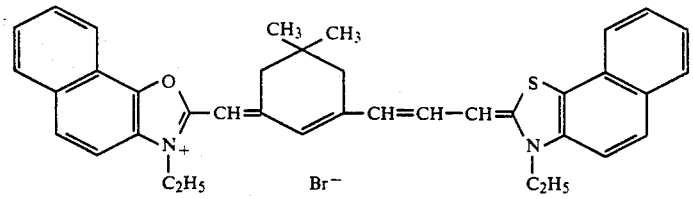
(I-4)
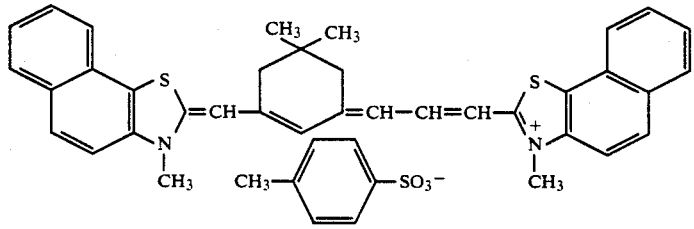
(I-5)
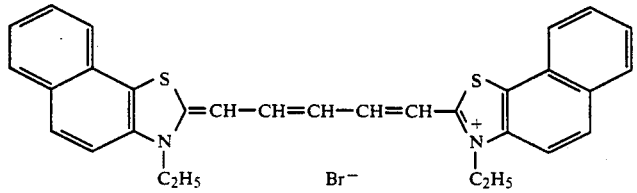
(I-6)
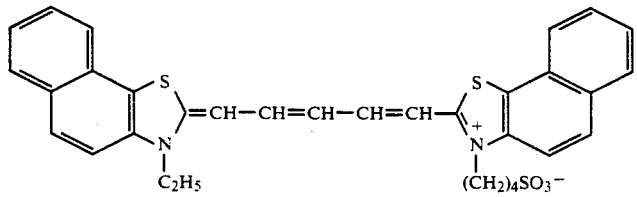
(I-7)
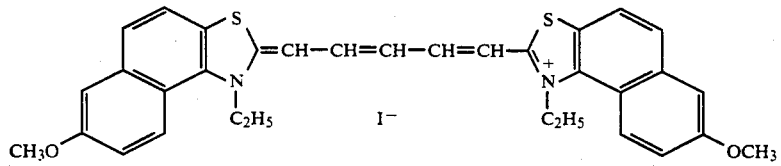
(I-8)
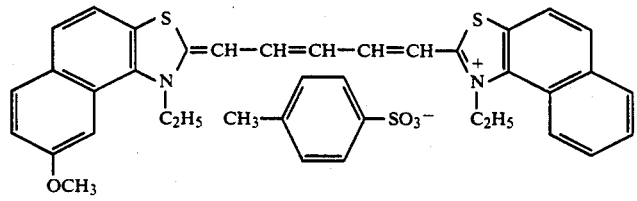
(I-9)
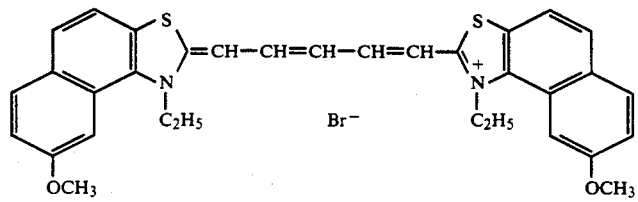

-continued
(I-10)
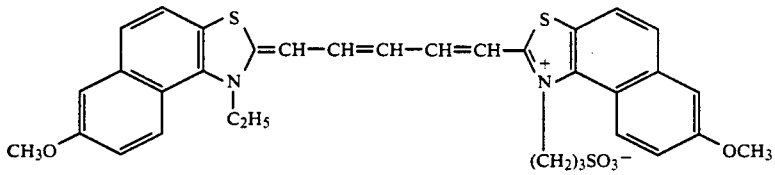
(I-11)
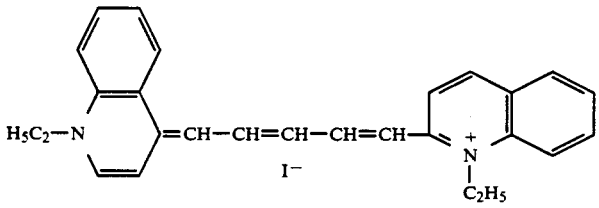
(I-12)
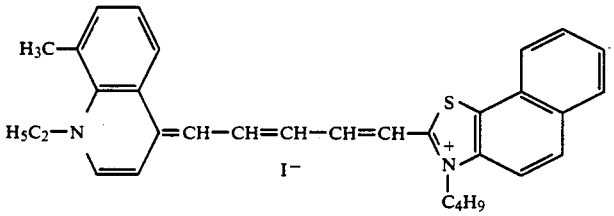
(I-13)
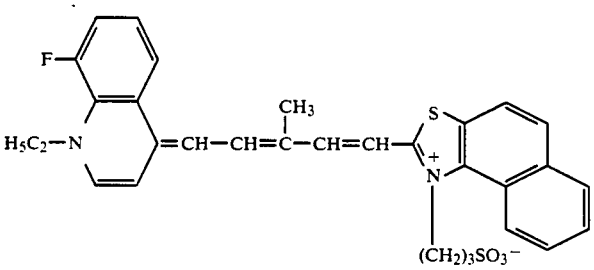
(I-14)
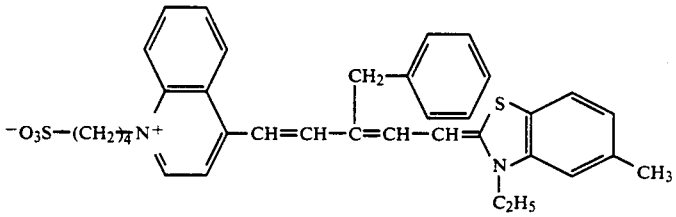
(I-15)
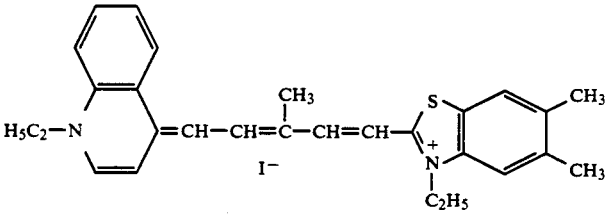
(I-16)
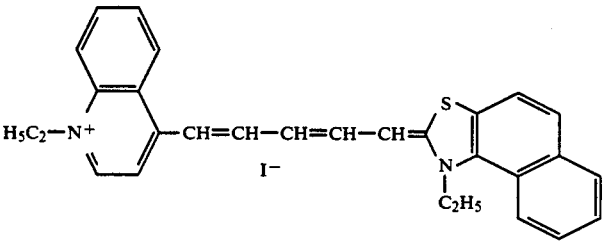

-continued
(I-17)
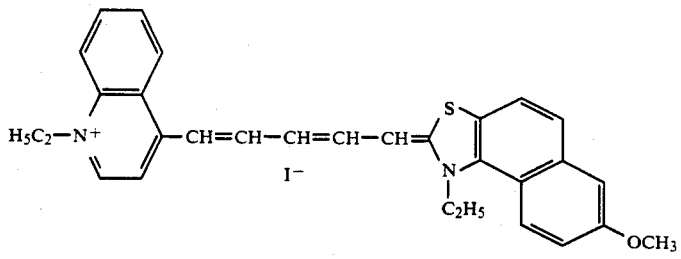
(II-1)
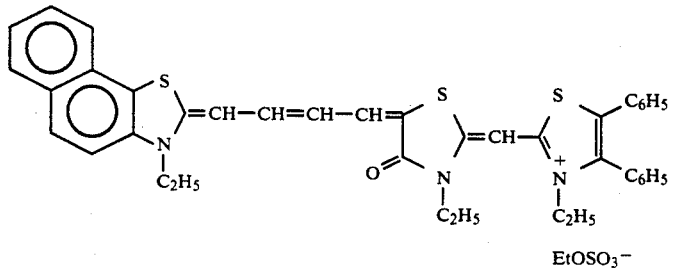
(II-2)
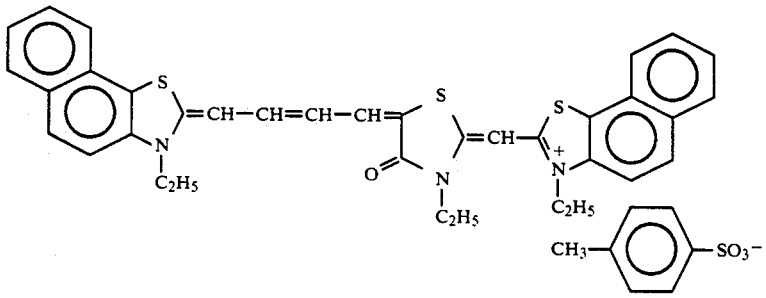
(II-3)
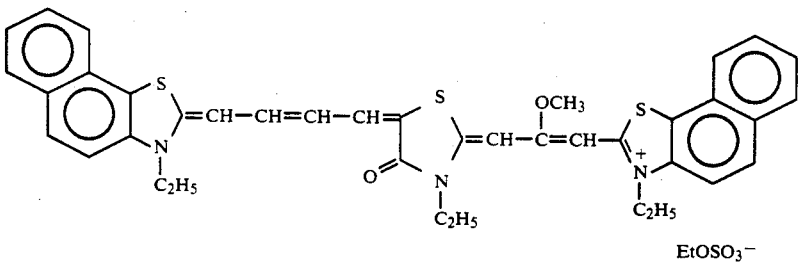
(II-4)
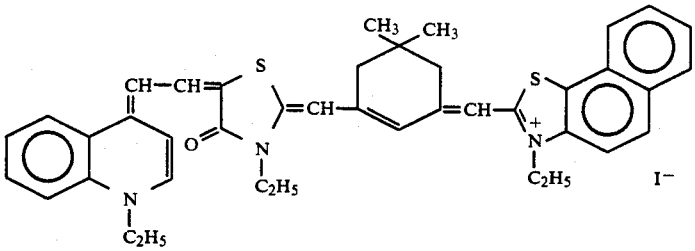
(II-5)
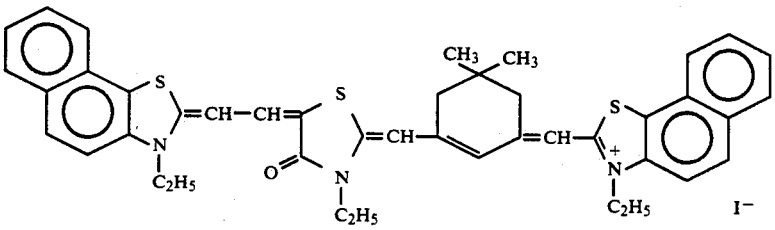

-continued (II-6)

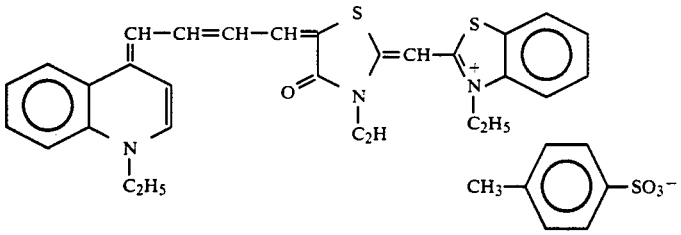

(III-1)

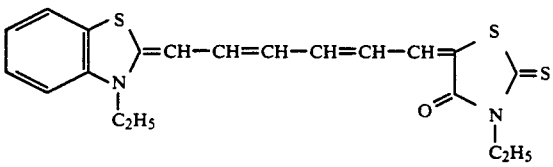

(III-2)

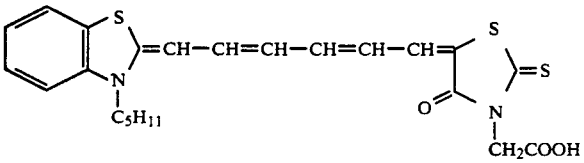

(III-3)

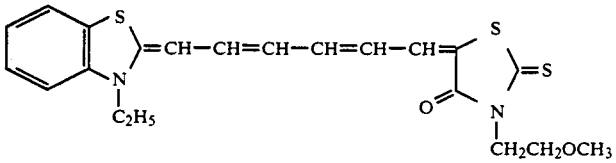

(III-4)

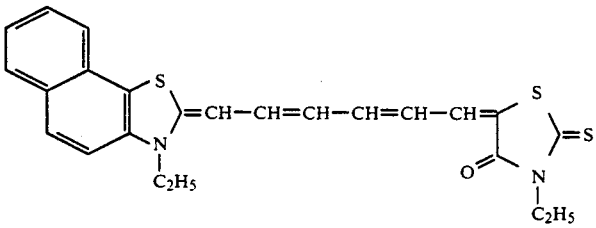

The sensitizing dyes used in the present invention are included in the silver halide photographic emulsion in an amount of from $5\times10^{-7}$ to $5\times10^{-3}$ mol, preferably in an amount of from $1\times10^{-6}$ to $1\times10^{-3}$ mol, and most preferably in an amount of from $2\times10^{-6}$ to $5\times10^{-4}$ mol, per mol of silver halide.

The sensitizing dyes used in the present invention can be dispersed directly into the emulsion. Furthermore, they can be dissolved in a suitable solvent, such as methyl alcohol, ethyl alcohol, methylcellosolve, acetone, water or pyridine, or in a mixture of such solvents, and added to the emulsion in the form of a solution. Furthermore, ultrasonics can be used for dissolution purposes. In addition, the infrared sensitizing dyes can be added using methods in which the dye is dissolved in a volatile organic solvent. The solution so obtained is dispersed in a hydrophilic colloid and the dispersion so obtained is dispersed in the emulsion, as disclosed, for example, in U.S. Pat. No. 3,469,987. Methods in which a water insoluble dye is dispersed in a water soluble solvent without dissolving and the dispersion is added to the emulsion are disclosed, for example, in JP-B-46-24185. Methods in which the dye is dissolved in a surfactant and the solution so obtained is added to the emulsion are disclosed in U.S. Pat. No. 3,822,135. Methods in which a solution is obtained using a compound which causes a red shift and in which the solution is added to the emulsion are disclosed in JP-A 51-74624. Methods in which the dye is dissolved in an essentially water free acid and the solution is added to the emulsion are disclosed in JP-A-50-80826. (The term "JP-B" as used herein signifies an "examined Japanese patent publication"). Furthermore, the methods disclosed, for example, in U.S. Pat. Nos. 2,912,343, 3,342,605, 2,996,287 and 3,429,835 can also be used for making the addition to an emulsion. Also, the above-mentioned infrared sensitizing dyes can be uniformly dispersed in the silver halide emulsion prior to coating on a suitable support. The addition can be made prior to chemical sensitization or during the latter half of silver halide grain formation.

Super-sensitization with compounds represented by the general formulae (IV), (V), (VI), or (VII), and condensate of compounds represented by formula (VIIIa), (VIIIb) or (VIIIc) and formaldehyde which are described below, in particular, can be used with the red-infrared M-band type sensitization in the present invention.

The super-sensitizing effect can be amplified by using super-sensitizing agents represented by general formula (IV) conjointly with super-sensitizing agents represented by the general formula (V), and condensates of compounds represented by formula (VIIIa), (VIIIb) or (VIIIc) and formaldehyde.

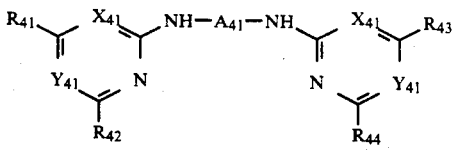

(IV)

In this formula, $A_{41}$ represents a divalent aromatic residual group. $R_{41}$, $R_{42}$, $R_{43}$ and $R_{44}$ each represents a hydrogen atom, a hydroxyl group, an alkyl group, an alkoxy group, an aryloxy group, a halogen atom, a heterocyclic nucleus, an alkylthio group, a heterocyclylthio group, an arylthio group, an amino group, an alkylamino group, an arylamino group, a heterocyclylamino group, an aralkylamino group, an aryl group or a mercapto group, and these groups may be unsubstituted or substituted.

However, at least one of the groups represented by $A_{41}$, $R_{41}$, $R_{42}$, $R_{43}$ and $R_{44}$ has a sulfo group. $X_{41}$ and $Y_{41}$ each represents a —CH= or —N= group, but at least one of $X_{41}$ and $Y_{41}$ represents an —N= group.

In general formula (IV), $—A_{41}—$ represents a divalent aromatic residual group, and these groups may contain $—SO_3M$ groups (where M represents a hydrogen atom or a cation [for example, sodium, potassium] which provides water solubility).

The $—A_{41}—$ groups are suitably selected from among those indicated, for example, under $—A_{42}—$ and $—A_{43}—$ below. However, when there is no $—SO_3M$ group in $R_{41}$, $R_{42}$, $R_{43}$ or $R_{44}$, then $—A_{41}—$ is only selected from among the $—A_{42}—$ groups.

$—A_{42}—$:

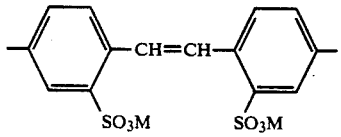

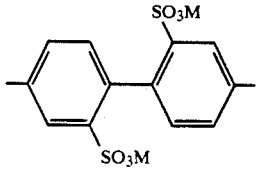

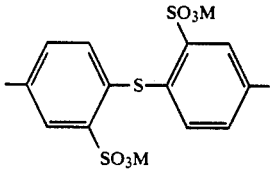

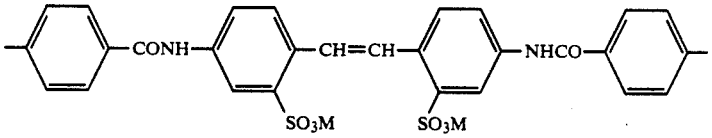

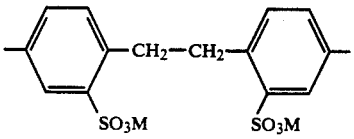

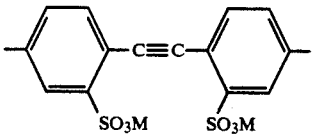

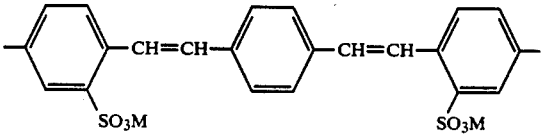

-continued

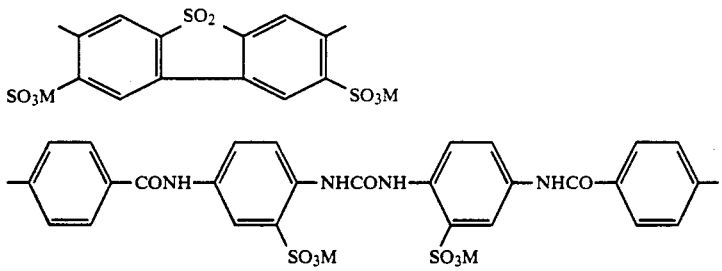

M in these formulae represents a hydrogen atom or a cation which provides water solubility.

$-A_{43}-$:

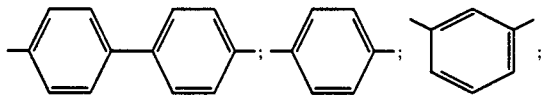

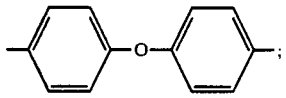

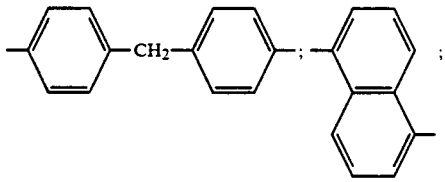

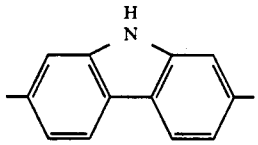

$R_{41}$, $R_{42}$, $R_{43}$ and $R_{44}$ each represents a hydrogen atom, a hydroxyl group, an alkyl group (which preferably has from 1 to 8 carbon atoms, for example methyl, ethyl, n-propyl, n-butyl), an alkoxy group (which preferably has from 1 to 8 carbon atoms, for example methoxy, ethoxy, propoxy, butoxy), an aryloxy group (for example, phenoxy, naphthoxy, o-tolyloxy, p-sulfophenoxy), a halogen atom (for example chlorine, bromine), a heterocyclic nucleus (for example, morpholinyl, piperidyl), an alkylthio group (for example, methylthio, ethylthio), a heterocyclylthio group (for example, benzothiazolylthio, benzimidazolylthio, phenyltetrazolylthio), an arylthio group (for example, phenylthio, tolylthio), an amino group, an alkylamino group or substituted alkylamino group (for example, methylamino, ethylamino, propylamino, dimethylamino, diethylamino, dodecylamino, cyclohexylamino, β-hydroxyethylamino, di-(β-hydroxyethyl)amino, β-sulfoethylamino), an arylamino group or a substituted arylamino group (for example, anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclylamino group (for example, 2-benzothiazolylamino, 2-pyridylamino), a substituted or unsubstituted aralkylamino group (for example, benzylamino, o-anisylamino, m-anisylamino, p-anisylamino), an aryl group (for example, phenyl), or a mercapto group.

$R_{41}$, $R_{42}$, $R_{43}$ and $R_{44}$ may be the same or different. In those cases where $-A_{41}-$ is selected from among the $-A_{43}-$ groups, at least one of the groups $R_{41}$, $R_{42}$, $R_{43}$ and $R_{44}$ must have a sulfo group (which may be a free acid group or be in the form of a salt). $X_{41}$ and $Y_{41}$ represent —CH= or —N= groups, and $X_{41}$ is preferably a —CH= group and $Y_{41}$ is preferably an —N= group.

Actual examples of compounds represented by general formula (IV) which can be used in the invention are set forth below, but the invention is not limited to just those compounds indicated herein.

(IV-1) 4,4'-Bis[2,6-di(2-naphthoxy)pyrimidin-4-ylamino]stilbene-2,2'-disulfonic acid disodium salt (IV-2) 4,4'-Bis[2,6-di(2-naphthylamino)pyrimidin-4-ylamino]stilbene-2,2'-disulfonic acid disodium salt (IV-3) 4,4'-Bis[2,6-anilinopyrimidin-4-ylamino)stilbene-2,2'-disulfonic acid disodium salt (IV-4) 4,4'-Bis[2-(2-naphthylamino)-6-anilinopyrimidin-4-ylamino]suilbene-2,2'-disulfonic acid disodium salt (IV-5) 4,4'-Bis[2,6-diphenoxypyrimidin-4-ylamino]-stilbene-2,2'-disulfonic acid triethylammonium salt (IV-6) 4,4'-Bis[2,6-di(benzimidazolyl-2-thio)pyrimidin-4-ylamino]stilbene-2,2'-disulfonic acid disodium salt (IV-7) 4,4'-Bis[4,6-di(benzothiazolyl-2-thio)pyrimidin-2-ylamino]stilbene-2,2'-disulfonic acid disodium salt (IV-8) 4,4'-Bis[4,6-di(benzothiazolyl-2-amino)pyrimidin-2-ylamino]stilbene-2,2'-disulfonic acid disodium salt (IV-9) 4,4'-Bis[4,6-di(naphthyl-2-oxy)pyrimidin-2-ylamino]stilbene-2,2'-disulfonic acid disodium salt (IV-10) 4,4'-Bis(4,6-diphenoxypyrimidin-2-ylamino)-stilbene-2,2'-disulfonic acid disodium salt (IV-11) 4,4'-Bis(4,6-diphenylthiopyrimidin-2-ylamino)stilbene-2,2'-disulfonic acid disodium salt (IV-12) 4,4'-Bis(4,6-dimercaptopyrimidin-2-ylamino)-biphenyl-2,2'-disulfonic acid disodium salt (IV-13) 4,4'-Bis(4,6-dianilinotriazin-2-ylamino)stilbene-2,2'-disulfonic acid disodium salt (IV-14) 4,4'-Bis(4-anilino-6-hydroxytriazin-2-ylamino)stilbene-2,2'-disulfonic acid disodium salt (IV-15) 4,4'-Bis[4,6-di(naphthyl-2-oxy)pyrimidin-2-ylamino]bibenzyl-2,2'-disulfonic acid disodium salt (IV-16) 4,4'-Bis(4,6-dianilinopyrimidin-2-ylamino)-stilbene-2,2'-disulfonic acid disodium salt (IV-17) 4,4'-Bis[4-chloro-6-(2-naphthyloxy)pyrimidin-2-ylamino]biphenyl-2,2'-disulfonic acid disodium salt (IV-18) 4,4'-Bis[4,6-di(1-phenyltetrazolyl-5-thio)-pyrimidin-2-ylamino]stilbene-2,2'-disulfonic acid disodium salt (IV-19) 4,4'-Bis[4,6-di(benzimidazolyl-2-thio))pyrimidin-2-ylamino]stilbene-2,2'-disulfonic acid disodium salt (IV-20) 4,4'-Bis(4-naphthylamino-6-anilinotriazin-2-ylamino)stilbene-2,2'-disulfonic acid disodium salt From among these examples, (IV-1) to (IV-6) are preferred, and (IV-1), (IV-2), (IV-4), (IV-5), (IV-9), (IV-15) and (IV-20) are most preferred.

The compounds represented by general formula (IV) are useful when used in amounts of from $0.02\times10^{-3}$ to $10\times10^{-3}$ mol per mol of silver halide, and when used in a weight ratio of the amount of the sensitizing dye to the amount of the compound within the range preferably of from 1/1 to 1/100, and more preferably within the range of from 1/2 to 1/50. The conjoint use of compounds represented by the general formula (V) with these compounds is preferred.

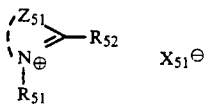

(V)

In this formula, $Z_{51}$ represents a group of non-metal atoms which is required to complete a five or six membered nitrogen containing heterocyclic ring. This ring may be condensed with a benzene ring or a naphthalene ring. Examples of such a ring include thiazoliums {for example thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium}, oxazoliums {for example oxazolium, 4-methyloxazolium, benzoxazolium, 5-chlorobenzoxazolium, 5-phenylbenzoxazolium, 5-methylbenzoxazolium, naphtho[1,2-d]oxazolium}, imidazoliums {for example, 1-methylbenzimidazolium, 1-propyl-5-chlorobenzimidazolium, 1-ethyl-5,6-dichlorobenzimidazolium, 1-allyl-5-trifluoromethyl-6-chlorobenzimidazolium}, and selenazoliums {for example, benzoselenazolium, 5-chlorobenzolselenazolium, 5-methylbenzoselenazolium, 5-methoxybenzoselenazolium, naphtho[1,2-d]selenazolium}. $R_{51}$ represents a hydrogen atom, an alkyl group (which preferably has not more than 8 carbon atoms, for example, methyl, ethyl, propyl, butyl, pentyl) or an alkenyl group preferably having not more than 8 carbon atoms, (for example, allyl). $R_{52}$ represents a hydrogen atom or a lower alkyl group (for example, methyl, ethyl). $R_{51}$ and $R_{52}$ may have substituent groups. $X_{51}\ominus$ represents an acid anion (for example, $Cl^-$, $Br^-$, $I^-$, $ClO_4^-$). $Z_{51}$ is preferably a thiazolium nucleus, and substituted or unsubstituted benzothiazolium or naphthothiazolium nuclei are most preferred. Moreover, unless indicated otherwise, these groups may have substituent groups.

Actual examples of compounds represented by general formula (V) are set forth below, but the invention is not limited to these compounds.

[V-1]

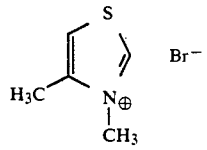

[V-2]

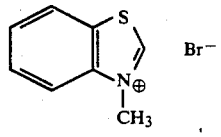

[V-3]

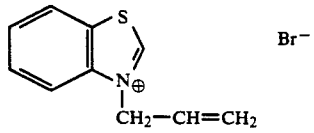

[V-4]

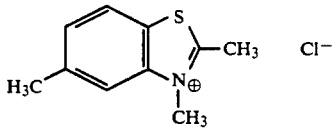

[V-5]

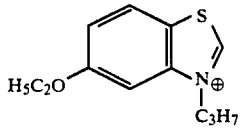

[V-6]

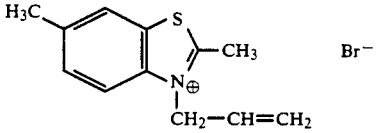

[V-7]

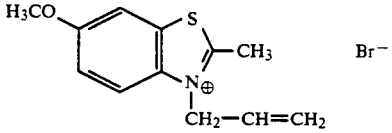

[V-8]

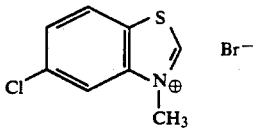

[V-9]

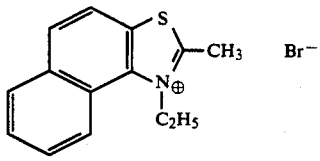

[V-10]

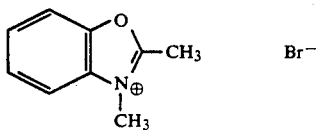

-continued

[V-11]

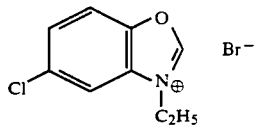

[V-12]

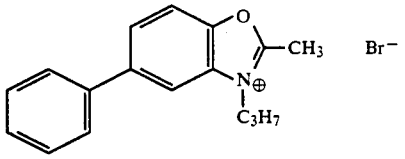

[V-13]

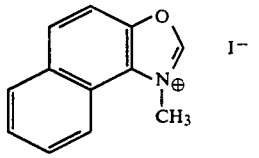

[V-14]

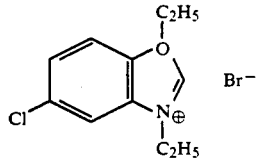

[V-15]

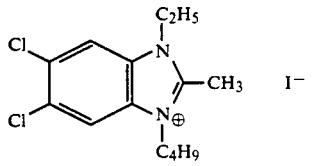

[V-16]

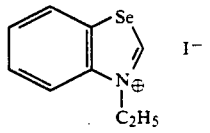

[V-17]

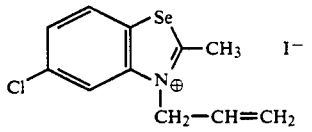

[V-18]

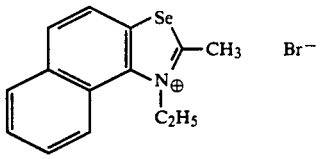

The compounds represented by general formula (V) which are used in the present invention are conveniently used in an amount of from 0.01 gram to 5 grams per mol of silver halide in the emulsion.

The ratio (by weight) of the infrared sensitizing dyes represented by the general formulae (I) to (III)/compounds represented by general formula (V) is within the range of from 1/1 to 1/300, and preferably within the range from 1/2 to 1/50.

The compounds represented by general formula (IV), (V), (VI) or (VII) and condensates of the compounds represented by general formula (VIIIa), (VIIIb) or (VIIIc) used in the invention can be dispersed directly into the emulsion, or they can be dissolved in an appropriate solvent (for example water, methyl alcohol, ethyl alcohol, propanol, methylcellosolve or acetone), or in a mixture of these solvents, and added to the emulsion. Furthermore, they can be added to the emulsion in the form of a solution or dispersion in a colloid in accordance with the methods used for adding sensitizing dyes.

The compounds represented by general formula (V) may be added to the emulsion before the addition of the sensitizing dyes represented by general formula (I) to (III), or they may be added after the sensitizing dyes have been added. Furthermore, the compounds of general formula (V) and the sensitizing dyes represented by general formulae (I) to (III) may be dissolved separately and the separate solutions can be added to the emulsion separately at the same time, or they may be added to the emulsion after mixing.

The combination of the infrared sensitizing dye represented by formulae (I) to (III) and the compound represented by formula (V) is preferably used when it is used further in combination with a compound represented by formula (IV).

Latent image stability and a marked improvement in the processing dependence of the linearity of gradation, as well as high speeds and control of fogging, can be achieved by using heterocyclic mercapto compounds together with super-sensitizing agents represented by the general formulae (IV) or (V) in the infrared sensitized high silver chloride content emulsions of this invention.

For example, heterocyclic compounds which contain a thiazole ring, an oxazole ring, a thiazoline ring, a selenazole ring, an imidazole ring, an indoline ring, a pyrrolidine ring, a tetrazole ring, a thiadiazole ring, a quinoline ring or an oxadiazole ring, and which are substituted with a mercapto group can be used for this purpose. Compounds which also contain carboxyl groups, sulfo groups, carbamoyl groups, sulfamoyl groups and hydroxyl groups are most preferred. The use of mercapto-heterocyclic compounds with super-sensitizing agents are disclosed in JP-B-43-22883. Remarkable anti-fogging effects and super-sensitizing effects can be achieved in this invention by using these mercapto-heterocyclic compounds conjointly with compounds which can be represented by general formula (V). The mercapto compounds represented by general formulae (VI) and (VII) described below are most preferred.

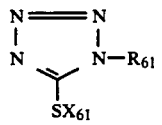

(VI)

In this formula, $R_{61}$ represents an alkyl group, an alkenyl group or an aryl group. $X_{61}$ represents a hydrogen atom, an alkali metal atom, an ammonium group, or a precursor. The alkali metal atom is sodium or potassium, for example, and the ammonium group is a tetramethylammonium group or a trimethylbenzylammonium group, for example. Furthermore, a precursor is a group such that $X_{61}$ becomes an H or an alkali metal under alkaline conditions, for example an acetyl group, a cyanoethyl group or a methanesulfonyl ethyl group.

The alkyl groups and alkenyl groups represented by $R_{61}$ as described above include unsubstituted and substituted groups (preferably having up to 12 carbon atoms in the alkyl or alkenyl moiety), also include alicyclic groups. The substituent groups of substituted alkyl groups may be, for example, a halogen atom, a nitro group, a cyano group, a hydroxyl group, an alkoxy group, an aryl group, an acylamino group, an alkoxycarbonylamino group, a ureido group, an amino group, a heterocyclic group, an aliphatic or aromatic acyl group, a sulfamoyl group, a sulfonamido group, a thioureido group, a carbamoyl group, an alkylthio group, an arylthio group, a heterocyclylthio group, and a carboxylic acid and a sulfonic acid group and salts thereof. The above mentioned a ureido group, a thioureido group, a sulfamoyl group, a carbamoyl group and an amino group may be unsubstituted groups, N-alkyl substituted groups or N-aryl substituted groups. The phenyl group and substituted phenyl groups are examples of aryl groups, and these groups may be substituted with alkyl groups and the substituent groups for alkyl groups described above.

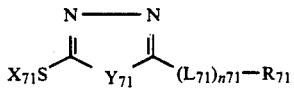

(VIII)

In this formula, $Y_{71}$ is an oxygen atom, a sulfur atom, an =NH group or an $=N-(L_{71})_{n72}-R_{72}$ group, $L_{71}$ represents a divalent linking group, $R_{71}$ represents a hydrogen atom, an alkyl group, an alkenyl group or an aryl group, $R_{72}$ has the same significance as $R_{71}$. The alkyl groups, alkenyl groups and aryl groups represented by $R_{71}$ or $R_{72}$ have the same significance as those in general formula (VI), and $X_{71}$, have the same significance as $X_{61}$ of general formula (VI).

Actual examples of the divalent linking groups represented by $L_{71}$ above include

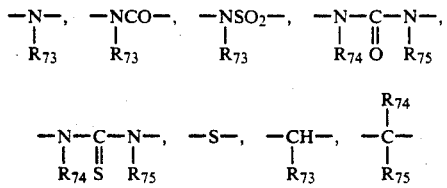

and combinations thereof.

Moreover, $n_{71}$ and $n_{72}$ represent 0 or 1, and $R_{73}$, $R_{74}$ and $R_{75}$ each represents a hydrogen atom, an alkyl group (preferably having 1 to 8 carbon atoms) or an aralkyl group.

These compounds represented by formula (VI) or (VII) may be included in any layer, that is a photosensitive or light-insensitive hydrophilic colloid layer, in the silver halide color photographic material.

The amount of the compounds represented by general formula (VI) or (VII) added is from $1\times10^{-5}$ to $5\times10^{-2}$ mol, and preferably from $1\times10^{-4}$ to $1\times10^{-2}$ mol per mol of silver halide when they are included in a silver halide color photographic photosensitive material. Furthermore, they can be added to color development solutions as anti-foggants at concentrations preferably of from $1\times10^{-6}$ to $1\times10^{-3}$ mol/liter, and more preferably at concentrations of from $5\times10^{-6}$ to $5\times10^{-4}$ mol/liter.

Actual examples of compounds represented by the general formulae (VI) and (VII) are set forth below, but the invention is not limited by these examples. The compounds disclosed at pages 4 to 8 to JP-A-62-269957 can be used, and of these, the compounds set forth below are especially preferred.

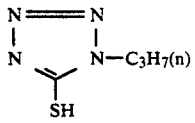

[VI-1]

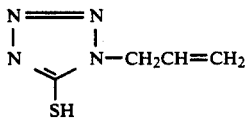

[VI-2]

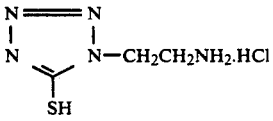

[VI-3]

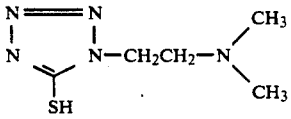

[VI-4]

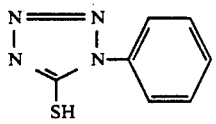

[VI-5]

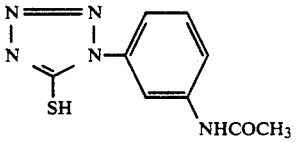

[VI-6]

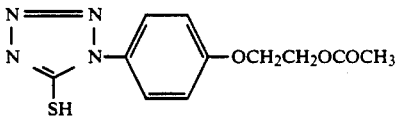

[VI-7]

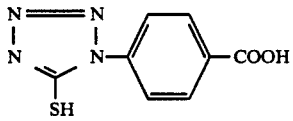

[VI-8]

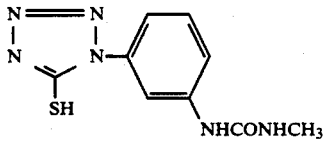

[VI-9]

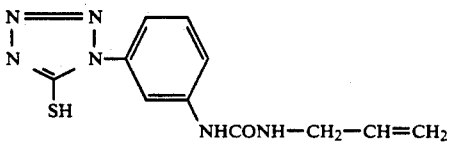

[VI-10]

-continued

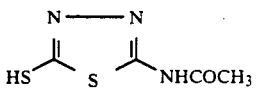
[VII-1]

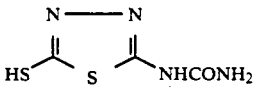
[VII-2]

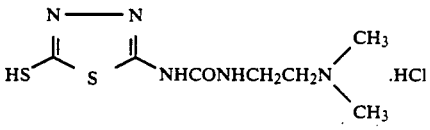
[VII-3]

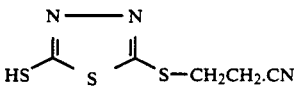
[VII-4]

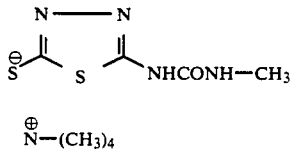
[VII-5]

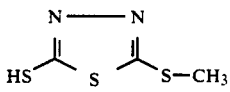
[VII-6]

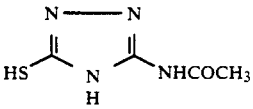
[VII-7]

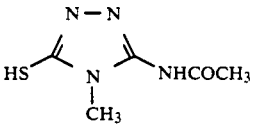
[VII-8]

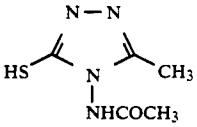
[VII-9]

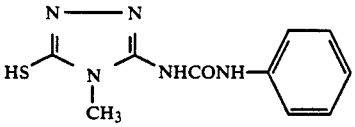
[VII-10]

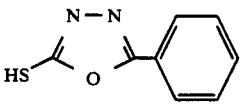
[VII-11]

Moreover, condenstates having from 2 to 10 condensed units of substituted or unsubstituted hydroxybenzenes represented by the general formulae (VIIIa), (VIIIb) and (VIIIc) below with formaldehyde can be used as super-sensitizing agents with the red sensitization or infrared sensitization used in the present invention. These compounds prevent fading of a latent image with a lapse of time and lowering the gradation.

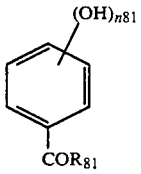
(VIIIa)

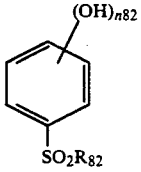
(VIIIb)

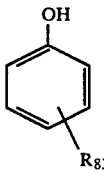
(VIIIc)

In these formulae, $R_{81}$ and $R_{82}$ each represents —OH, —$OM_{81}$, —$OR_{84}$, —$NH_2$, —$NHR_{84}$, —$NH(R_{84})_2$, —$NHNH_2$ or —$NHNHR_{84}$, where $R_{84}$ represents an alkyl or alkenyl group (preferably has up to 8 carbon atoms), or an aralkyl group. $M_{81}$ represents an alkali metal or an alkaline earth metal. $R_{83}$ represents —OH or a halogen atom and $n_{81}$ and $n_{82}$ each represents 1, 2 or 3. The hydroxy groups in the formulae (VIIIa), (VIIIb) and (VIIIc) may be substituted at any position of the benzene nucleus.

Actual examples of substituted and unsubstituted polyhydroxybenzenes which form components for aldehyde condensates which can be used in the invention are set forth below, but they are not limited to these examples.

(VIII-1) β-resorcyclic acid
(VIII-2) γ-resorcyclic acid
(VIII-3) 4-Hydroxybenzoic acid hydrazide
(VIII-4) 3,5-Hydroxybenzoic acid hydrazide
(VIII-5) p-Chlorophenol
(VIII-6) Sodium hydroxybenzenesulfonate
(VIII-7) p-Hydroxybenzoic acid
(VIII-8) o-Hydroxybenzoic acid
(VIII-9) m-Hydroxybenzoic acid
(VIII-10) p-Dioxybenzene
(VIII-11) Gallic acid
(VIII-12) Methyl p-hydroxybenzoate
(VIII-13) o-Hydroxybenzenesulfonic acid amide N-Ethyl-o-hydroxybenzoic acid amide (VIII-14)

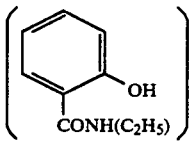

N-Diethyl-o-hydroxybenzoic acid amide (VIII-15)

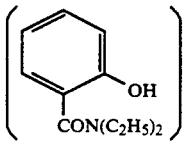

-continued o-Hydroxybenzoic acid 2-methylhydrazide (VIII-16)

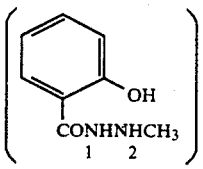

Moreover, in practical terms, the derivatives of the compounds represented by general formulae (IIa), (IIb) and (IIc) disclosed in JP-B-49-49504 can be used.

The condensate may be incorporated in a light sensitive layer and/or a light-insensitive layer preferably in an amount of from 0.1 to 10 g, more preferably of from 0.5 to 5 g per mol of silver halide.

Yellow couplers, magenta couplers and cyan couplers which form yellow, magenta and cyan colors on coupling with the oxidized product of an aromatic amine color developing agent are normally used in the full color recording materials of the present invention.

Of the yellow couplers which can be used in the invention, the acylacetamide derivatives, such as benzoylacetanilides and pivaloylacetanilides, are preferred.

The derivatives represented by the general formulae (Y-I) and (Y-II) below are preferred as yellow couplers.

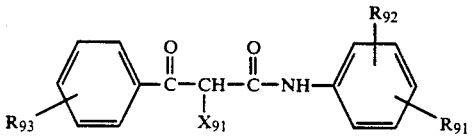

(Y-I)

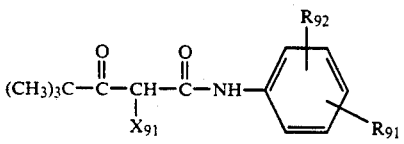

(Y-II)

In these formulae, $X_{91}$ represents a hydrogen atom or a coupling releasing group. $R_{91}$ represents a ballast group which has a total of from 8 to 32 carbon atoms, $R_{92}$ represents a hydrogen atom, one or more halogen atoms, lower alkyl groups, lower alkoxy groups or ballast groups which have from 8 to 32 carbon atoms. $R_{93}$ represents a hydrogen atom or substituent groups. In those cases where there are two or more $R_{93}$ groups the groups may be the same or different.

Details of pivaloylacetanilide yellow couplers are disclosed in U.S. Pat. No. 4,622,287, column 3, line 15 to column 8, line 39 and U.S. Pat. No. 4,623,616, column 14, line 50 to column 19, line 41.

Details of benzoylacetanilide yellow couplers are disclosed, for example, in U.S. Pat. Nos. 3,408,194, 3,933,501, 4,046,575, 4,133,958 and 4,401,752.

The illustrative compounds (Y-1) to (Y-39) disclosed in columns 37 to 54 of the aforementioned U.S. Pat. No. 4,622,287 can be cited as actual examples of pivaloylacetanilide yellow couplers and, of these, (Y-1), (Y-4), (Y-6), (Y-7), (Y-15), (Y-21), (Y-22), (Y-23), (Y-26), (Y-35), (Y-36), (Y-37) and (Y-38), for example, are preferred.

Furthermore, illustrative compounds (Y-1) to (Y-33) disclosed in columns 19 to 24 of the aforementioned U.S. Pat. No. 4,623,616 can be used and, of these, (Y-2), (Y-7), (Y-8), (Y-12), (Y-20), (Y-21), (Y-23) and (Y-29) are preferred.

Example (34) disclosed in column 6 of U.S. Pat. No. 3,408,194, illustrative compounds (16) and (19) disclosed in column 8 of U.S. Pat. No. 3,933,501, illustrative compounds (9) disclosed in columns 7 to 8 of U.S. Pat. No. 4,046,575, illustrative compounds (1) disclosed in columns 5 to 6 of U.S. Pat. No. 4,133,958, illustrative compound 1 disclosed in column 5 of U.S. Pat. No. 4,401,752, and the compounds (Y-1) to (Y-8) set forth below can also be cited as preferred examples.

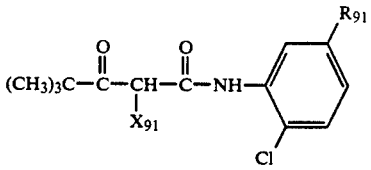

| Compound | $R_{91}$ | $X_{91}$ |
|---|---|---|
| Y-1 | $-COOCH(CH_3)COOC_{12}H_{25}$ | 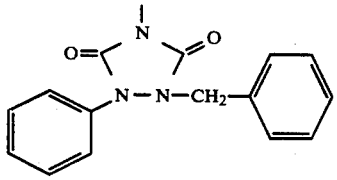 |
| Y-2 | $-COOCH(C_4H_9)COOC_{12}H_{25}$ | As above |

-continued

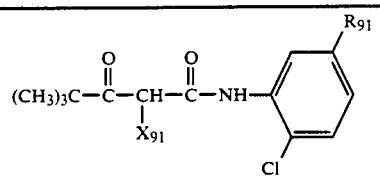

| Compound | $R_{91}$ | $X_{91}$ |
|---|---|---|
| Y-3 | 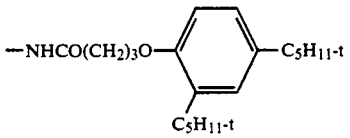 | 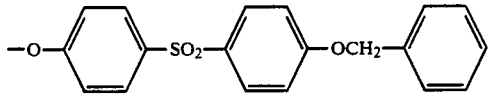 |
| Y-4 | 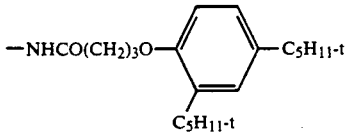 | 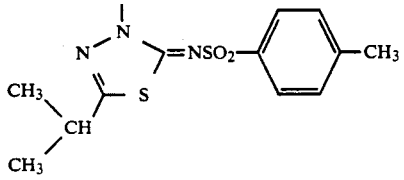 |
| Y-5 | 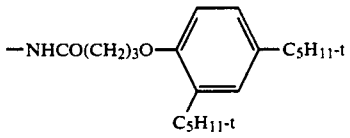 | 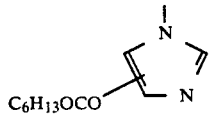 |
| Y-6 | $-NHSO_2C_{12}H_{25}$ | 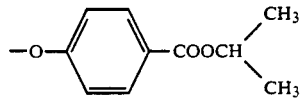 |
| Y-7 | $-NHSO_2C_{16}H_{33}$ | 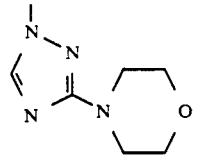 |
| Y-8 | 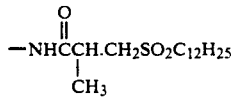 | 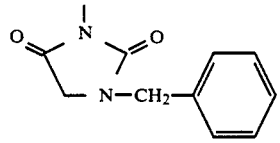 |

A nitrogen atom is especially preferred as the releasing atom in the above mentioned couplers.

In the present invention, oil protected type indazolone couplers or cyanoacetyl couplers, and preferably 5-pyrazolone couplers and pyrazoloazole couplers, for example, pyrazolotriazole couplers can be used as the magenta couplers may be used. The 5-pyrazolone couplers which are substituted in the 3-position with an arylamino group or an acylamino group are preferred with respect to hue and the density of the color formed, and typical examples have been disclosed, for example, in U.S. Pat. Nos. 2,311,082, 2,343,703, 2,600,788, 2,908,573, 3,062,653, 3,152,896 and 3,936,015. The nitrogen atom releasing groups disclosed in U.S. Pat. No. 4,310,619 or the arylthio groups disclosed in U.S. Pat. No. 4,351,897 are the preferred releasing groups for two-equivalent 5-pyrazolone couplers. Furthermore, high color densities can be obtained with the 5-pyrazolone couplers which have ballast groups as disclosed in European Patent 73636.

The pyrazolobenzimidazoles disclosed in U.S. Pat. No. 2,369,879, and especially the pyrazolo[5,1-c][1,2,4]triazoles disclosed in U.S. Pat. No. 3,725,067, the pyrazolotetrazoles disclosed in *Research Disclosure* 24220 (June 1984) and the pyrazolopyrazoles disclosed in *Research Disclosure* 24230 (June 1984), can be used as pyrazoloazole couplers. All of the aforementioned couplers can take the form of polymeric couplers.

Actual examples of these compounds are represented by the general formulae (M-I), (M-II) and (M-III) below. Those couplers which are represented by the general formula (M-III) are especially useful.

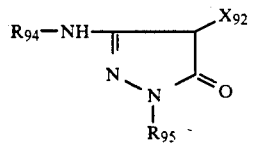

(M-I)

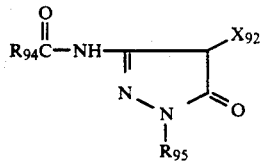

(M-II)

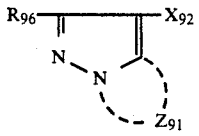

(M-III)

In these formulae, $R_{94}$ represents a ballast group which has a total of from 8 to 32 carbon atoms, and $R_{95}$ represents a phenyl group or a substituted phenyl group. $R_{96}$ represents a hydrogen atom or a substituent. $Z_{91}$ represents a group of non-metal atoms which is required to form a five membered azole ring which contains from 2 to 4 nitrogen atoms, and the azole ring may have substituent groups (including condensed rings).

$X_{92}$ represents a hydrogen atom or a group which is eliminated. Details of substituent groups for $R_{96}$ and substituent groups for the azole ring are disclosed, for example, between line 41 of column 2 and line 27 of column 8 in U.S. Pat. No. 4,540,654, column 2, line 41 to column 8, line 27.

The imidazo[1,2-b]pyrazoles disclosed in U.S. Pat. No. 4,500,630 are preferred from among the pyrazole couplers in respect to the small subsidiary absorbance on the yellow and the light fastness of the colored dyes, and the pyrazole[1,5-b][1,2,4]triazoles are especially desirable.

Use of the pyrazolotriazole couplers which have a branched alkyl group directly bonded in the 2-, 3- or 6-position of the pyrazolotriazole ring as disclosed in JP-A-61-65245, the pyrazoloazole couplers which have a sulfonamido group within the molecule such as those disclosed in JP-A-61-65246, the pyrazoloazole couplers which have an alkoxyphenylsulfonamido ballast group such as those disclosed in JP-A-61-147254, and the pyrazoloazole couplers which have an alkoxy group or aryloxy groups in the 6-position such as those disclosed in European Patent (laid open) 226,849 are also preferred.

Actual examples of these couplers are as set forth below.

| Compound | $R_{96}$ | $R_{97}$ | $X_{92}$ |
|---|---|---|---|
| | | 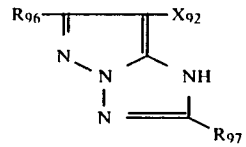 | |
| M-1 | $CH_3$— | 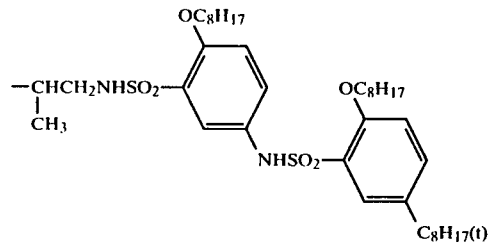 | Cl |
| M-2 | As above | 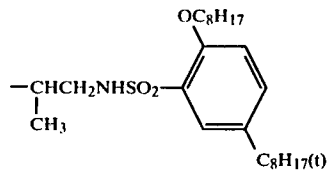 | As above |
| M-3 | As above | 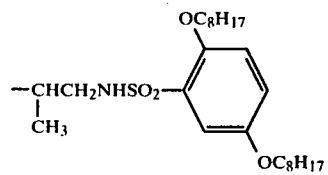 | 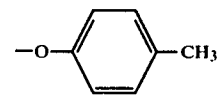 |
| M-4 | 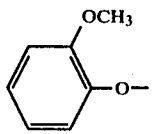 | 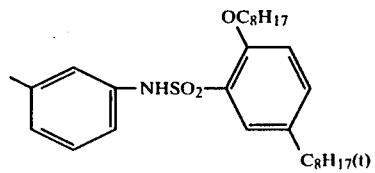 | 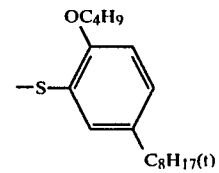 |

-continued
| Compound | $R_{96}$ | $R_{97}$ | $X_{92}$ |
|---|---|---|---|
| M-5 | $CH_3$— | 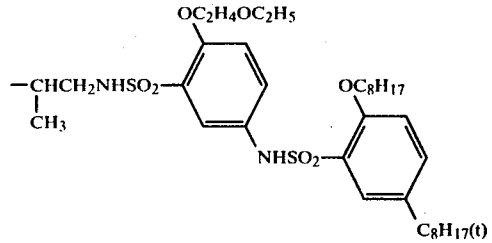 | Cl |
| M-6 | $CH_3$— | 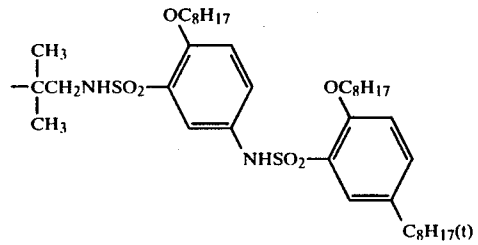 | As above |
| M-7 | 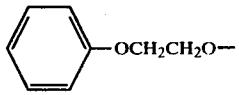 | 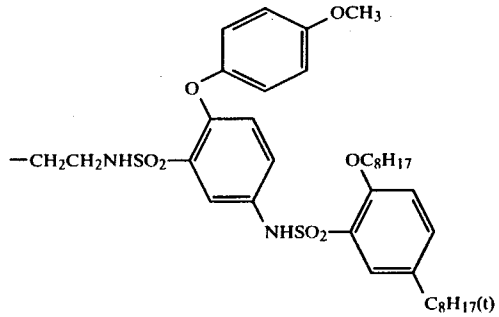 | 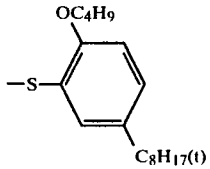 |
| M-8 | $CH_3CH_2O$— | As above | As above |
| M-9 | 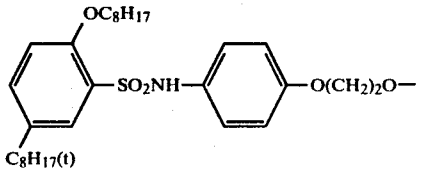 | 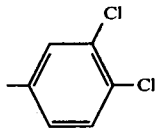 | As above |

-continued
| Compound | $R_{96}$ | $R_{97}$ | $X_{92}$ |
|---|---|---|---|
| M-10 | $CH_3$— | 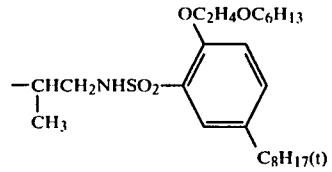 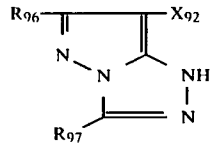 | Cl |
| M-11 | $CH_3$— | 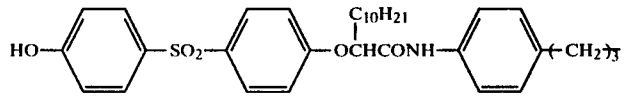 | Cl |
| M-12 | As above | 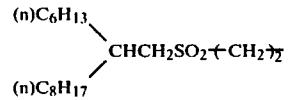 | As above |
| M-13 | 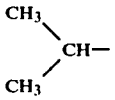 | 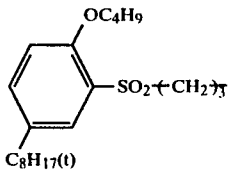 | As above |
| M-14 | 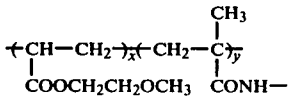 x:y = 50:50 (weight ratio) | 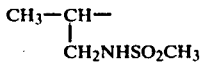 | Cl |

-continued
| Compound | $R_{96}$ | $R_{97}$ | $X_{92}$ |
|---|---|---|---|
| M-15 | 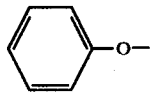 | 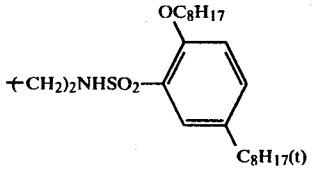 | As above |
| M-16 | 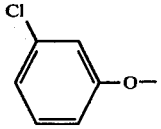 | 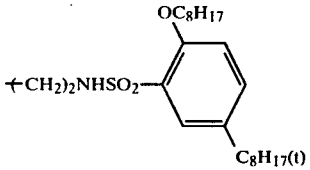 | 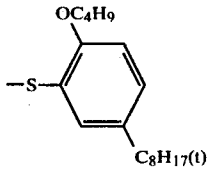 |

(M-17)
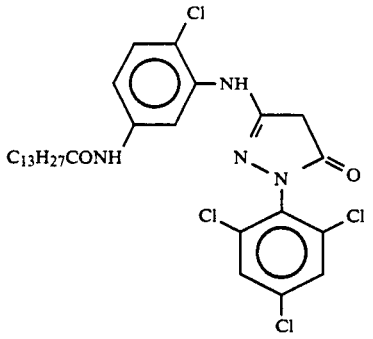
(M-18)
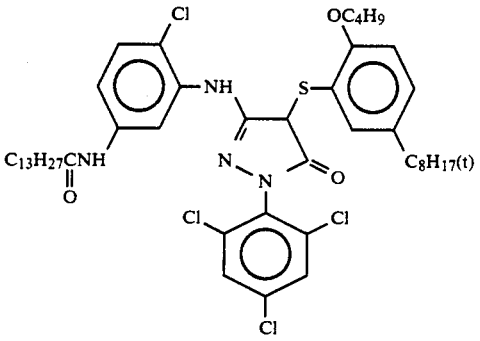
(M-19)
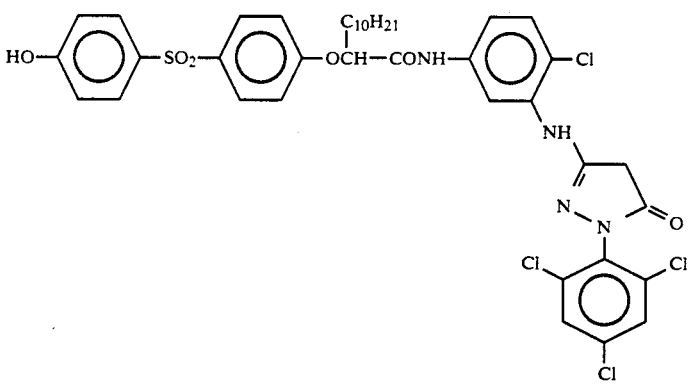
(M-20)
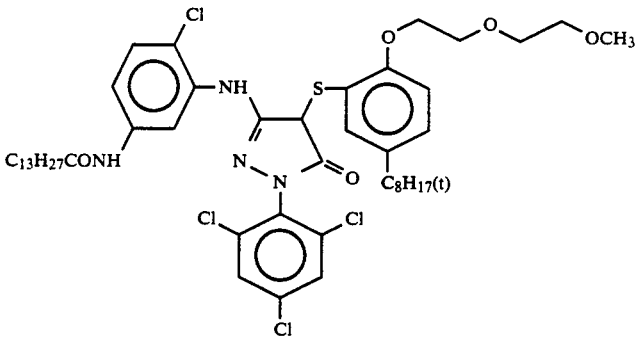

-continued
(M-21)
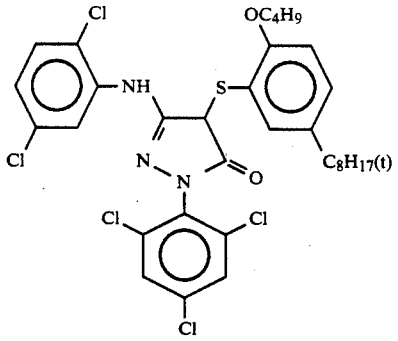
(M-22)
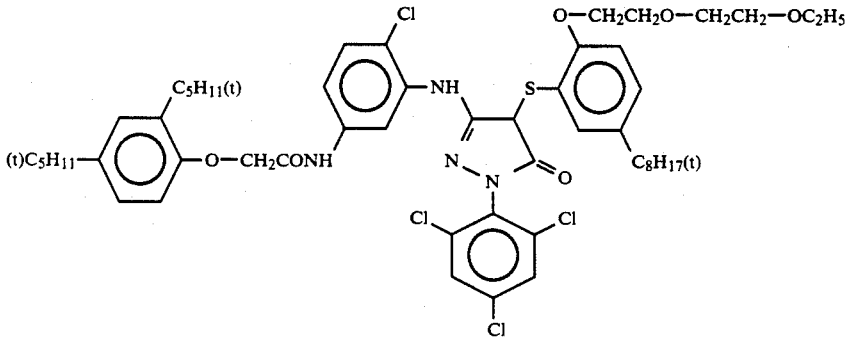
(M-23)
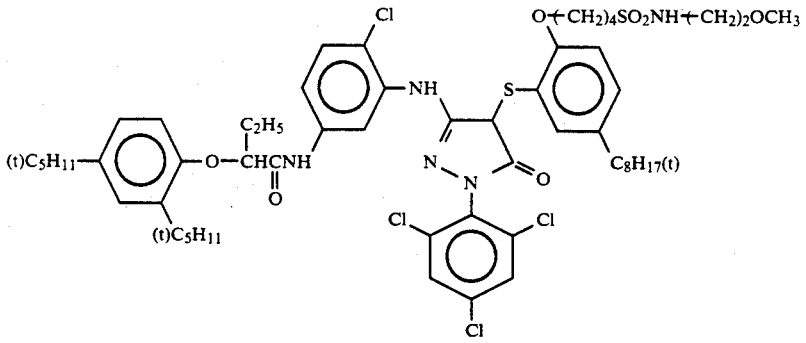
(M-24)
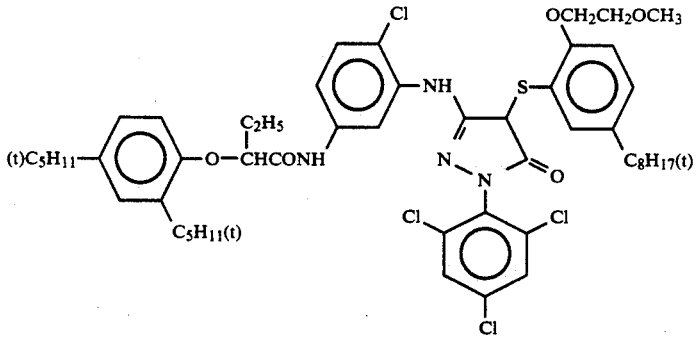

-continued
(M-25)
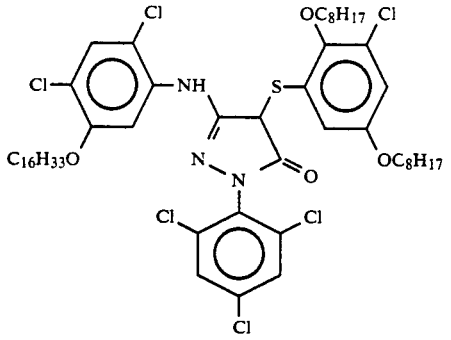
(M-26)
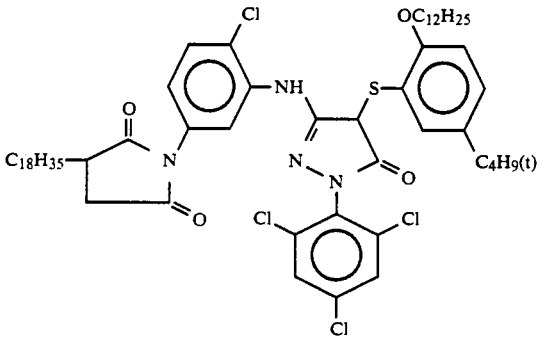
(M-27)
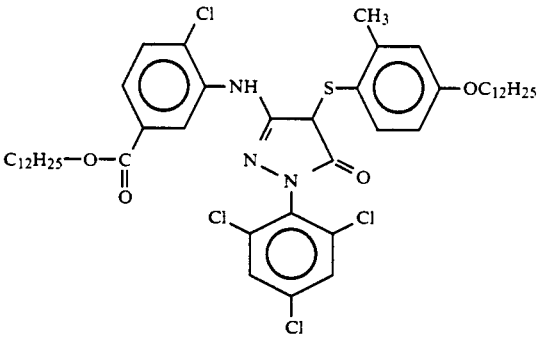
(M-28)
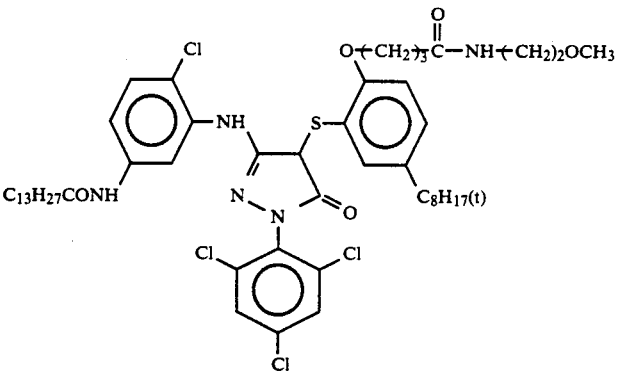

-continued
(M-29)
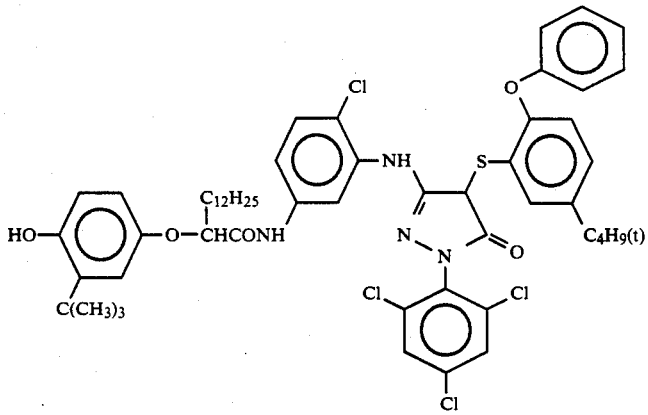
(M-30)
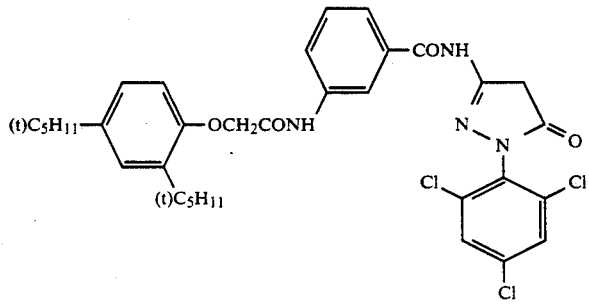
(M-31)
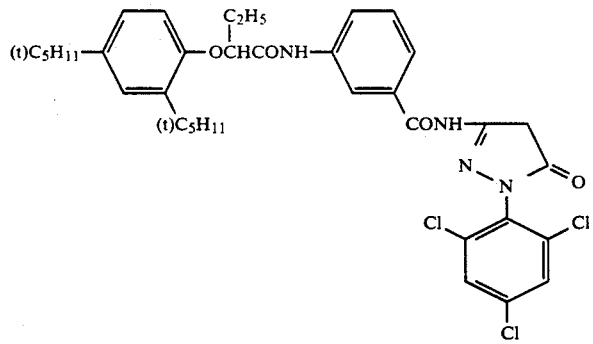
(M-32)
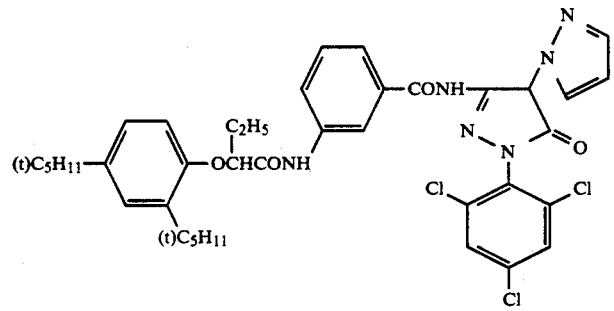

-continued (M-33)

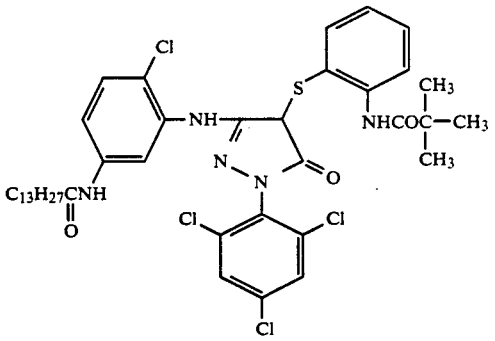

(M-34)

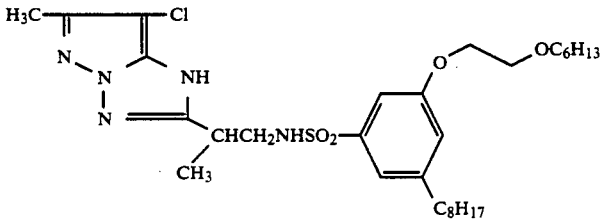

Phenol based cyan couplers and naphthol based cyan couplers can be used as cyan couplers.

The phenol couplers (including polymeric couplers) which have an acyl amino group in the 2-position of the phenol nucleus and an alkyl group in the 5-position of the phenyl nucleus are disclosed, for example, in U.S. Pat. Nos. 2,369,929, 4,518,687, 4,511,647 and 3,772,002, and can be used as phenol cyan couplers. Actual examples of such couplers include the coupler of Example 2 disclosed in Canadian Patent 625,822, compound (1) disclosed in U.S. Pat. No. 3,772,002, compounds (I-4) and (I-5) disclosed in U.S. Pat. No. 4,564,590, compounds (1), (2), (3) and (24) disclosed in JP-A-61-39045, and compound (C-2) disclosed in JP-A-62-70846.

The 2,5-diacylaminophenol couplers disclosed in U.S. Pat. Nos. 2,772,162, 2,895,826, 4,334,011 and 4,500,653, and JP-A-59-164555 can be used as phenol cyan couplers, and actual, typical, examples include compound (V) disclosed in U.S. Pat. No. 2,895,826, compound (17) disclosed in U.S. Pat. No. 4,557,999, compounds (2) and (12) disclosed in U.S. Pat. No. 4,565,777, compound (4) disclosed in U.S. Pat. No. 4,124,396, and compound (I-19) disclosed in U.S. Pat. No. 4,613,564.

The couplers which have a nitrogen containing heterocyclic ring condensed with a phenol nucleus disclosed in U.S. Pat. Nos. 4,372,173, 4,564,586, and 4,430,423, JP-A-61-390441 and JP-A-62-257158 can be used as phenol cyan couplers, and actual, typical examples (of couplers which are especially useful in this present invention) include couplers (1) and (3) disclosed in U.S. Pat. No. 4,327,173, compounds (3) and (16) disclosed in U.S. Pat. No. 4,565,586, compounds (1) and (3) disclosed in U.S. Pat. No. 4,430,423 and the compounds set forth below:

(C-1)

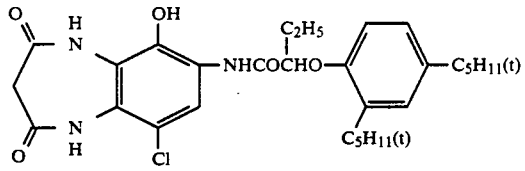

(C-2)

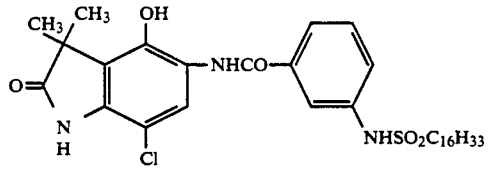

(C-3)

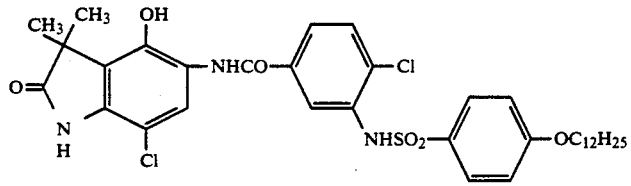

-continued (C-4)

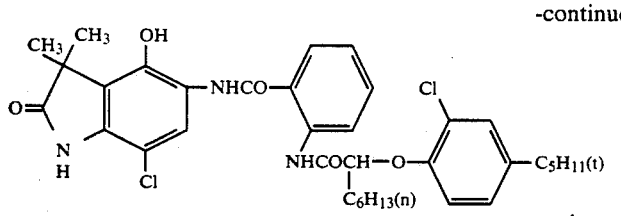

(C-5)

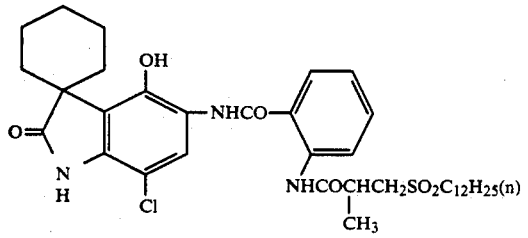

(C-6)

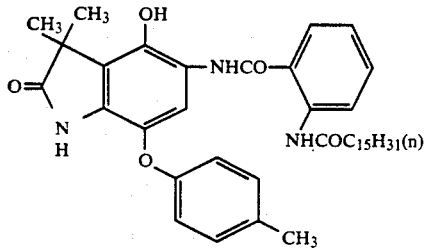

(C-7)

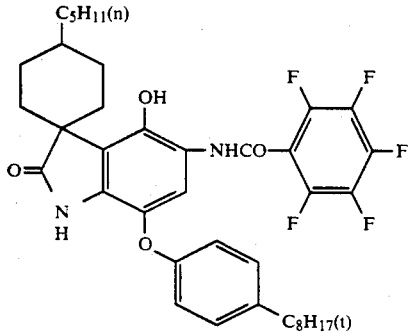

(C-8)

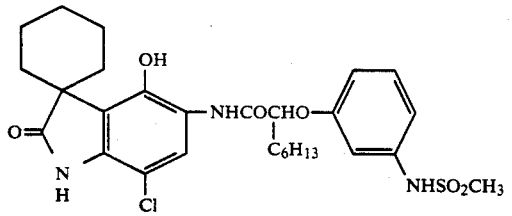

The diphenylimidazole based cyan couplers disclosed in European Patent (laid open) 0,249,453A2, for example, can also be used in addition to the cyan couplers of the types aforementioned.

The ureido couplers disclosed, for example, in U.S. Pat. Nos. 4,333,999, 4,451,559, 4,444,872, 4,427,767 and 4,579,813, and European Patent 067,689B1 can also be used as phenol cyan couplers, and actual, typical, examples include coupler (7) disclosed in U.S. Pat. No. 4,333,999, coupler (1) disclosed in U.S. Pat. No. 4,451,559, coupler (14) disclosed in U.S. Pat. No. 4,444,872, coupler (3) disclosed in U.S. Pat. No. 4,427,767, compounds (6}and (24) disclosed in U.S. Pat. No. 4,609,619, couplers (1) and (11) disclosed on U.S. Pat. No. 4,579,813, couplers (45) and (50) disclosed in European Patent (EP) 067,689B1, and coupler (3) disclosed in JP-A-61-42658.

The naphthol couplers which have an N-alkyl-N-arylcarbamoyl group in the 2-position of the naphthol nucleus (for example, U.S. Pat. No. 2,313,586), the naphthol couplers which have an alkylcarbamoyl group in the 2-position (for example, U.S. Pat. Nos. 2,474,293 and 4,282,312), the naphthol couplers which have an arylcarbamoyl group in the 2-position (for example, JP-B-50-14523), the naphthol based couplers which have a carboxylic acid amido group or a sulfonamido group in the 5-position (for example, JP-A-60-237448, JP-A-61-145557 and JP-A-61-153640), the naphthol couplers which have an aryloxy releasing group (for example, U.S. Pat. No. 3,476,563), the naphthol couplers which have a substituted alkoxy releasing group (for example, U.S. Pat. No. 4,296,199) and the naphthol couplers which have a glycolic acid releasing group (for example JP-B-60-39217) can be used as naphthol cyan couplers.

These couplers can be included in an emulsion layer in which they are dispersed in the presence of at least one of high boiling point organic solvent. The use of high boiling point organic solvents represented by the general formulae (A) to (E) set forth below are preferred.

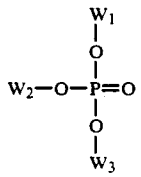
(A)

$W_1-COO-W_2$ (B)

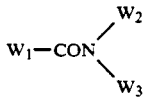
(C)

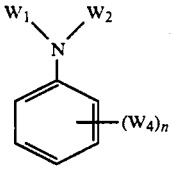
(D)

$W_1-O-W_2$ (E)

In these formulae, $W_1$, $W_2$ and $W_3$ each represents a substituted or unsubstituted alkyl group, cycloalkyl group, alkenyl group, aryl group or heterocyclic group, $W_4$ represents $-W_1$, $-O-W_1$ or $-S-W_1$, and n represents an integer of 1 to 5, and when n is 2 or more the $W_4$ groups may be the same or different. Moreover, $W_1$ and $W_2$ in general formula (E) may form a condensed ring.

Furthermore, these couplers can be impregnated into a loadable latex polymer (for example, U.S. Pat. No. 4,203,716) with or without the use of the aforementioned high boiling point organic solvents, or they can be dissolved in a water insoluble, organic solvent soluble polymer and emulsified and dispersed in an aqueous hydrophilic colloid solution.

Use of the homopolymers and copolymers disclosed on pages 12 to 30 of International Patent laid open W088/00723 is preferred, and the use of acrylamide polymers is especially preferred from the point of view of colored image stabilization etc.

Photosensitive materials of the present invention may contain hydroquinone derivatives, aminophenol derivatives, gallic acid derivatives and ascorbic acid derivatives as anti-color fogging agents.

Various anti-color fading agents can be used in the photosensitive materials of the present invention. Hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines and ether and ester derivatives in which the phenolic hydroxyl groups of these compounds have been silylated or alkylated are typical organic anti-color fading agents which can be used for cyan, magenta and/or yellow images. Furthermore, metal complexes as typified by (bis-salicylaldoximato)nickel and (bis-N,N-dialkyldithiocarbamato)nickel complexes, for example, can also be used for this purpose.

Actual examples of organic anti-color fading agents are disclosed in the patents indicated below.

Hydroquinones are disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028. 6-Hydroxychromans, 5-hydroxychromans and spirochromans are disclosed, for example, in U.S. Pat. Nos. 3,432,300, 3,573,050, 3,574,627, 3,698,909 and 3,764,337, and JP-A-52-152225. Spiroindanes have been disclosed in U.S. Pat. No. 4,360,589. P-alkoxyphenols are disclosed, for example, in U.S. Pat. No. 2,735,765, British Patent 2,066,975, JP-A-59-10539 and JP-B-57-19765. Hindered phenols are disclosed, for example, in U.S. Pat. No. 3,700,455, JP-A-52-72224, U.S. Pat. No. 4,228,235, and JP-B-52-6623. Gallic acid derivatives, methylenedioxybenzenes and aminophenols are disclosed, for example, in U.S. Pat. Nos. 3,457,079 and 4,332,886, and JP-B-56-21144 respectively. Hindered amines are disclosed, for example, in U.S. Pat. Nos. 3,336,135 and 4,268,593, British Patents 1,32 ,889, 1,354,313 and 1,410,846, JP-B-51-1420, JP-A-58-114036, JP-A-59-53846 and JP-A-59-78344. Phenolic hydroxyl group ether and ester derivatives are disclosed, for example, in U.S. Pat. Nos. 4,155,765, 4,174,220, 4,254,216 and 4,264,720, JP-A-54-145530, JP-A-55-6321, JP-A-58-105147, JP-A-59-10539, JP-B-57-37856, U.S. Pat. No. 4,279,990 and JP-B-53-3263, and metal complexes are disclosed, for example, in U.S. Pat. Nos. 4,050,938 and 4,241,155, and British Patent 2,027,731(A). These compounds can be used effectively by addition to the photosensitive layer after coemulsification with the corresponding color coupler, usually at a rate of from 5 to 100 wt % with respect to the coupler. The inclusion of ultraviolet absorbers in the layers on both sides adjacent to the cyan color forming layer is effective for preventing degradation of the cyan dye image by heat, and especially by light.

The spiroindanes and hindered amines among the above mentioned anti-color fading agents are especially desirable.

The use of compounds such as those described below, together with the aforementioned couplers, is preferred in the present invention. The conjoint use of these compounds with pyrazoloazole couplers is especially preferred.

Thus, the use of compounds (Q) which bond chemically with the aromatic amine developing agents remaining after color development processing and form compounds which are chemically inert and essentially colorless, and/or compounds (R) which bond chemically with the oxidized product of the aromatic amine color developing agents remaining after color development processing and form compounds which are chemically inert and essentially colorless either simultaneously or individually is desirable for preventing the occurrence of staining and other side effects due to colored dye formation resulting from the reaction of couplers with color developing agents or oxidized products thereof which remain in the film during storage after processing.

Compounds which react with p-anisidine with a second order reaction rate constant $k_2$ (measured in trioctyl phosphate at 80° C.) within the range of from 1.0 liter/mol.sec to $1\times10^{-5}$ liter/mol.sec are preferred for the compound (Q). Moreover, second order reaction rate constants can be measured using the method disclosed in JP-A-63-158545.

The compounds are unstable if $K_2$ has a value above this range, and they will react with gelatin or water and be decomposed. If, on the other hand, the value of $K_2$ is below this range, reaction with the residual aromatic amine developing agent is slow and consequently it is not possible to prevent the occurrence of the side effects of the residual aromatic amine developing agent.

The preferred compounds (Q) of this type are represented by the general formulae (QI) and (QII) which are shown below.

$$R_{101}-(A_{101})_{n101}-X_{101} \quad \text{(QI)}$$

$$R_{101}-(A_{101})_{n101}-X_{101} \quad \text{(QI)}$$

$$R_{102}-\underset{\underset{B_{101}}{\|}}{C}=Y_{101} \quad \text{(QII)}$$

In these formulae, $R_{101}$ and $R_{102}$ each represents an aliphatic group, an aromatic group or a heterocyclic group. Moreover, $n_{101}$ represents 1 or 0. $A_{101}$ represents a group which reacts With an aromatic amine developing agent and forms a chemical bond, and $X_{101}$ represents a group which is eliminated by reaction with an aromatic amine developing agent. $B_{101}$ represents a hydrogen atom, an aliphatic group, an aromatic group, a heterocyclic group, an acyl group or a sulfonyl group, and $Y_{101}$ represents a group which accelerates the addition of the aromatic amine developing agent to the compound of general formula (QII). Here, $R_{101}$ and $X_{101}$, and $Y_{101}$ and $R_{102}$ or $B_{101}$, can be joined together to form a cyclic structure.

Substitution reactions and addition reactions are typical of the reactions by which the residual aromatic amine developing agent is chemically bound.

The actual examples of compounds represented by the general formulae (QI) and (QII) are disclosed, for example, in JP-A-63-158545, JP A 62-283338. The examples in JP-A-64-2042 and JP-A-1-86139 are preferred.

On the other hand, the preferred compounds (R) which chemically bond with the oxidized product of the aromatic amine developing agents which remain after color development processing and form compounds which are chemically inert and colorless are represented by the general formula (RI) indicated below.

$$R_{103}-Z_{101} \quad \text{(RI)}$$

$R_{103}$ in this formula represents an aliphatic group, an aromatic group or a heterocyclic group. $Z_{101}$ represents a nucleophilic group or a group which decomposes in the photosensitive material and releases a nucleophilic group. The compounds represented by the general formula (RI) are preferably compounds in which $Z_{101}$ is a group of which the Pearson nucleophilicity $^{n}CH_3I$ value (R. G. Pearson et al., *J. Am. Chem. Soc.*, 90, 319 (1968)) is at least 5, or a group derived therefrom.

The actual examples of compounds which can be represented by general formula (RI) are disclosed, for example, in European Patent Laid Open No. 255,722, JP-A-62-143048, JP-A-62-229145. The examples in JP-A-1-57259, JP-A-1-86139, JP-A-64-2042 and Japanese Patent Application No. 63-136724 are preferred.

Furthermore, details of combinations of the aforementioned compounds (R) and compounds (Q) have been disclosed in European Patent Laid Open No. 277,589.

Ultraviolet absorbers can be included in the hydrophilic colloid layers in the photosensitive materials of the present invention. For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzoxidol compounds (for example, those disclosed in U.S. Pat. No. 3,700,455) can be used for this purpose. Ultraviolet absorbing couplers (for example, α-naphthol based cyan dye forming couplers) and ultraviolet absorbing polymers, for example, can also be used for this purpose. These ultraviolet absorbers can be mordanted in a specified layer.

Colloidal silver and dyes can be used in the full color recording materials of the present invention for anti-irradiation purposes, for anti-halation purposes, and especially for separating the spectral sensitivity distributions of the photosensitive layers and ensuring safety under safelights in the visible wavelength region.

Usually, a dye for an anti-irradiation or anti-halation purposes is used for a yellow dye forming emulsion layer and/or a magenta dye forming emulsion layer. The dye is generally incorporated into a ultraviolet absorbing layer. A filter dye is used for a cyan dye forming emulsion layer.

For an anti-irradiation purpose, a dye having a spectral absorption within the range of the principal sensitivity wavelength of the emulsion layer is used. It is preferred that the dye is water soluble. The use of such a dye improve storage stability after exposure up to development.

For an anti-halation purpose, a dye having a spectral absorption within the range of the principal sensitivity wavelength of the emulsion layer is used. It is preferred that the dye is incorporated as a non-diffusible state in a specified layer.

As a filter dye, a dye having a maximum absorption wavelength outside the range of the principal sensitivity wavelength of the emulsion layer is used. The dye is incorporated as a nondiffusible state in a specific layer.

Oxonol dyes, hemi-oxonol dyes, styryl dyes, merocyanine dyes, cyanine dyes and azo dyes can all be used for this purpose. Of these, the oxonol dyes, hemioxonol dyes and the merocyanine dyes are especially useful.

The decolorizable dyes or dyes for backing layers disclosed, for example, in JP-A-62-3250, JP-A-62-181381, JP-A-62-123454 and JP-A-63-197947 (preferably dyes represented by formula (VI) or (VII)), and the dyes disclosed in JP-A-62-39682, JP-A-62-123192, JP-A-62-158779 and JP-A-62-174741, or dyes obtained by introducing water solubilizing groups into these dyes so that the dyes can be washed out during processing, can be used as red-infrared dyes. The infrared dyes used in the present invention may be colorless with essentially no absorption at all in the visible wavelength region.

There is a problem in that when the infrared dyes used in the present invention are mixed with a silver halide emulsion spectrally sensitized to the red-infrared region, desensitization or fogging may occur, and when the dyes themselves are adsorbed on the silver halide grains, weak and broad spectral sensitization occurs. Hence the inclusion of these dyes in just colloid layers other than the photosensitive layers is preferred. For this reason, the inclusion of dyes in a state in which they are fast to diffusion in a specified colored layer is preferred. First, the dyes can be rendered fast to diffusion by the introduction of ballast groups. However, this is liable to result in the occurrence of residual coloration and process staining. Second, anionic dyes can be mordanted by a polymer or polymer latex which provides cation sites. Third, dyes which are insoluble in water at pH levels below 7 and which are decolorized and washed out during processing can be used in the form of fine particle dispersions. In this case, the dyes can be dissolved in a low boiling point organic solvent or rendered soluble into a surfactant and the solution so obtained can be dispersed in a hydrophilic protective colloid, such as gelatin, for use. Most desirably, the solid dye is milled with an aqueous surfactant solution and formed into fine particles mechanically in a mill, and these fine particles are dispersed in an aqueous solution of a hydrophilic colloid, such as gelatin, for use.

Gelatin is useful as a binder or protective colloid to use in the photosensitive layers of the photosensitive materials of the present invention, but other hydrophilic colloids, either alone or in conjunction with gelatin, can be use for this purpose.

The gelatin used in the invention may be a lime treated or acid treated gelatin. Details of the preparation of gelatins have been disclosed by Arthur Weise in *The Macromolecular Chemistry of Gelatin* (published by Academic Press, 1964).

The color photosensitive materials of the present invention is prepared by providing on a support, a photosensitive layer (YL) containing an yellow coupler, a photosensitive layer (ML) containing a magenta coupler and a photosensitive layer (CL) containing a cyan coupler, a protective layer (PL) and inter-layers (IL), and colored layers which can be decolorized during development processing, and especially anti-halation layers (AH), can be established as required. The YL, ML and CL have spectral sensitivities corresponding to at least three light sources which have different principal wavelengths. The principal wavelengths of the YL, the ML and the CL are separated from one another by at least preferably 30 nm, more preferably at least 40 nm, and most preferably from 50 nm to 100 nm, and at the principal wavelength of any one sensitive layer there is a difference in photographic speed of at least 0.8 LogE (exposure), and preferably of at least 1.0, from the other layers. It is preferred that each of all the photosensitive layers is sensitive in the region of wavelengths longer than 670 nm, most desirably at least one layer is sensitive in the region of wavelengths longer than 750 nm. It is preferred that two or three layers are spectrally sensitized to match laser beam wavelength regions selected from 660 to 690 nm, 740 to 790 nm, 800 to 850 nm and 850 to 900 nm.

The other layers which are not sensitized in such a manner may be spectrally sensitized to match, for example, a wavelength of 650 nm of a semiconductor laser light beam, a wavelength of 500 nm obtained from a secondary harmonic wave generation, or a wavelength of 450, 550 or 590 nm obtained from a LED, and preferably a wavelength of the red-region.

For example, any photosensitive layers such as those indicated in the following table can be adopted. In this table, R signifies red sensitization and IR-1 and IR-2 signify layers which have been spectrally sensitized to different infrared wavelength regions.

| | (1) | (2) | (3) | (4) | (5) |
|---|---|---|---|---|---|
| Protective layer | PL | PL | PL | PL | PL |
| Photosensitive layer (Unit) | YL = R<br>ML = IR-1<br>CL = IR-2<br>(AH) | YL = 1R-2<br>ML = 1R-1<br>CL = R<br>(AH) | YL = R<br>CL = IR-1<br>ML = IR-2<br>(AH) | ML = R<br>YL = IR-1<br>CL = IR-2<br>(AH) | CL = R<br>YL = IR-1<br>ML = IR-2<br>(AH) |
| Support | | | | | |

| | (6) | (7) | (8) | (9) |
|---|---|---|---|---|
| Protective layer | PL | PL | PL | PL |
| Photosensitive layer (Unit) | CL = R<br>ML = IR-1<br>YL = IR-2<br>(AH) | CL = 1R-2<br>MI = 1R-1<br>YL = R<br>(AH) | ML = IR-2<br>CL = IR-1<br>YL = R<br>(AH) | ML = R<br>CL = IR-1<br>YL = IR-2<br>(AH) |
| Support | | | | |

In the present invention, the photosensitive layer which has a spectral sensitivity in the wavelength region above 670 nm can be exposed imagewise using a laser light beam. Hence, the spectral sensitivity distribution is preferably in a wavelength range of ±25 nm of the principal wavelength, and most desirably of ±15 nm of the principal wavelength. On the other hand, the spectral sensitivity of the present invention at wavelengths longer than 670 nm, especially in the infrared wavelength region is liable to become comparatively broad. Hence, the spectral sensitivity distribution of the photosensitive layer should be corrected using dyes, and preferably, dyes which are fixed in a specified layer. Dyes which can be included in a colloid layer in a non-diffusive form, and which can be decolorized during development processing, are used for this purpose. First, fine particle dispersions of solid dyes which are essentially insoluble in water at pH 7 and soluble in water at pH greater than 9 can be used. Second, acidic dyes can be used together with a polymer, or polymer latex, which provides cation sites. Dyes represented by the general formulae (VI) and (VII) in the specification of JP-A-63-197947 are useful in the first and second methods described above. Dyes which have carboxyl groups are especially useful in the first method.

The transparent films and reflective supports, such as cellulose nitrate films and poly(ethylene terephthalate) films, normally used in photographic photosensitive materials can be used as the supports in the present invention. The use of reflective supports is preferred in view of the objects of the present invention.

The "reflective supports" used in the present invention have a high reflectivity and make the dye image formed in the silver halide emulsion layer is sharp. The use of supports which have been covered with a hydrophobic resin containing a dispersion of light reflecting material, such as titanium oxide, zinc oxide, calcium carbonate or calcium sulfate for increasing the reflectance in the visible wavelength region, and supports comprising a hydrophobic resin containing a dispersion of a light reflecting substance are included among such reflective supports. Examples of such supports include baryta paper, polyethylene coated paper, polypropylene based synthetic paper and transparent supports, such as glass plates, polyester films, such as poly(ethylene terephthalate), cellulose triacetate and cellulose nitrate films, polyamide films, polycarbonate films, polystyrene films, and polyvinyl chloride films on which a reflective layer is provided or in which a reflective substance is combined. These supports can be selected appropriately according to the intended application of the material.

The use of a white pigment milled adequately in the presence of a surfactant and the pigment particles of which the surface is treated with a dihydric-tetrahydric alcohol for the light reflecting substance is preferred.

The occupied surface ratio of fine white pigment particles per specified unit area (%) can be determined most typically by dividing the area observed into adjoining $6\times6$ μm unit areas and measuring the occupied area ratio (%) for the fine particles projected in each unit area. The variation coefficient of the occupied area ratio (%) can be obtained by means of the ratio $s/\bar{R}$ of the standard deviation s for $\bar{R}$ which is the average value of $R_i$. The number (n) of unit areas taken for observation is preferably at least six. Hence, the variation coefficient $s/\bar{R}$ can be obtained from the expression:

$$\sqrt{\frac{\sum_{i=1}^{n}(Ri-R)^2}{n-1}} \Big/ \frac{\sum_{i=1}^{n} Ri}{n}$$

In the present invention, the occupied area ratio (%) of the fine pigment particles is not more than 0.15, and preferably not more than 0.12.

Metal films, for example aluminum or alloy films or metals having mirror surface reflection properties or having a surface having second diffuse reflection properties as disclosed, for example, in JP-A-63-118154, JP-A-63-24247, JP-A-63-24251 to 63-24253, and JP-A-63-245255 can be used for the light reflecting substance.

The supports used in the present invention should be light in weight, thin and tenacious since the materials are used for hard copies after image formation. They should also be inexpensive. Polyethylene coated papers and synthetic papers of a thickness of from 10 to 250 μm are preferred as reflective supports, and more preferably of a thickness of from 30 to 180 μm.

The features of the color development processings and processing solutions which are used in the present invention are described below. The color development processings for the full color recording materials of the present invention is comprised of color development, bleach-fixing, and water washing or stabilization processes, and bleaching and fixing steps can be introduced as required. According on the present invention color development can be and preferably is completed within 60 seconds, and then the other processes are started and color development processing (excluding drying) can be and preferably is completed in a short time of not more than 180 seconds.

Silver halide emulsions which have a high silver chloride content (greater than 95 mol %) are used in the full color recording materials of the present invention, and the halide ion concentration of the color development bath has a pronounced effect on stability and uneven development.

The chloride ion concentration in the color development bath in the present invention is from $3.5\times10^{-2}$ to $1.5\times10^{-1}$ mol/liter, and preferably from $4\times10^{-2}$ to $1\times10^{-1}$ mol/liter. There is a problem in that development is retarded when the chloride ion content exceeds $1.5\times10^{-1}$ mol/liter and rapid processing and high maximum densities, which are the objects of the present invention, cannot be achieved. Furthermore, if the chloride ion concentration is less than $3.5\times10^{-2}$ mol/liter, streaky pressure fogging and uneven development are difficult to avoid. Moreover, there are large fluctuations in continuous processing and the residual silver content increases.

The bromide ion concentration in the color development bath in the present invention is from $3.0\times10^{-5}$ to $1.0\times10^{-3}$ mol/liter, and preferably from $5.0\times10^{-5}$ to $5\times10^{-4}$ mol/liter. Development is retarded and the maximum density and photographic speed are reduced when the bromide ion concentration is greater than $1\times10^{-3}$ mol/liter, and streaky pressure fogging and uneven development are difficult to avoid when the bromide ion concentration is less than $3.0\times10^{-5}$ mol/liter, and fluctuations in the photographic performance in continuous processing and de-silvering failure are liable to occur. When the halogen composition of the silver halide grains is pure silver chloride, the concentration may be less than $3.0\times10^{-5}$ mol/liter.

Here, chloride ion and bromide ion may be added directly to the development solution, or they may be dissolved out from the photosensitive material in the solution.

Sodium chloride, potassium chloride, ammonium chloride, nickel chloride, magnesium chloride, manganese chloride, calcium chloride and cadmium chloride can be used as sources of chloride ions which can be added directly to the color development solution, but the use of sodium chloride and potassium chloride is preferred. Furthermore the chloride ion can be added in the form of a counter ion for the fluorescent whiteners which are added to the development solutions. Sodium bromide, potassium bromide, ammonium bromide, lithium bromide, calcium bromide, magnesium bromide, manganese bromide, nickel bromide, cadmium bromide, cerium bromide, and thallium bromide can be used as a source of bromide ions, but the use of potassium bromide and sodium bromide from among these materials is preferred.

In those cases in which halide ions are dissolved out into the development solution from the sensitive material, both chloride ions and bromide ions can be supplied from the emulsion, or they may be supplied from another source.

Sulfite ion is useful for preventing aerial oxidation of the developing agent and for preventing the occurrence of staining, but with the full color recording materials of the present invention in which the silver halide emulsions having a high silver chloride content are used, essentially sulfite ion free development solutions are used because of problems with the variation in photographic performance in continuous processing, uneven development and streaky pressure fogging etc. Here, the term "essentially sulfite ion free" signifies a sulfite ion concentration of not more than $10^{-2}$ mol per liter of development solution. In the absence of sulfite ion, physical devices, such as the use of a floating lid or reduction of the open area of the development tank, can be used to suppress the effects of aerial oxidation to prevent degradation of the development solution. A chemical means, such as the addition of an organic preservative, can also be used for this purpose. The methods in which organic preservatives are used are advantageous because of convenience.

The organic preservatives used in the present invention are organic compounds which reduce the rate of deterioration of primary aromatic amine color developing agents when added to a color photographic material processing solution. That is to say, the organic preservatives are organic compounds which have the ability to prevent the oxidation of color developing agents by air and, from among these compounds, the hydroxylamine derivatives (excluding hydroxylamine, the same below), hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamido compounds and condensed ring amines, for example, are especially effective as organic preservatives. These are disclosed, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

The concentration of the aforementioned organic preservatives in the color development solution is from 0.005 to 0.5 mol/liter, and preferably from 0.03 to 0.1 mol/liter.

The addition of hydroxylamine derivatives and/or hydrazine derivatives is preferred.

Details of hydroxylamine derivatives and hydrazine derivatives (hydrazines and hydrazides) are disclosed in JP-A-1-97953, JP-A-1-186939, JP-A-1-186940 and JP-A-1-187559.

Furthermore, the conjoint use of the aforementioned hydroxylamine derivatives or hydrazine derivatives with amines is preferred for improving the stability of the color development solution and improving stability during continuous processing.

The aforementioned amines may be cyclic amines as disclosed in JP-A-63-239447, amines of the type disclosed in JP-A-63-128340, or other amines such as those disclosed in JP-A-1-186939 and JP-A-1-187557.

The above mentioned organic preservatives can be obtained as commercial products, or they can be prepared using the methods disclosed, for example, in JP-A 63-170642 and JP-A-63-239447.

Known primary aromatic amine color developing agents may be contained in the color development solutions used in the present invention. The p-phenylenediamines are preferred, and typical examples are set forth below, but the invention is not limited by these examples.

(D-1) N,N-Diethyl-p-phenylenediamine (D-2) 4-[N-ethyl-N-(β-hydroxyethyl)amino]aniline (D-3) 2-Methyl-4-[N-ethyl-N-(β-hydroxyethyl-)amino]aniline (D-4) 4-Amino-3-methyl-N-ethyl-N-(β-methanesulfonamidoethyl)aniline Furthermore, these p-phenylenediamine derivatives may take the form of salts, such as sulfates, hydrochlorides or p-toluenesulfonates for example. The concentration of the primary aromatic amine developing agent used is preferably from 0.1 to 20 grams, and more preferably from about 0.5 to about 10 grams, per liter of development solution.

The color development solutions used in the present invention are preferably having a pH of from 9 to 12, and more desirably of from 9 to 11, and other known development solution component compounds can be included therein.

The use of various buffers for maintaining the above mentioned pH levels is preferred. Examples of such buffers include sodium carbonate, potassium carbonate, sodium bicarbonate, potassium bicarbonate, trisodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of the buffer added to the color development solution is preferably at least 0.1 mol/liter, and more preferably from 0.1 to 0.4 mol/liter.

Various chelating agents can also be used in the color development solutions for preventing the precipitation of calcium and magnesium, or for improving the stability of the color development solution.

Actual examples are set forth below, but the chelating agents are not limited by these examples:

nitrilotriacetic acid, diethylenetriamine pentaacetic acid, ethylenediamine tetra-acetic acid, triethylenetetramine hexa-acetic acid, N,N,N-trimethylenephosphonic acid, ethylenediamine-N,N,N',N'-tetramethylenephosphonic acid, 1,3-diamino-2-propanol tetra-acetic acid, trans-cyclohexanediamine tetra-acetic acid, nitrilotripropionic acid, 1,2-diaminopropane tetraacetic acid, hydroxyethyliminodiacetic acid, glycol ether diamine tetra-acetic acid, hydroxyethylenediamine triacetic acid, ethylenediamine o-hydroxyphenylacetic acid, butan-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid and 4-sulfosalicylic acid.

Two or more of these chelating agents can be used conjointly, if desired.

The amount of the chelating agent used should be sufficient to block up the metal ions which are present in the color development solution. For example, they can be used at a concentration of from about 0.1 gram to about 10 grams per liter.

Various development accelerators can be added to the color development solution, if desired.

For example, the thioether compounds disclosed, for example, in JP B-37-16088, JP-B-37-5987, JP-B-38-7826, JP-B-44 12380, JP-B-45-9019 and U.S. Pat. No. 3,813,247, the p-phenylenediamine compounds disclosed in JP-A-52-49829 and JP-A-50-15554, the quaternary ammonium salts disclosed, for example, in JP-A-

50-137726, JP-B-44-30074, JP-A-56-156826 and JP-A-52-43429, the p-aminophenols disclosed in U.S. Pat. Nos. 2,610,122 and 4,119,462, the amine compounds disclosed, for example, in U.S. Pat. Nos. 2,494,903, 3,128,182, 4,230,796 and 3,253,919, JP-B-41-11431, and U.S. Pat. Nos. 2,482,546, 2,596,926 and 3,582,346, the poly(alkylene oxides) disclosed, for example, in JP-B-37-16088, JP-B-42-25201, U.S. Pat. No. 3,128,183, JP-B-41-11431, JP-B-42-23883 and U.S. Pat. No. 3,532,501, and 1-phenyl-3-pyrazolidones, hydrazines, meso-ionic compounds, ionic compounds and imidazoles, for example, can be added as development accelerators, if desired.

The color development solution is preferred to be essentially benzyl alcohol free. This means that the concentration of benzyl alcohol in the development solution is not more that 2.0 ml/liter, and that the development solution preferably contains no benzyl alcohol at all. Being essentially benzyl alcohol free minimizes the fluctuation in photographic characteristics during continuous processing and provides the desired results.

Any anti-foggant can be added optionally, if desired, in the present invention. Alkali metal halides, such as potassium iodide, and organic anti-foggants can be used for this purpose. Typical examples of organic anti-foggants include nitrogen containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

The inclusion of fluorescent whiteners in the color development solutions used in the present invention is desirable. 4,4'-Diamino-2,2'-disulfostilbene compounds are preferred as fluorescent whiteners. These are added in an amount of from 0 to 10 grams/liter, and preferably in an amount of from 0.1 to 6 grams/liter.

Furthermore, various surfactants, such as alkylsulfonic acids, arylsulfonic acids, aliphatic carboxylic acids and aromatic carboxylic acids, can be added, as required.

The processing temperature of the color development solution in the present invention is preferably from 20° C. to 50° C., and more preferably from 30° C. to 40° C. The processing time is preferably from 20 seconds to 5 minutes, more preferably from 30 seconds to 2 minutes. The most preferred embodiment is not more than 60 seconds and from 30° to 40° C.

A de-silvering process is carried out after color development in the present invention. The de-silvering process is normally comprised of a bleaching process and a fixing process, but these processes are preferably carried out simultaneously in a bleach-fix process.

Re-halogenating agents, such as bromides (for example, potassium bromide, sodium bromide, ammonium bromide), chlorides (for example, potassium chloride, sodium chloride, ammonium chloride), or iodides (for example, ammonium iodide) can be included in the bleach baths or bleach-fix baths which are used in the present invention. One or more inorganic acids or organic acids, or an alkali metal or ammonium salt thereof, which has a pH buffering function, for example, boric acid, borax, sodium metaborate, acetic acid, sodium acetate, sodium carbonate, potassium carbonate, phosphorous acid, phosphoric acid, sodium phosphate, citric acid, sodium citrate or tartaric acid, and corrosion inhibitors such as ammonium nitrate and guanidine, can be added, if desired.

Known fixing agents include thiosulfates, such as sodium thiosulfate and ammonium thiosulfate, thiocyanates, such as sodium thiocyanate and ammonium thiocyanate, thioether compounds, such as ethylenebisthioglycolic acid and 3,6-dithia-1,8-octanediol, and water soluble silver halide solvents, such as thioureas can be used either alone or in combinations as the fixing agent in the bleach-fix solutions and fixing solutions which are used in the present invention. Special bleach-fix solutions consisting of a combination of large quantities of a halide such as potassium iodide and a fixing agent as disclosed in JP-A-55-155354 can also be used. The use of thiosulfates, and especially ammonium thiosulfate, is preferred in the present invention. The amount of fixing agent per liter is preferably within the range from 0.3 to 2 mol, and most desirably within the range from 0.5 to 1.0 mol.

The pH range of the bleach-fix solution or fixing solution in the present invention is preferably from 3 to 10, and most desirably from 5 to 9. Improved de-silvering can be achieved at lower pH values, but deterioration of the solution and leuco dye formation from the cyan dye are promoted under these conditions. Conversely, de-silvering is retarded and staining is liable to occur at higher pH values.

Hydrochloric acid, sulfuric acid, nitric acid, acetic acid, bicarbonates, ammonia, caustic potash, caustic soda, sodium carbonate and potassium carbonate, for example, can be added, as required, to adjust the pH value.

Furthermore, various fluorescent whiteners and anti-foaming agents, or surfactants, polyvinyl pyrrolidone and organic solvents such as methanol, for example, can be included in the bleach-fix solution.

Sulfite ion releasing compounds, such as sulfites (for example, sodium sulfite, potassium sulfite, ammonium sulfite), bisulfites (for example, ammonium bisulfite, sodium bisulfite, potassium bisulfite) and metabisulfites (for example, potassium metabisulfite, sodium metabisulfite, ammonium metabisulfite) can be used as preservatives in the bleach-fix solutions and fixing solutions may be used in the present invention. These compounds are used at a concentration, calculated as sulfite ion, preferably of from 0.02 to 0.50 mol/liter, and more preferably of from 0.04 to 0.40 mol/liter.

Sulfites are generally added as the preservative, but ascorbic acid and carbonyl/sulfite addition compounds, sulfinic acids or carbonyl compounds and sulfinic acids, for example, can be added.

Buffers, fluorescent whiteners, chelating agents, and antimoldings etc. can also be added, if desired.

The silver halide color photographic light-sensitive materials of the present invention are generally subjected to a water washing process and/or stabilization process after the de-silvering process, such as a fixing or bleach-fix process.

The amount of wash water used in a washing process can be fixed within a wide range, depending on the characteristics of the photosensitive material (such as couplers used) and their application, the wash water temperature, the number of water washing tanks (the number of water washing stages), the replenishment system (i.e. whether a counter-flow or sequential flow system is used), and various other factors. The relationship between the amount of water used and the number of washing tanks in a multi-stage counter-flow system can be obtained using the method outlined on pages 248 to 253 of the *Journal of the Society of Motion Picture and Television Engineers*, Vol. 64 (May 1955).

The amount of wash water can be greatly reduced by using the multi-stage counter-flow system noted in the aforementioned literature, but bacteria proliferate due to the increased residence time of the water in the tanks, and problems with the suspended matter which is produced becoming attached to the photosensitive material occur. The method in which the calcium ion and magnesium ion concentrations are reduced, as disclosed in JP-A-62-288838, can be used very effectively as a means of overcoming this problem when processing color photographic photosensitive materials of the present invention. Furthermore, the isothiazolone compounds disclosed in JP-A-57-8542, thiabendazoles, chlorinated disinfectants such as chlorinated sodium isocyanurate, and benzotriazole, for example, and the disinfectants disclosed in "*The Chemistry of Biocides and Fungicides*" by Horiguchi, in "*Killing Microorganisms, Biocidal and Fungicidal Techniques*" published by the Health and Hygiene Technical Society, and in "*A Dictionary of Biocides and Fungicides*" published by the Japanese Biocide and Fungicide Society, can also be used in this connection.

The pH value of the wash water when processing photosensitive materials of the present invention is from 4 to 9, and preferably from 5 to 8. The washing water temperature and the washing time can be adjusted in accordance with the characteristics and application of the photosensitive material but, in general, washing conditions of from 20 seconds to 10 minutes at a temperature of from 15° C. to 45° C. are selected, and preferably of from 30 seconds to 5 minutes at a temperature of from 25° C. to 40° C., are selected.

Moreover, the photosensitive materials of the present invention can be processed directly in a stabilizing bath instead of being subjected to a water wash as described above. The known methods disclosed in JP-A-57-8543, JP-A-58-14834, JP-A-59-184343, JP-A-60-220345, JP-A-60-238832, JP-A-60-239784, JP-A-60-239749, JP-A-61-4054 and JP-A-61-118749 can all be used in such a stabilization process. Stabilizing baths which contain 1-hydroxyethylidene-1,1-diphosphonic acid, 5-chloro-2-methyl-4-isothiazolin-3-one, bismuth compounds and ammonium compounds, for example, are especially desirable.

Furthermore, in some cases, a stabilization process is carried out following the aforementioned water washing process. Examples of such baths include the stabilizing baths which contain formalin and surfactant which are used as final baths when processing camera color photosensitive materials.

The processing operation time in the present invention is defined as the period of time (excluding drying) from which the photosensitive material makes contact with the color development solution up to the time at which it emerges from the final bath (generally a water washing or stabilizing bath). The effect of the present invention is most pronounced in cases of rapid processing in which this processing operation time is not more than 180 seconds, and preferably not more than 150 seconds.

The invention is described in practical terms below by means of examples, but the present invention is not limited by these examples. Unless otherwise indicated, all perents, ratios, parts, etc. are by weight.

EXAMPLE 1

Lime treated gelatin (32 grams) was added to 1000 ml of distilled water and dissolved at 40° C., after which 3.3 grams of sodium chloride were added and the temperature was raised to 52° C. A 1% aqueous solution (3.2 ml) of N,N'-dimethylimidazolin-2-thione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes while maintaining a temperature of 52° C. Moreover, a solution obtained by dissolving 128.0 grams of silver nitrate in 560 ml of water and a solution obtained by dissolving 44.0 grams of sodium chloride and 0.1 mg of potassium hexachloroiridate (IV) in 560 ml of distilled water were added to, and mixed with, the aforementioned mixture over a period of 20 minutes while maintaining a temperature of 52° C. The mixture was subsequently maintained at 52° C. for a period of 15 minutes, after which the temperature was lowered to 40° C. and the mixture was desalted and washed with water. Lime treated gelatin was then added to provide emulsion (A). The emulsion so obtained contained cubic silver chloride grains of average particle size 0.45μ with a particle size variation coefficient of 0.08.

Emulsion (B) which contained 2 mol % silver bromide was obtained in the same way as emulsion (A) except that the aqueous solution of sodium chloride added together with the aqueous silver nitrate solution were replaced by mixed aqueous solutions of sodium chloride and potassium bromide (with the same total number of mol as before, mol ratio 98:2). The addition times for the reactants were adjusted in such a way that the average grain size of the silver halide grains contained in this emulsion was the same as that in emulsion (A). The grains obtained were cubic grains, and the grain size variation coefficient was 0.08.

Emulsion (C) which contained 10 mol % silver bromide was obtained in the same way as emulsion (A) except that the aqueous solutions of sodium chloride added together with the aqueous silver nitrate solution were replaced by mixed aqueous solutions of sodium chloride and potassium bromide (with the same total number of mol as before, mol ratio 9:1). The addition times for the reactants were adjusted in such a way that the average grain size of the silver halide grains contained in this emulsion was the same as that in emulsion (A). The grains obtained were cubic grains, and the grain size variation coefficient was 0.09.

The pH and pAg values of the three types of emulsions so obtained were adjusted, after which triethylthiourea was added and each emulsion was optimally chemically sensitized to provide emulsions (A-1), (B-1) and (C-1).

A fine grained silver bromide emulsion (a-1) of average grain size 0.05μ was prepared separately from the above mentioned emulsions.

An amount of the emulsion (a-1) corresponding to 2 mol % as silver halide was added to emulsion (A), after which triethylthiourea was added and the emulsion was optimally chemically sensitized to provide emulsion (A-2).

The compound shown below was added as a stabilizer in an amount of $5.0\times10^{-4}$ mol/per mol of silver halide to each of these four types of emulsions.

Stabilizer (I-1)

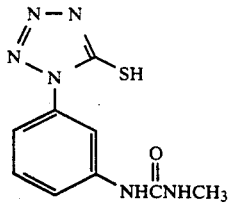

The halogen compositions and distributions of the four types of silver halide emulsion so obtained were investigated using X-ray diffraction methods.

The results obtained showed single diffraction peaks for 100% silver chloride for emulsion (A-1), 98% silver chloride (2% silver bromide) for emulsion (B-1) and 90% silver chloride (10% silver bromide) for emulsion (C-1). On the other band, the result for emulsion (A-2) showed a broad peak centered on 70% silver chloride (30% silver bromide) with a spread to the side of 60% silver chloride (40% silver bromide) as well as a main peak for 100% silver chloride.

Next, emulsified dispersions of color couplers etc. were prepared and combined with each of the aforementioned silver halide emulsions and the mixtures were coated onto a paper support which had been laminated on both sides with polyethylene to provide multi layer photosensitive materials of which the layer structure was prepared as indicated below.

Layer Structure

The composition of each layer is indicated below. The numerical values indicate coated weights (g/m$^2$; or ml/m$^2$ in the case of solvents). The coated weights of silver halide emulsions are shown as coated weights of silver.

| | |
|---|---|
| Support | |
| Polyethylene laminated paper [White pigment ($TiO_2$) and blue dye (ultramarine) were included in the polyethylene on the emulsion layer side] | |
| First Layer (Yellow Color Forming Layer) | |
| Silver halide emulsion (Table 1) | 0.03 |
| Spectrally sensitizing dye (Table 1) | |
| Yellow coupler (Y-1) | 0.82 |
| Colored image stabilizer (Cpd-7) | 0.09 |
| Solvent (Solv-6) | 0.28 |
| Gelatin | 1.75 |
| Second Layer (Anti-color Mixing Layer) | |
| Gelatin | 1.25 |
| Filter dye (Dye-10) | 0.01 |
| Anti-color mixing agent (Cpd-4) | 0.11 |
| Solvents (Solv-2) | 0.24 |
| (Solv-5) | 0.26 |
| Third Layer (Magenta Color Forming Layer) | |
| Silver halide emulsion (Table 1) | 0.12 |
| Spectrally sensitizing dye (Table 1) | |
| Magenta coupler (M-1) | 0.13 |
| Magenta coupler (M-2) | 0.09 |
| Colored image stabilizer (Cpd-1) | 0.15 |
| Colored image stabilizer (Cpd-2) | 0.02 |
| Colored image stabilizer (Cpd-8) | 0.02 |
| Colored image stabilizer (Cpd-9) | 0.03 |
| Solvent (Solv-1) | 0.34 |
| Solvent (Solv-2) | 0.17 |
| Gelatin | 1.25 |
| Fourth Layer (Ultraviolet Absorbing Layer) | |
| Gelatin | 1.58 |
| Filter dye (Dye-11) | 0.03 |
| Ultraviolet absorber (UV-1) | 0.47 |
| Anti-color mixing agent (Cpd-4) | 0.05 |
| Solvent (Solv-3) | 0.26 |
| Fifth Layer (Cyan Color Forming Layer) | |
| Silver halide emulsion (Table 1) | 0.23 |
| Spectrally sensitizing dye (Table 1) | |
| Cyan coupler (C-1) | 0.32 |
| Colored image stabilizer (Cpd-5) | 0.17 |
| Colored image stabilizer (Cpd-6) | 0.04 |
| Colored image stabilizer (Cpd-7) | 0.40 |
| Solvent (Solv-4) | 0.15 |
| Gelatin | 1.34 |
| Sixth Layer (Ultraviolet Absorbing Layer) | |
| Gelatin | 0.53 |
| Ultraviolet absorber (UV-1) | 0.16 |
| Anti-color mixing agent (Cpd-4) | 0.02 |
| Solvent (Solv-3) | 0.09 |
| Seventh Layer (Protective Layer) | |
| Gelatin | 1.33 |
| Acrylic modified poly(vinyl alcohol) (17% modification) | 0.17 |
| Liquid paraffin | 0.03 |

1-Oxy-3,5-dichloro-s-triazine sodium salt, was used in an amount of 14.0 mg per gram of gelatin in each layer as a gelatin hardening agent.

Yellow coupler (Y-1)

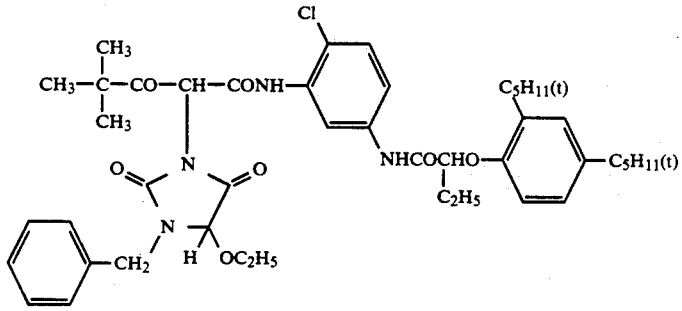

Cyan Coupler (C-1)

A 2:4:4 (by weight) mixture of:

-continued
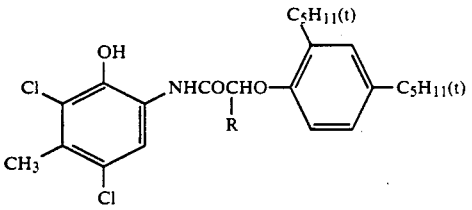
(where R = $C_2H_5$ and $C_4H_9$ respectively)
and
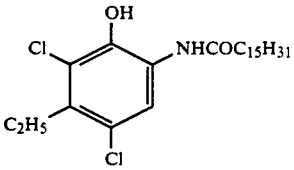
Magenta Coupler (M-1)
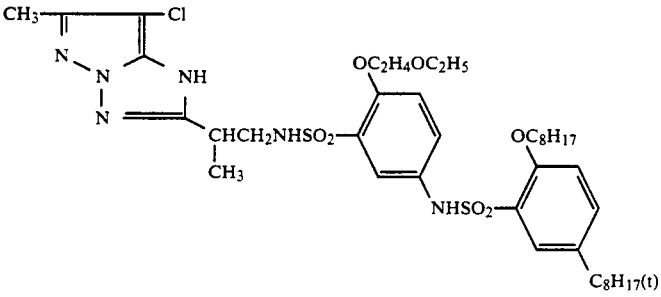
Magenta Coupler (M-2)
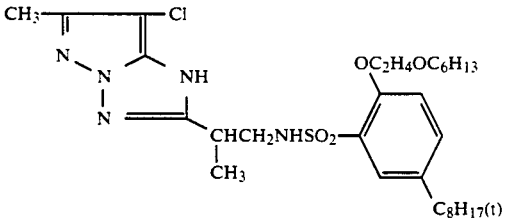
Colored Image Stabilizer (Cpd-1)
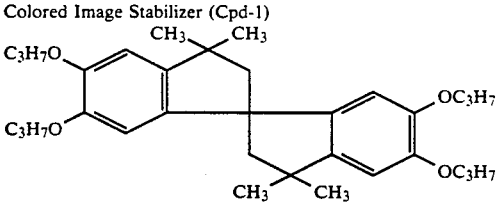
Colored Image Stabilizer (Cpd-2)
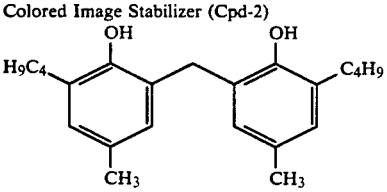
Anti-color Mixing Agent (Cpd-4)
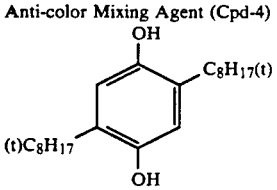

-continued
Colored Image Stabilizer (Cpd-5)
A 2:2:4 mixture (by weight) of:
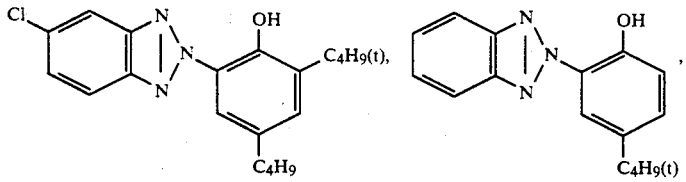
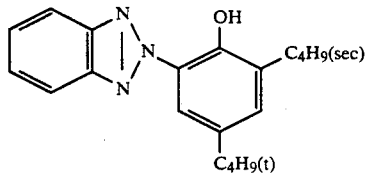
Colored Image Stabilizer (Cpd-6)
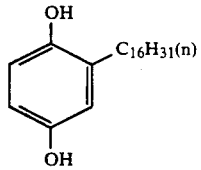
Colored Image Stabilizer (Cpd-7)
$$\left(CH_2-\underset{\substack{|\\ CONHC_4H_9(t)}}{CH}\right)_n$$
n = mean molecular weight: 80,000
Colored Image Stabilizer (Cpd-8)
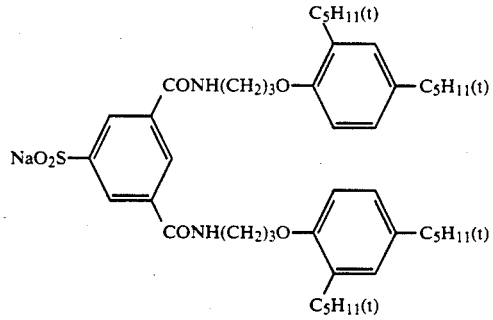
Colored Image Stabilizer (Cpd-9)
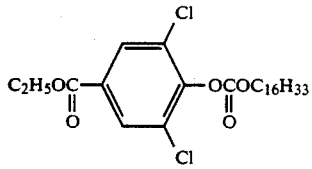
Solvent (Solv-1)
$$O{=}P\left(OCH_2\overset{\substack{C_2H_5\\ |}}{C}HC_4H_9\right)_3$$
Solvent (Solv-2)
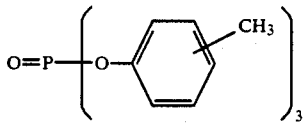
Solvent (Solv-3)

-continued
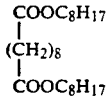
Solvent (Solv-4)
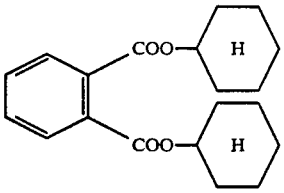
Solvent (Solv-5)
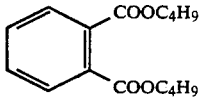
Solvent (Solv-6)
$O{=}P{+}O{-}C_9H_{19}\text{-(iso)})_3$
Ultraviolet Absorber (UV-1)
A 4:2:4 (by weight) mixture of:
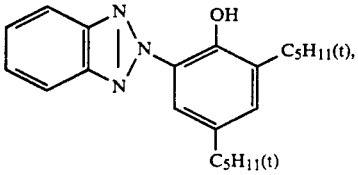
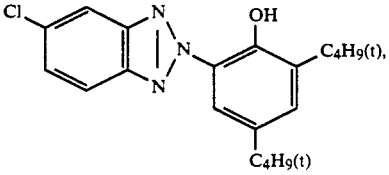
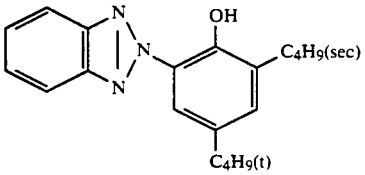
(Dye-10)
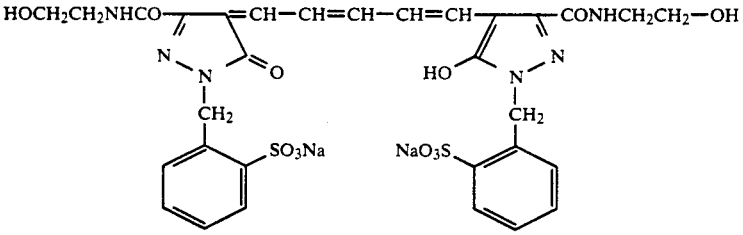
10 mg per square meter of coated film
(For filter and anti-irradiation purposes)
(Dye-11)
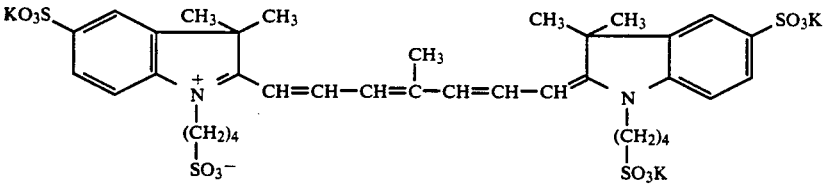
30 mg per square meter of coated film
(For filter and anti-irradiation purposes)
TABLE 1
| Sample No. | a | b | c | d | e | f | g |
|---|---|---|---|---|---|---|---|
| Yellow Color | | | | | | | |

TABLE 1-continued

| | | | | | | | |
|---|---|---|---|---|---|---|---|
| Forming Layer | | | | | | | |
| Emulsion Used | A-1 | A-1 | B-1 | B-1 | A-2 | C-1 | C-1 |
| Dye Used | Dye-1 | Dye-4 | Dye-1 | Dye-4 | Dye-4 | Dye-1 | Dye-4 |
| (λmax of emulsion) | 480 | 675 | 480 | 677 | 670 | 482 | 680 |
| Magenta Color Forming Layer | | | | | | | |
| Emulsion Used | A-1 | A-1 | B-1 | B-1 | A-2 | C-1 | C-1 |
| Dye Used | Dye-2 | Dye-5 | Dye-2 | Dye-5 | Dye-5 | Dye-2 | Dye-5 |
| (λmax of emulsion) | 550 | 730 | 550 | 733 | 730 | 553 | 735 |
| Cyan Color Forming Layer | | | | | | | |
| Emulsion Used | A-1 | A-1 | B-1 | B-1 | A-2 | C-1 | C-1 |
| Dye Used | Dye-3 | Dye-6 | Dye-3 | Dye-6 | Dye-6 | Dye-3 | Dye-6 |
| (λmax of emulsion) | 705 | 810 | 707 | 815 | 813 | 708 | 815 |
| Remarks | Comparative example | Comparative example | Comparative example | Comparative example | This invention | Comparative example | Comparative example |

(Dye-1)

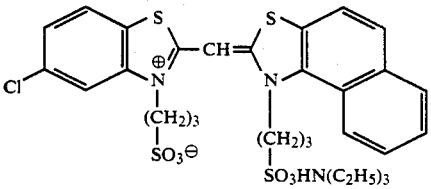

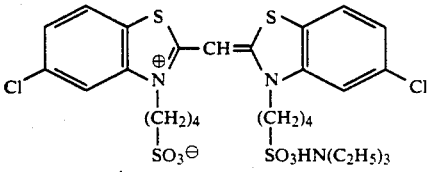

(2.0 × $10^{-4}$ mol of each per mol of silver halide)

(Dye-2)

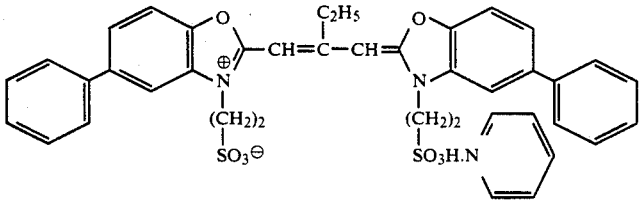

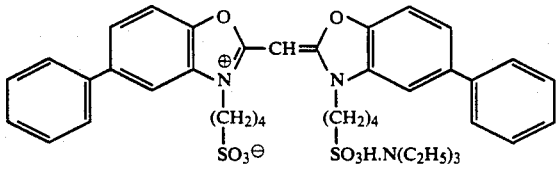

(4.0 × $10^{-4}$ mol/7.0 × $10^{-5}$ mol per mol of silver halide)

(Dye-3)

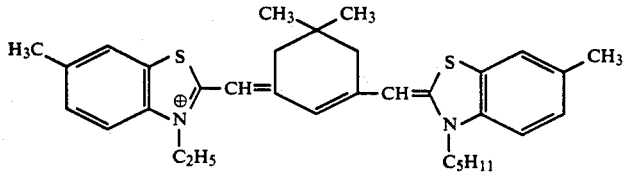

(0.9 × $10^{-4}$ mol per mol of silver halide)

The compound (IV-1) shown below was added in an amount of $2.6\times10^{-3}$ mol per mol of silver halide when the above mentioned sensitizing dye (Dye-3) was used.

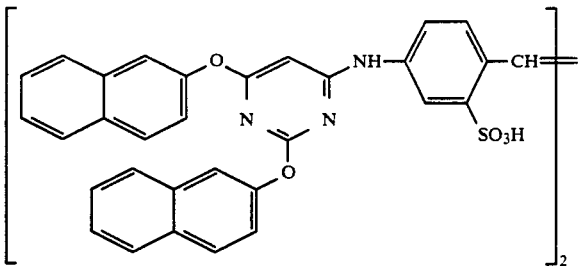

(Dye-4)

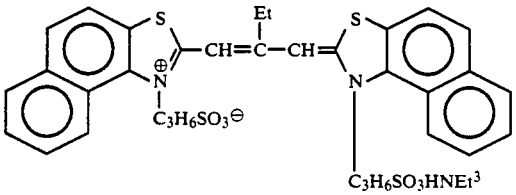

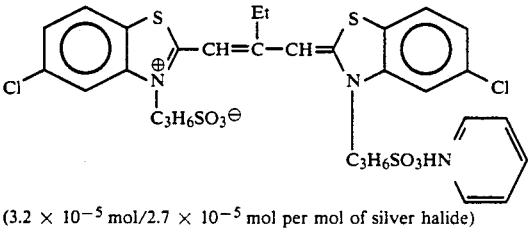

($3.2\times10^{-5}$ mol/$2.7\times10^{-5}$ mol per mol of silver halide)

(Dye-5)

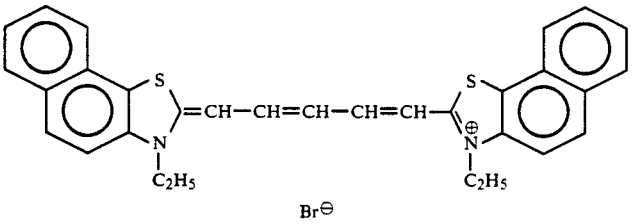

Added in an amount of $3.5\times10^{-5}$ mol per mol of silver halide, and (IV-1) was used conjointly in an amount of $2.6\times10^{-3}$ mol/mol·Ag.

Dye (III-1)

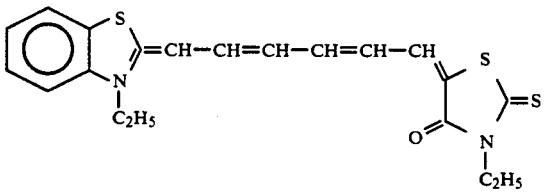

$1.7\times10^{-5}$ mol per mol of silver halide, used conjointly with $2.6\times10^{-3}$ mol/mol·Ag of (IV-1).

The samples described above were subjected to laser exposure. The laser exposing device "exposing device-1" was used for the samples in which Dye-1, Dye-2 and Dye-3 had been used as sensitizing dyes and the laser exposing device "exposing device-2" was used for exposing the samples in which Dye-4, Dye-5 and Dye-6 had been used as sensitizing dyes.

The exposing devices used in this example are described below.

Exposing Device-1

The lasers used in this device were a GaAs laser (oscillating wavelength about 900 nm), an LD excited YAG laser (oscillating wavelength about 1064 nm) and an InGaAs laser (oscillating wavelength about 1300 nm) and a non-linear optical element was used in each case to extract the secondary higher harmonic wave (wavelengths 450 nm, 532 nm and 650 nm respectively). The device was assembled in such a way that the wavelength converted blue, green and red laser light were directed sequentially by a rotating multi-surfaced body to expose the color printing paper which was being moved in a direction at right angles to the scanning direction. The exposure was controlled by controlling the semiconductor laser light outputs electrically.

Exposing Device-2

The semiconductor lasers used were an AlGaInP semiconductor laser (oscillating wavelength about 670 nm), a GaAlAs semiconductor laser (oscillating wavelength about 750 nm) and a GaAlAs semiconductor laser (oscillating wavelength about 810 nm). The device was assembled in such a way that the wavelength converted blue, green and red laser light were directed sequentially by a rotating multi-surfaced body to expose the color printing paper which was being moved in the direction at right angles to the scanning direction. The exposure was controlled by controlling the semiconductor laser light outputs electrically.

In order to determine the density of each layer varied with the passage of time after exposure but before development processing, the exposures were controlled to provide a yellow, magenta and cyan densities of 1.0 and development was started 10 seconds after exposure. Next, samples which had been subjected to a similar exposure were developed and processed in the same way as before but after being left to stand for a period of 5 minutes after exposure, and the variation in density from 1.0 was measured in each case. The time taken to complete the exposure was about 1 minute. The results obtained are shown in Table 2.

The development processing was as indicated below.

| Processing Steps | Temperature | Time |
|---|---|---|
| Color development | 35° C. | 45 seconds |
| Bleach-fix | 30 to 35° C. | 45 seconds |
| Rinse (1) | 30 to 35° C. | 20 seconds |
| Rinse (2) | 30 to 35° C. | 20 seconds |
| Rinse (3) | 30 to 35° C. | 20 seconds |
| Rinse (4) | 30 to 35° C. | 30 seconds |
| Drying | 70 to 80° C. | 60 seconds |

(A four tank counter-flow system from rinse (1) to rinse (4))

-continued

| | |
|---|---|
| by Ciba Geigy) | |
| Water to make up to | 1000 ml |
| pH (25° C.) | 10.10 |
| Bleach-fix Bath | |
| Water | 400 ml |
| Ammonium thiosulfate (70% aqueous solution) | 100 ml |
| Sodium sulfite | 18 grams |
| Ethylenediamine tetra-acetic acid Fe(III) ammonium salt | 55 grams |
| Disodium ethylenediamine tetra-acetic acid | 3 grams |
| Ammonium bromide | 40 grams |
| Glacial acetic acid | 8 grams |
| Water to make up to | 1000 ml |
| pH (25° C.) | 5.5 |
| Rinse Bath | |
| Ion exchanged water (Both calcium and magnesium less than 3 ppm) | |

Samples c', d' and e' were prepared in the same manner as Samples c, d and e, respectively, except that Dye-11 was not incorporated into the Fourth layer (ultraviolet absorbing layer). The maximum absorbing wavelength of Dye-11 in the layer was about 765 nm. The thus obtained Samples were subjected to the tests in the same manner as Samples c, d and e. The results obtained are shown in Table 3.

The same Samples as Samples d, c, d' and e' were contacted tightly with a square wave chart for determination of CTF and exposed using a light having a wavelength of 730 nm through an interference filter having a maximum transmission at 730 nm. The Samples exposed were developed and the density was measured with a microdensitometer to obtain CTF values (line number/mm at 50% gain).

The results obtained are also shown in Table 3.

TABLE 2

| | a | b | c | d | e | f | g |
|---|---|---|---|---|---|---|---|
| ΔD yellow | +0.18 | +0.11 | +0.13 | +0.08 | +0.02 | −0.10 | −0.19 |
| ΔD Magenta | +0.16 | +0.10 | +0.12 | +0.06 | +0.01 | −0.12 | −0.22 |
| ΔD Cyan | +0.07 | +0.04 | +0.04 | +0.03 | −0.02 | −0.18 | −0.25 |
| Remarks | Comparative example | Comparative example | Comparative example | Comparative example | This invention | Comparative example | Comparative example |

ΔD = ΔD after 5 min. − ΔD after 10 sec.

TABLE 3

| | c' | d' | e' | d | e |
|---|---|---|---|---|---|
| ΔD yellow | +0.13 | +0.10 | +0.03 | | |
| ΔD Magenta | +0.12 | +0.10 | +0.03 | | |
| ΔD Cyan | +0.05 | +0.06 | +0.04 | | |
| ΔD Magenta CTF (50% line number/mm) | — | 11 | 12 | 14 | 16 |
| Remarks | Comparative example | Comparative example | This invention | Comparative example | This invention |

The composition of each processing solution was as indicated below.

| Color Development Solution | |
|---|---|
| Water | 800 ml |
| Ethylenediamine-N,N,N',N'-tetramethylphosphonic acid | 1.5 grams |
| Triethanolamine | 5.0 grams |
| Sodium chloride | 1.4 grams |
| Potassium carbonate | 25 grams |
| N-Ethyl-N-(β-methanesulfonamidoethyl)-3-methyl-4-aminoaniline sulfate | 5.0 grams |
| N,N-Diethylhydroxyamine | 4.2 grams |
| Fluorescent whitener (UVITEX CK, made | 2.0 grams |

It is clear from the results outlined above that there is no change in the color density formed when the time after laser exposure but prior to development is changed, and that stable images can be obtained by following the present invention.

Samples containing no Dye-11, especially Samples d' and e', more especially Sample e' showed increased ΔD, especially increased ΔD Magenta and ΔD Cyan. Improved resolving power (CTF (50%)) can also be seen when Dye-11 was used.

In the silver halide emulsion which was infrared sensitized according on the present invention, the use of a dye having absorption wavelength of longer than 670 nm provides an advantageous effect in decreasing of ΔD.

EXAMPLE 2

Tests were carried out in the same way as in Example 1 using Dye-7 (λmax=780 nm) and Dye-8 (λmax=810 nm) in place of the Dye-5 and Dye-6. An oscillating wavelengths 780 nm and 830 nm of GaAlAs semiconductor lasers were used in place of those of oscillating wavelengths 750 nm and 810 nm in exposing device-2.

The results indicate that the desired effect of the present invention was the same as before.

Dye-7

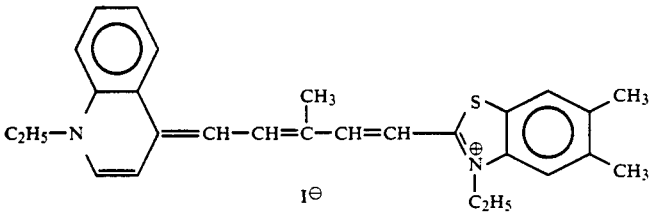

($2.5 \times 10^{-5}$ mol per mol of silver halide)
(Used conjointly with $2.6 \times 10^{-3}$ mol/mol.Ag of (IV-1))

Dye-8

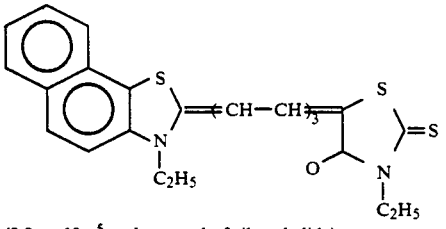

($2.0 \times 10^{-5}$ mol per mol of silver halide)
(Used conjointly with $2.6 \times 10^{-3}$ mol/mol.Ag of (IV-1))

EXAMPLE 3

Tests were carried out in the same way as Example 2 using Dye-9 (λmax=870 nm) in place of Dye-8. Oscillating wavelength 880 nm of a GaAlAs semiconductor laser was used in place of oscillating wavelength 830 nm.

The results indicate that the desired effect of the present invention was remarkable in the same way as before.

Dye-9

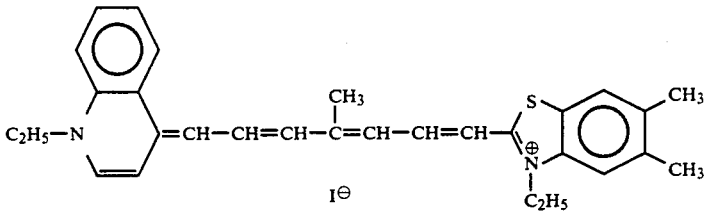

($2.0 \times 10^{-5}$ mol per mol of silver halide)
(Used conjointly with $2.6 \times 10^{-3}$ mol/mol.Ag of (IV-1))

EXAMPLE 4

Samples h, i, j, k, l and m were prepared in the same way as samples c, d and e in Example 1 except that the prescribed quantities of sensitizing dyes and super-sensitizing agents shown in Table 4 were used in the fifth layer. Latent image stability was tested in the same way as in Example 1 using these samples. The results obtained for the cyan layer are shown in Table 4.

TABLE 4

| Sample | h | i | j | k | l | m |
|---|---|---|---|---|---|---|
| Emulsion | B-1 | B-1 | A-2 | B-1 | B-1 | A-2 |
| Dye Used | Dye-3 | Dye-6 | Dye-6 | Dye-3 | Dye-6 | Dye-6 |
| Amount Used ($\times 10^{-4}$ mol/mol silver halide | 0.9 | 0.17 | 0.17 | 0.9 | 0.17 | 0.17 |
| Super-sensitizing agent | IV-1 | IV-1 | IV-1 | V-6 | V-6 | V-6 |
| Amount Used ($\times 10^{-3}$ mol/mol silver halide | 2.6 | 2.6 | 2.6 | 1.5 | 1.5 | 1.5 |
| ΔD Cyan | +0.13 | +0.06 | −0.01 | +0.15 | +0.04 | −0.01 |
| Remarks | Comparative | Comparative | This | Comparative | Comparative | This |

TABLE 4-continued

| Sample | h | i | j | k | l | m |
|---|---|---|---|---|---|---|
| | example | example | invention | example | example | invention |

It is clear from the results shown in Table 4 that a pronounced improvement in latent image stability is achieved with emulsions in which the super-sensitizing agents (VI-1) and (V-6) of the present invention are used with the sensitizing dyes of the present invention.

EXAMPLE 5

Preparation of Silver Halide Emulsions D-1 and D-2

Lime treated gelatin (32 grams) was added to 1000 ml of distilled water and a solution was obtained at 40° C., after which 3.3 grams of sodium chloride was added and the temperature was raised to 60° C. A 1% aqueous solution (3.2 ml) of N,N'-dimethylimidazolidine-2-thione was then added to the solution. Next, a solution obtained by dissolving 32.0 grams of silver nitrate in 200 ml of distilled water and a solution obtained by dissolving 9.0 grams of potassium bromide and 6.6 grams of sodium chloride in 200 ml of distilled water were added to, and mixed with, the aforementioned solution over a period of 12 minutes while maintaining a temperature of 60° C. Moreover, a solution obtained by dissolving 128.0 grams of silver nitrate in 560 ml of distilled water and a solution obtained by dissolving 35.9 grams of potassium bromide and 26.4 grams of sodium chloride in 560 ml of distilled water were added to, and mixed with, the aforementioned mixture over a period of 20 minutes while maintaining a temperature of 60° C. The temperature was reduced to 40° C. after the addition of the aqueous solutions of silver nitrate and alkali metal halides had been completed and the mixture was desalted and washed with water. Then lime treated gelatin (90.0 grams) was added and, after adjusting to a pAg of 7.2 using sodium chloride, 60.0 mg of the sensitizing Dye I-4 ($\lambda max = 845$ nm) and 2.0 mg of triethylthiourea were added and the emulsion was optimally chemically sensitized at 58° C. The silver chlorobromide emulsion D-1 was thus obtained (silver bromide content 40 mol %).

An emulsion (D-2) was prepared which the only difference from emulsion D-1 was that the dye added prior to chemical sensitization was changed from Dye I-4 to Dye I-9 ($\lambda max = 740$ nm).

Preparation of Silver Halide Emulsions E-1 and E-2

Lime treated gelatin (32 grams) was added to 1000 ml of distilled water and a solution was obtained at 40° C., after which 3.3 grams of sodium chloride was added and the temperature was raised to 60° C. A 1% aqueous solution (3.2 ml) of N,N'-dimethylimidazolidine-2-thione was then added to the solution. Next, a solution obtained by dissolving 32.0 grams of silver nitrate in 200 ml of distilled water and a solution obtained by dissolving 2.26 grams of potassium bromide and 9.95 grams of sodium chloride in 200 ml of distilled water were added to, and mixed with, the aforementioned solution over a period of 12 minutes while maintaining a temperature of 60° C. Moreover, a solution obtained by dissolving 128.0 grams of silver nitrate in 560 ml of distilled water and a solution obtained by dissolving 8.93 grams of potassium bromide and 39.7 grams of sodium chloride in 560 ml of distilled water were added to, and mixed with, the aforementioned mixture over a period of 20 minutes while maintaining a temperature of 60° C. The temperature was reduced to 40° C. after the addition of the aqueous solutions of silver nitrate and alkali metal halides had been completed and the mixture was desalted and washed with water. Lime treated gelatin (90.0 grams) was then added and, after adjusting to a pAg of 7.2 using the sodium chloride, 60.0 mg of the sensitizing dye I-4 and 2.0 mg of triethylthiourea were added and the emulsion was optimally chemically sensitized at 58° C. The silver chlorobromide emulsion E-1 was thus obtained (silver bromide content 10 mol %).

An emulsion (E-2) was prepared in which the only difference from emulsion E-1 was that the dye added prior to chemical sensitization was changed from Dye I-4 to Dye I-9.

Preparation of Silver Halide Emulsions F 1 and F-2

Lime treated gelatin (32 grams) was added to 1000 ml of distilled water and a solution was obtained at 40° C., after which 3.3 grams of sodium chloride was added and the temperature was raised to 60° C. A 1% aqueous solution (3.2 ml) of N,N'-dimethylimidazolidine-2-thione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 8 minutes while maintaining a temperature of 60° C. Moreover, a solution obtained by dissolving 128.0 grams of silver nitrate in 560 ml of distilled water and a solution obtained by dissolving 44.0 grams of sodium chloride in 560 ml of distilled water were added to, and mixed with, the aforementioned mixture over a period of 20 minutes while maintaining a temperature of 60° C. The temperature was reduced to 40° C. after the addition of the aqueous solutions of silver nitrate and alkali metal halides had been completed and the mixture was desalted and washed with water. Lime treated gelatin (90.0 grams) was then added and, after adjusting to a pAg of 7.2 using sodium chloride, 60.0 mg of the sensitizing dye I-4 and 2.0 mg of triethylthiourea were added and the emulsion was optimally chemically sensitized at 58° C. The silver chloride emulsion F-1 was thus obtained.

An emulsion (F-2) was prepared in which the only difference from emulsion F-1 was that the dye added prior to chemical sensitization was changed from Dye I-4 to Dye I-9.

Preparation of Silver Halide Emulsions G-1 and G 2

Lime treated gelatin (32 grams) was added to 1000 ml of distilled water and a solution was obtained at 40° C., after which 3.3 grams of sodium chloride was added and the temperature was raised to 60° C. A 1% aqueous solution (3.2 ml) of N,N'-dimethylimidazolidine-2-thione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 8 minutes while maintaining a temperature of 60° C. Moreover, a solution obtained by dissolving 125.6 grams of silver nitrate in 560 ml of distilled water and a solution obtained by dissolving 41.0 grams of sodium chloride in 560 ml of distilled water were added to, and mixed with, the aforementioned mixture over a period of 20 minutes while maintaining a temperature of 60° C. The sensitizing dye I-4 (60.0 mg) was added after the addition of the aqueous solutions of silver nitrate and alkali metal halide had been completed. After maintaining at 60° C. for a period of 10 minutes, the temperature was reduced to 40° C. and an aqueous solution obtained by dissolving 2.4 grams of silver nitrate in 20 ml of distilled water and an aqueous solution obtained by dissolving 1.35 grams of potassium bromide and 0.17 grams of sodium chloride in 20 ml of distilled water were added to, and mixed with, the mixture over a period of 5 minutes while maintaining at a temperature of 40° C., after which the mixture was desalted and washed with water. Lime treated gelatin (90.0 grams) was then added and, after adjusting to a pAg of 7.2 using a sodium chloride solution, 2.0 mg of triethylthiourea were added and the emulsion was optimally chemically sensitized at 58° C. The silver chlorobromide emulsion G-1 (silver bromide content 1.2 mol %) was thus obtained.

An emulsion (G-2) was prepared in which the only difference from emulsion G-1 was that the dye added during grain formation was changed from Dye I-4 to Dye I-9.

The form of the grains, the grain size and the grain size distribution for each of the eight types of silver halide emulsions D-1 to G-2 prepared in this way were obtained from electron micrographs. The silver halide grains contained in the emulsions D-1 to G-2 were all cubic grains. The grain size was represented in terms of the average value of the diameters of circles which had the same areas as the projected areas of the grains, and the value obtained by dividing the standard deviation of the grain diameters by the average grain size was used for the grain size distribution. Moreover, the halogen composition of the emulsion grains was determined by measuring X-ray diffraction due of the silver halide crystals. The results obtained are shown in Table 6.

Various super-sensitizing agents and additives were added to the silver halide emulsions (D-1) to (G-2), as shown in Table 7, and an emulsified dispersion containing a cyan coupler was mixed with each of the emulsions so obtained. The resulting mixtures having the compositions as shown in Table 5 were coated onto a paper support which had been laminated on both sides with polyethylene to provide samples 1 to 43. 1-Oxy-3,5-dichloro-s-triazine sodium was used as a gelatin hardening agent.

TABLE 5

| Layer | Principal Composition | Amount Used |
|---|---|---|
| Second Layer (Protective layer) | Gelatin | 1.50 g/m$^2$ |
| First Layer (Red sensitive layer) | Silver Halide Emulsion | 0.24 g/m$^2$ |
| | Gelatin | 0.96 g/m$^2$ |
| | Cyan Coupler (a) | 0.38 g/m$^2$ |
| | Color image (b) stabilizer | 0.17 g/m$^2$ |
| | Solvent (c) | 0.23 ml/m$^2$ |
| Support | Polyethylene laminated paper ($TiO_2$ and ultramarine included in the polyethylene on the first layer side) | |

Coated weight of silver halide emulsion shown as the weight calculated as silver

TABLE 6

| Emulsion | Grain form | Grain size (μm) | Size distribution | Halogen composition of grains by x-ray diffraction |
|---|---|---|---|---|
| D-1 | Cubic | 0.50 | 0.09 | AgCl content: 60 mol % uniform |
| D-2 | " | 0.50 | 0.09 | AgCl content: 60 mol % uniform |
| E-1 | " | 0.51 | 0.09 | AgCl content: 90 mol % uniform |
| E-2 | " | 0.51 | 0.09 | AgCl content: 90 mol % uniform |
| F-1 | " | 0.52 | 0.08 | AgCl content: 100 mol % uniform |
| F-2 | " | 0.52 | 0.08 | AgCl content: 100 mol % uniform |
| G-1 | " | 0.52 | 0.08 | Local phase AgBr content: 10 to 39% |
| G-2 | " | 0.52 | 0.08 | Local phase AgBr content: 10 to 39% |

(a) Cyan Coupler

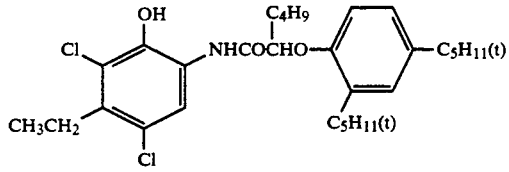

(b) Color Image Stabilizer
A 1:3:3 (mol ratio) mixture of:

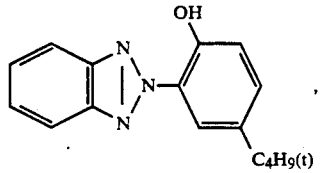

TABLE 6-continued

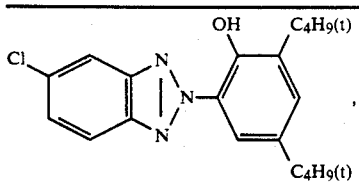

and

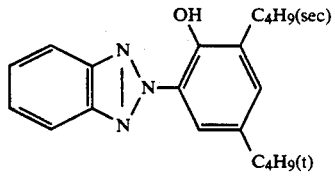

(c) Solvent

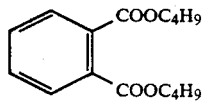

Spectral sensitivity, fogging, the extent of the variation in photographic speed due to changes in the exposure temperature and the extent of the variation in photographic speed due to natural storage were tested using the methods indicated below with the coated samples 1 to 43 in which these eight types of silver halide emulsion had been used.

The coated samples were subjected to a 0.5 second exposure through an optical wedge and a red filter while being maintained at 15° C. and 55% relative humidity, or 35° C. and 55% relative humidity, and then they were color developed and processed using the development processing steps and the development solution described in Example 1 in order to evaluate the extent of the variation in photographic speed due to a variation in the exposure temperature. Furthermore, coated samples were aged for 3 months under conditions of 30° C. to 40% and then they were exposed and processed in the same way as before after being maintained under conditions of 15° C. to 55% prior to exposure in order to evaluate the extent of the variation in photographic speed due to natural storage.

Furthermore, samples were exposed through an optical wedge and band pass interference filters which had a high transmittance in the vicinity of 750 nm and 830 nm for the red filter and these samples were color developed and processed in the same way as before.

The reflection densities of the processed samples so obtained were measured and characteristics curves were obtained. The change in density ΔD on exposing at 35° C. and 55% relative humidity at the exposure which gave a density of 1.0 when exposed at 15° C. and 55% relative humidity was taken as a measure of the change in photographic speed due to the variation in the exposure temperature. The change in density ΔD(aged) with the aged samples at the exposure which gave a density of 1.0 on exposing the fresh samples at 15° C. and 55% relative humidity was taken as a measure of the extent of the variation in photographic speed due to natural storage. The results obtained are shown in Table 7.1 and 7.2.

TABLE 7.1

| Sample No. | Emulsion No. | Sensitizing Dye | Super-sensitizing Agent ($\times 10^{-3}$ mol/mol Ag) [IV] | [V] | [VI] | [VII] | Aldehyde condensate of [VIIIa] |
|---|---|---|---|---|---|---|---|
| 1 | D-1 | I-4 | | | | | |
| 2 | " | " | | | VI-9 1 | | |
| 3 | E-1 | " | | | | | |
| 4 | " | " | | | VI-9 1 | | |
| 5 | F-1 | " | | | VI-9 1 | | |
| 6 | G-1 | " | | | VI-9 1 | | |
| 7 | E-1 | " | IV-3 2 | | VI-9 1 | | |
| 8 | " | I-4 | IV-3 4 | | VI-9 1 | | |
| 9 | F-1 | " | IV-3 2 | | VI-9 1 | | |
| 10 | " | " | IV-3 4 | | VI-9 1 | | |
| 11 | G-1 | " | IV-3 2 | | VI-9 1 | | |
| 12 | " | " | IV-3 4 | | VI-9 1 | | |
| 13 | E-1 | " | IV-3 2 | V-3 1 | VI-9 1 | | |
| 14 | F-1 | " | IV-3 2 | V-3 1 | VI-9 1 | | |
| 15 | G-1 | " | IV-3 2 | V-3 1 | VI-9 1 | | |
| 16 | E-1 | " | | V-3 1 | VI-9 1 | | |
| 17 | F-1 | " | | V-3 1 | VI-9 1 | | |
| 18 | G-1 | " | | V-3 1 | VI-9 1 | | |
| 19 | E-1 | " | | | VI-8 1 | VII-8 1 | VIII-7* 2 |
| 20 | F-1 | " | | | VI-8 1 | VII-8 1 | VIII-7* 2 |

TABLE 7.1-continued

| | | | | | | | |
|---|---|---|---|---|---|---|---|
| 21 | G-1 | " | | | VI-8 1 | VII-8 1 | VIII-7* 2 |
| 22 | F-1 | I-4 | IV-3 3 | V-3 1 | VI-8 0.5 | VII-8 1 | VIII-7* 1 |
| 23 | G-1 | " | IV-3 3 | V-3 1 | VI-8 0.5 | VII-8 1 | VIII-7* 1 |

| Sample No. | Red, Infrared Speed (Relative) | Principal Wavelength Speed (Relative) | Change In Ageing ΔD | Fog. | Remarks | |
|---|---|---|---|---|---|---|
| 1 | 92 | 84 (830 nm) | −0.18 | 0.15 | (Comparative Ex.) | slight development failure |
| 2 | 94 | 84 | −0.15 | 0.13 | " | slight development failure |
| 3 | 93 | 94 | −0.18 | 0.16 | " | |
| 4 | 98 | 86 | −0.10 | 0.14 | " | |
| 5 | 108 | 100 (Standard) 830 nm | −0.05 | 0.13 | " | |
| 6 | 122 | 108 | −0.03 | 0.13 | (This invention) | |
| 7 | 322 | 236 | −0.07 | 0.13 | (Comparative Ex.) | |
| 8 | 458 | 282 | −0.09 | 0.13 | " | |
| 9 | 632 | 532 | −0.05 | 0.13 | " | |
| 10 | 720 | 628 | −0.05 | 0.13 | " | |
| 11 | 645 | 555 | −0.03 | 0.12 | (This invention) | |
| 12 | 724 | 648 | −0.02 | 0.12 | " | |
| 13 | 362 | 322 | −0.06 | 0.13 | (Comparative Ex.) | |
| 14 | 712 | 638 | −0.05 | 0.13 | " | |
| 15 | 875 | 722 | 0.00 | 0.12 | (This invention) | |
| 16 | 150 | 162 | −0.10 | 0.14 | (Comparative Ex.) | |
| 17 | 232 | 228 | −0.04 | 0.13 | " | |
| 18 | 252 | 232 | +0.01 | 0.13 | (This invention) | |
| 19 | 162 | 140 | −0.05 | 0.12 | (Comparative Ex.) | |
| 20 | 278 | 242 | −0.05 | 0.12 | " | |
| 21 | 278 | 262 | −0.01 | 0.12 | (This invention) | |
| 22 | 722 | 640 | −0.05 | 0.13 | (Comparative Ex.) | |
| 23 | 862 | 730 | 0.00 | 0.12 | (This invention) | |

VIII-7*: Aldehyde condensate of VIII-7

TABLE 7.2

| Sample No. | Emulsion No. | Sensitizing Dye | Super-sensitizing Agent ($\times 10^{-3}$ mol/mol Ag) [IV] | [V] | [VI] | [VII] | Aldehyde condensate of [VIIIa] |
|---|---|---|---|---|---|---|---|
| 24 | D-2 | I-9 | | | | | |
| 25 | " | " | | | VI-9 1 | | |
| 26 | E-2 | " | | | | | |
| 27 | " | | | | VI-9 1 | | |
| 28 | F-2 | " | | | VI-9 1 | | |
| 29 | G-2 | " | | | VI-9 1 | | |
| 30 | E-2 | " | IV-3 2 | | VI-9 1 | | |
| 31 | F-2 | " | IV-3 2 | | VI-9 1 | | |
| 32 | G-2 | " | IV-3 2 | | VI-9 1 | | |
| 33 | E-2 | " | IV-3 2 | V-3 1 | VI-9 1 | | |
| 34 | F-2 | " | IV-3 2 | V-3 1 | VI-9 1 | | |
| 35 | G-2 | " | IV-3 2 | V-3 1 | VI-9 1 | | |
| 36 | E-2 | " | | V-3 1 | VI-9 1 | | |
| 37 | F-2 | " | | V-3 1 | VI-9 1 | | |
| 38 | G-2 | " | | V-3 1 | VI-9 1 | | |
| 39 | E-2 | " | | | VI-8 1 | VII-8 1 | VIII-7* 2 |
| 40 | F-2 | " | | | VI-8 1 | VII-8 1 | VIII-7* 2 |
| 41 | G-2 | " | | | VI-8 1 | VII-8 1 | VIII-7* 2 |
| 42 | F-2 | " | IV-3 2 | V-3 1 | VI-8 0.5 | VII-8 1 | VIII-7* 1 |
| 43 | G-2 | " | IV-3 2 | V-3 1 | VI-8 0.5 | VII-8 1 | VIII-7* 1 |

| Sample No. | Red, Infrared Speed (Relative) | Principal Wavelength Speed (Relative) | Change In Ageing AD | Fog. | Remarks | |
|---|---|---|---|---|---|---|
| 24 | 90 | 90 (750 nm) | −0.15 | 0.16 | (Comparative Ex.) | slight development failure |
| 25 | 96 | 94 | −0.10 | 0.14 | " | slight development failure |
| 26 | 90 | 86 | −0.18 | 0.17 | " | |
| 27 | 92 | 92 | −0.12 | 0.14 | " | |
| 28 | 100 | 100 (Standard) | −0.09 | 0.14 | " | |
| 29 | 112 | 112 | −0.03 | 0.13 | (This invention) | |
| 30 | 322 | 256 | −0.10 | 0.13 | (Comparative Ex.) | |
| 31 | 476 | 250 | −0.06 | 0.13 | " | |
| 32 | 568 | 545 | −0.02 | 0.12 | (This invention) | |
| 33 | 342 | 298 | −0.08 | 0.13 | (Comparative Ex.) | |
| 34 | 708 | 620 | −0.05 | 0.13 | " | |
| 35 | 722 | 630 | −0.01 | 0.12 | (This invention) | |
| 36 | 122 | 118 | −0.07 | 0.12 | (Comparative Ex.) | |

TABLE 7.2-continued

| | | | | | |
|---|---|---|---|---|---|
| 37 | 132 | 132 | −0.05 | 0.13 | " |
| 38 | 162 | 148 | +0.02 | 0.13 | (This invention) |
| 39 | 150 | 132 | −0.07 | 0.12 | (Comparative Ex.) |
| 40 | 262 | 248 | −0.05 | 0.12 | " |
| 41 | 308 | 252 | −0.02 | 0.11 | (This invention) |
| 42 | 700 | 620 | 0.04 | 0.12 | (Comparative Ex.) |
| 43 | 732 | 630 | 0.00 | 0.11 | (This invention) |

When sensitizing Dye I-4 was replaced by sensitizing Dyes I-2, I-3, I 11, I-12, I-13, I-16, I-17, III-1 or III-4, for example, similar super-sensitizing effects were also observed. Furthermore, when the sensitizing Dye I-9 was replaced by sensitizing Dyes I-6, I-7, I-8, I-10 and II-1, for example, a similar trend was also observed.

It is clear from the results shown in Table 7.1 and Table 7.2 that the silver halide emulsions of the present invention provide speeds and gradations which are stable with a 45 second color development process. Moreover, it is possible to increase the spectral sensitivity by a factor of several times without adversely affecting the ageing stability by using super-sensitizing agents, and especially compounds represented by the general formulae (IV) and (V), conjointly in accordance with the present invention. Furthermore, the occurrence of fogging and staining can be suppressed without reducing the photographic speed when super-sensitizing agents represented by the general formulae (VI), (VII) and (VIIIa) in particular are used together with silver halide emulsions and sensitizing dyes in accordance with the present invention.

EXAMPLE 6

Processing Variation Test

Photosensitive material samples b, d, e and g prepared in Example 1 were exposed using the exposure device 2 described in Example 1 to provide exposed samples so that each of the yellow, magenta and cyan densities on an initial development processing using the color development processing indicated below were 1.0.

The same samples as Samples b, d, e and g were obtained and subjected separately to an imagewise exposure. The samples were then subjected to color development processing continuously to make the color development solution fatigue by replenishing the solution until the amount of the replenishment became twice the color development tank capacity. Then the same samples as Samples b, d, e and g were subjected to the same exposure under the conditions set initially using the aforementioned exposing device-2 and these samples were subjected to a color development processing using the continuously processed developing solution.

Density measurements were then made, and the changes in density of the samples after continuous processing to a two-fold replenishment were obtained. The results are shown in Table 8.

| Processing Steps | Temperature | Time | Replenishment Amount* | Tank Capacity |
|---|---|---|---|---|
| Color Development | 38° C. | 45 seconds | 90 ml | 4 liters |
| Bleach-fix | 30 to 36° C. | 45 seconds | 61 ml | 4 liters |
| Water Wash (1) | 30 to 37° C. | 30 seconds | — | 2 liters |
| Water Wash (2) | 30 to 37° C. | 30 seconds | — | 2 liters |
| Water Wash (3) | 30 to 37° C. | 30 seconds | 364 ml | 2 liters |

-continued

| Processing Steps | Temperature | Time | Replenishment Amount* | Tank Capacity |
|---|---|---|---|---|
| Drying | 70 to 85° C. | 60 seconds | | |

*Per square meter of photosensitive material.
[Water washing carried out with a three tank counter flow system from water wash (3) to water wash (1).
The bleach-fix bath replenished with 122 ml/square meter of sensitive material of water wash (1)]

The composition of each processing bath was as follows:

| | Tank | Replenisher |
|---|---|---|
| Color Development Solution | | |
| Water | 800 ml | 800 ml |
| Ethylenediamine-N,N,N',N'-tetramethylenephosphonic acid | 3.0 grams | 3.0 grams |
| Triethanolamine | 8.0 grams | 12.0 grams |
| Sodium chloride | 1.4 grams | — |
| Potassium bromide | 0.12 gram | — |
| Potassium carbonate | 25 grams | 26 grams |
| N-Ethyl-N-(β-methanesulfonamidoethyl)-3-methyl-4-aminoaniline sulfate | 5.0 grams | 9.0 grams |
| N,N-Bis(carboxymethyl)-hydrazine | 4.5 grams | 7.4 grams |
| Fluorescent whitener (Whitex-4, made by Sumitomo Chemicals) | 1.0 gram | 2.5 grams |
| Water to make up to | 1000 ml | 1000 ml |
| pH (25° C.) | 10.05 | 10.55 |
| Bleach-Fix Solution | | |
| Water | 400 ml | |
| Ammonium thiosulfate (70% aqueous solution) | 100 ml | |
| Ammonium sulfite | 38 grams | |
| Ethylenediamine tetra-acetic acid Fe(III) ammonium salt | 55 grams | |
| Ethylenediamine tetra-acetic acid disodium salt | 5 grams | |
| Glacial acetic acid | 9 grams | |
| Water to make up to | 1000 ml | |
| pH (25° C.) | 5.40 | |
| Replenisher | | |
| A 2.5 times concentrate of the tank solution. | | |
| Water Washing Bath (Tank = Replenisher) | | |
| Ion exchanged water (Calcium and magnesium both less than 3 ppm) | | |

Moreover, continuous processing was carried out while adding distilled water to make up for any loss by evaporation of the development solution, the bleach-fix solution or the water washing solution.

TABLE 8

| Sample | b | d | e | g |
|---|---|---|---|---|
| ΔD Yellow | +0.05 | −0.02 | +0.02 | −0.25 |
| ΔD Magenta | +0.05 | +0.02 | 0.00 | −0.12 |
| ΔD Cyan | +0.06 | −0.05 | −0.03 | −0.15 |

With sample e, the range of the variation was ±0.03 and there was no marked loss of color density. With sample g, the initial progress of color development was retarded and there was a fall in color density in continuous processing.

It is possible by means of the present invention to obtain full color recording materials with stable and high picture quality colored images and which can be written-in in a short period of time (for example within about 30 seconds for an A4 sized sheet) using a write-in device in which semiconductor laser light beams are used. Moreover, these materials can be developed easily and rapidly in a short period of time within 180 seconds to match the short write-in time.

While the present invention has been described in detail and with reference to specific embodiments thereof, it will be apparent to one skilled in the art that various changes and modifications can be made therein without departing from the spirit and scope thereof.

What is claimed is:

1. A full color recording material which has, on a support, at least one light-insensitive hydrophilic colloid layer and at least three silver halide photosensitive emulsion layers which have different color sensitivities and which contain a yellow coupler, magenta coupler and cyan coupler, respectively, and in which at least two of these layers are selectively spectrally sensitized to match semiconductor laser light beams of wavelengths greater than 670 nm, wherein said at least three silver halide photosensitive layers which have different color sensitivities each contains silver chlorobromide grains with a layer average silver chloride content of from 96 to 99.9 mol %, and said silver chlorobromide grains have a silver bromide local phase of which the silver bromide content is higher than that of the surroundings thereof, wherein said silver chlorobromide grains having a silver bromide local phase are contained in an amount of at least 50 mol % based on the silver halide contained in the emulsion containing the silver chlorobromide grains;

the silver bromide content in the silver bromide local phase is from 20 to 60%;

at least one of said spectrally sensitized silver halide photosensitive layers is spectrally sensitized selectively using at least one of a sensitizing dye selected from the group consisting of compounds represented by the general formulae (I), (II), (II)' and (III) to match the wavelength of a semiconductor laser light beam in any of the wavelength regions 660 to 690 nm, 740 to 790 nm, 800 to 850 nm and 850 to 900 nm:

(I)

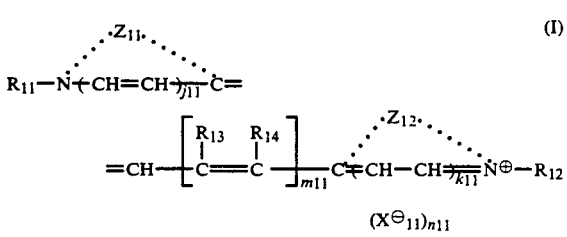

wherein $Z_{11}$ and $Z_{12}$ each represents a group of atoms which forms a heterocyclic ring of five or six members and contains at least one of a nitrogen atom, a sulfur atom, an oxygen atom, a selenium atom and a tellurium atom as a hetero-atom, said ring may be a condensed ring, and may be substituted with at least one substituent, $R_{11}$ and $R_{12}$ each represents an alkyl group, an alkenyl group, an alkynyl group or an aralkyl group, $m_{11}$ represents a positive integer of 2 or 3, $R_{13}$ represents a hydrogen atom, and $R_{14}$ represents a hydrogen atom, a lower alkyl group or an aralkyl group, or $R_{14}$ may be joined with $R_{12}$ to form a five or six membered ring, and when $R_{14}$ represents a hydrogen atom, $R_{13}$ may be joined with another $R_{13}$ group to form a hydrocarbonyl or heterocyclic ring, $j_{11}$ and $k_{11}$ each represents 0 to 1, $X\ominus_{11}$ represents an acid anion, and $n_{11}$, represents 0 or 1:

(II)

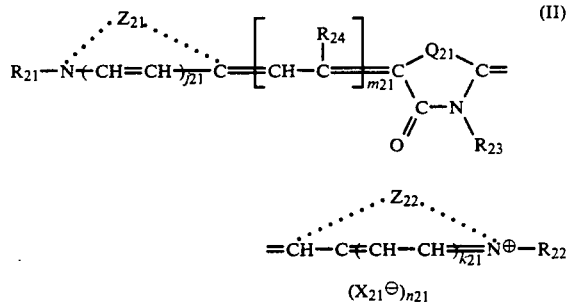

(II)'

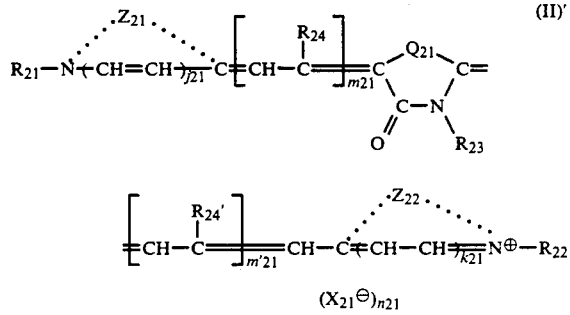

wherein $Z_{21}$ and $Z_{22}$ are the same as $Z_{11}$ and $Z_{12}$ in general formula (I), respectively, $R_{21}$ and $R_{22}$ are the same as $R_{11}$ and $R_{12}$ in general formula (I), respectively, and $R_{23}$ represents an alkyl group, an alkenyl group, an alkynyl group or an aryl group, $m_{21}$ represents an integer of 2 or 3, $R_{24}$ represents a hydrogen atom, a lower alkyl group or an aryl group, or $R_{24}$ may be joined with another $R_{24}$ group to form a hydrocarbonyl or heterocyclic ring, $Q_{21}$ represents a sulfur atom, an oxygen atom, a selenium atom or an

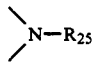

group, and $R_{25}$ is the same as $R_{23}$, $j_{21}$, $k_{21}$, $X\ominus_{21}$, and $n_{21}$ are the same as $j_{11}$, $k_{11}$, $X\ominus_{11}$ and $n_{11}$ in general formula (I), respectively, $R'_{24}$ and $m'_{21}$ are the same as $R_{24}$ and $m_{21}$, respectively:

(III)

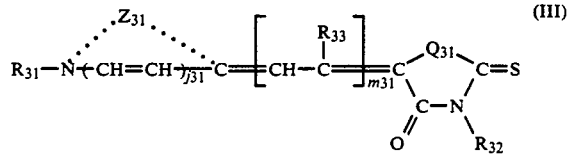

wherein $Z_{31}$ represents a group of atoms which forms a heterocyclic ring, $Q_{31}$ is the same as $Q_{21}$, in general formula (II), $R_{31}$ is the same as $R_{11}$ or $R_{12}$ in general formula (I), $R_{32}$ is the same as $R_{23}$ in general formula (II), $m_{31}$ represents an integer of 2 or 3, $R_{33}$ is the same as $R_{24}$ in general formula (II) or $R_{24}$ may be joined with an $R_{33}$ group to form a hydrocarbonyl or heterocyclic ring, and $j_{31}$ is the same as $j_{11}$ in general formula (I); and the silver bromide local phase is located on the surface of the silver halide grains.

2. The full color recording material as claimed in claim 1, wherein at least one of said light-insensitive hydrophilic colloid layers and said silver halide photosensitive emulsion layers on the support is colored with a coloring material which can be decolorized during development processing.

3. The full color recording material as claimed in claim 1, wherein said silver halide chlorobromide has a layer average silver bromide content of at least 0.1 mol %.

4. The full color recording material as claimed in claim 1, wherein said silver halide emulsions are supersensitized using compounds selected from the group consisting of compounds represented by the general formulae (IV), (V), (VI), (VII), and condensates of a compound represented by formula (VIIIa), (VIIIb) or (VIIIc) and formaldehyde:

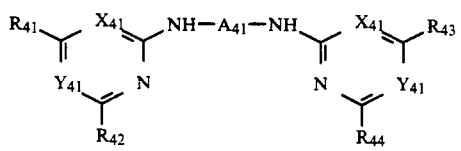
(IV)

wherein $A_{41}$ represents a divalent aromatic residual group, $R_{41}$, $R_{42}$, $R_{43}$ and $R_{44}$ each represents a hydrogen atom, a hydroxyl group, an alkyl group, an alkoxy group, an aryloxy group, a halogen atom, a heterocyclic nucleus, an alkylthio group, a heterocyclylthio group, an arylthio group, an amino group, an alkylamino group, an arylamino group, a heterocyclylamino group, an aralkylamino group, an aryl group or a mercapto group, which may be substituted or unsubstituted, and at least one of the groups represented by $A_{41}$, $R_{41}$, $R_{42}$, $R_{43}$ and $R_{44}$ is a sulfo group, $X_{41}$ and $Y_{41}$ each represent a —CH= or —N= group, and at least one of $X_{41}$ and $Y_{41}$ represents an —N= group;

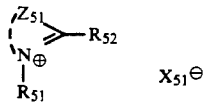
(V)

wherein $Z_{51}$ represents a group of non-metal atoms which completes a five or six membered nitrogen containing heterocyclic ring, which ring may be condensed with a benzene ring or a naphthalene ring, $R_{51}$ represents a hydrogen atom, an alkyl group or an alkenyl group, $R_{52}$ represents a hydrogen atom or a lower alkyl group, and $X_{51}\ominus$ represents an acid anion;

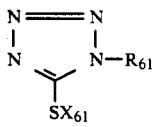
(VI)

wherein $R_{61}$ represents an alkyl group, an alkenyl group or an aryl group, and $X_{61}$ represents a hydrogen atom, an alkali metal atom, an ammonium group, or a precursor,

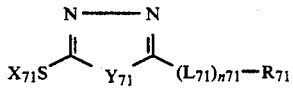
(VII)

wherein $Y_{71}$ is an oxygen atom, a sulfur atom, an =NH group or an $=N-(L_{71})_{n72}-R_{72}$ group, $n_{72}$ represents 0 or 1, $L_{71}$ represents a divalent linking group, $n_{71}$ represents 0 or 1, $R_{71}$ and $R_{72}$ each represents a hydrogen atom, an alkyl group, an alkenyl group or an aryl group, and $X_{71}$ is the same as $X_{61}$ in general formula (VI);

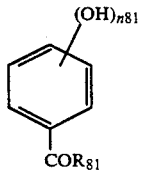
(VIIIa)

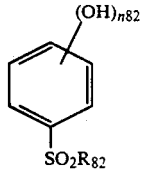
(VIIIb)

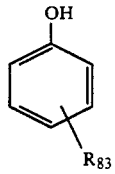
(VIIIc)

wherein $R_{81}$ and $R_{82}$ each represents —OH, $-OM_{81}$, $-OR_{84}$, $-NH_2$, $-NHR_{84}$, $-N(R_{84})_2$, $-NHNH_2$ or $-NHNHR_{84}$, $R_{84}$ represents an alkyl group having from 1 to 8 carbon atoms, an alkenyl group or an aralkyl group, $M_{81}$ represents an alkali metal atom or an alkaline earth metal atom, $R_{83}$ represents —OH or a halogen atom and $n_{81}$ and $n_{82}$ each represents an integer of 1, 2 or 3.

* * * * *